US005462424A

United States Patent [19]

Kuroyone

[11] Patent Number: 5,462,424

[45] Date of Patent: Oct. 31, 1995

[54] METALLIC DIE DEVICE FOR PRESS MACHINE

[75] Inventor: Kazuo Kuroyone, Yamato, Japan

[73] Assignee: Anritsu Corporation, Tokyo, Japan

[21] Appl. No.: 381,430

[22] Filed: Jan. 31, 1995

Related U.S. Application Data

[62] Division of Ser. No. 52,592, Apr. 23, 1993.

[30] Foreign Application Priority Data

| | | | |
|---|---|---|---|
| Apr. 24, 1992 | [JP] | Japan | 4-106916 |
| Apr. 24, 1992 | [JP] | Japan | 4-106917 |
| Apr. 27, 1992 | [JP] | Japan | 4-107953 |
| May 27, 1992 | [JP] | Japan | 4-134759 |

[51] Int. Cl.[6] ..... B30B 3/00

[52] U.S. Cl. ..... 425/150; 72/313; 72/315; 72/319; 72/384; 425/167; 425/394; 425/409

[58] Field of Search ..... 72/312, 313, 314, 72/315, 319, 384, 388; 425/150, 167, 394, 406, 409; 264/40.5, 339

[56] References Cited

U.S. PATENT DOCUMENTS

| | | | |
|---|---|---|---|
| 3,561,248 | 1/1971 | Bessho | 72/384 |
| 3,686,952 | 8/1972 | Hitosugi . | |
| 3,802,246 | 4/1974 | Goff . | |
| 3,822,160 | 7/1974 | La Barge et al. | 425/394 |
| 4,002,049 | 1/1977 | Randolph, Sr. | 72/313 |
| 4,487,051 | 12/1984 | Iwamoto | 72/315 |
| 4,520,646 | 6/1985 | Pauzin . | |
| 4,535,619 | 8/1985 | Gargrave | 72/313 |
| 4,558,582 | 12/1985 | Meinig | 72/384 |
| 4,660,402 | 4/1987 | Hongo | 72/319 |
| 5,052,913 | 10/1991 | Conliffe | 425/394 |

FOREIGN PATENT DOCUMENTS

| | | | |
|---|---|---|---|
| 0089904 | 9/1983 | France . | |
| 59-197318 | 11/1984 | Japan | 72/313 |
| 1-37214 | 8/1989 | Japan . | |
| 2-70324 | 3/1990 | Japan | 72/313 |
| 4-52031 | 2/1992 | Japan | 72/313 |
| 4-48533 | 8/1992 | Japan . | |
| 4-48532 | 8/1992 | Japan . | |
| 4-55764 | 9/1992 | Japan . | |
| WO-A8705838 | 10/1987 | WIPO . | |

OTHER PUBLICATIONS

Patent Abstract of Japan, vol. 9, No. 330 (M–442) Dec. 25, 1985 & JP–A–60 162 537 (Anritsu Denki KK) Aug. 24, 1985.

*Primary Examiner*—C. Scott Bushey

*Attorney, Agent, or Firm*—Frishauf, Holtz, Goodman, Langer & Chick

[57] ABSTRACT

A lower metallic die has a major surface for supporting a workpiece thereon. A ridgeline is formed on an end portion of the major surface and with which a bending portion of the workpiece is brought into contact. An upper metallic die has a plane surface rotatable in a bending direction of the workpiece to clamp the workpiece together with the ridgeline of the lower metallic die, thereby freely bending workpiece at one angle of desired various angles. A rotation controller controls rotation of the plane surface of the upper metallic die, thereby rotating and positioning the plane surface at a position of the one angle of the desired various angles.

9 Claims, 37 Drawing Sheets

METALLIC DIE DEVICE FOR PRESS MACHINE

This is a division of application Ser. No. 08/052,592 filed Apr. 23, 1993.

BACKGROUND OF THE INVENTION

1. Field of the Invention

The present invention generally relates to a press machine and, more particularly, to a metallic die device for a press machine, which is applied to a press machine that can bend not only the one side but the two sides of a workpiece (hereinafter referred to as "work") simultaneously, and which can correctly press a portion of the work with the same die at an arbitrary bending angle and can press the work at high precision by preventing escape and deformation of a lower metallic die; and a metallic die device for a press machine, which is applied to a press machine for bending a work, and which can bend the work in an arbitrary size and at an arbitrary angle without changing the metallic die, thereby easily pressing the work to have a box shape, and so on, 2. Description of the Related Art A recent press machine must cope with many requirements, e.g., small quantity with many items, flexibility, and high precision.

For this purpose, a press machine employing a control technique based on a computer program, i.e., a press machine using an NC device has been used in practice.

Generally, in a press machine of this type using an NC (Numerical Control) device, a work is conveyed to a pressing position and positioned there in accordance with a command from the NC device. Then, a hammer is operated by a command from the NC device to move a punch as an upper metallic die downward, and press the work present between the upper metallic die and a die serving as a lower metallic die.

Conventionally, however, when a work is to be pressed by, e.g., bending by a press machine of this type, the size of the bending width or the bending angle for bending press is changed. The bending precision corresponding to the thickness or material of the work is changed. In this manner, the press machine is stopped each time, a suitable die is selected from a large number of metallic dies, and die exchange and size adjustment are manually performed. Such a press technique has a very poor productivity and is very uneconomical since manual exchange occupies a large part of the entire press time and a large number of different dies are required because the die exchange requires several tens of minutes. In this manner, in the conventional press method, when the size of the bending width and the thickness or material are changed, fine adjustment of the size cannot be automatically performed.

The assignee of the present application solves the above drawbacks by a press machine disclosed in Published Examined Japanese Patent Application No. 1-37214.

More specifically, according to this press machine, each of the upper and lower metallic dies comprises a pair of dies. One lower metallic die is fixed, and the other lower metallic die and the two upper metallic dies are set to be movable to and away from the fixed lower metallic die. The upper and lower metallic dies are moved by a controllable driving unit. As a result, work holes can be formed at desired pitches, the size of the bending width can be freely set, and at least one upper metallic die can be moved to a desired position by a small distance.

Then, even when works having different thicknesses are to be pressed, the pressing portions on the two surfaces of each work, i.e., the two sides of each work as the pressing portions can be simultaneously bent at a right angle without exchanging the metallic dies, thereby increasing the press efficiency.

In the above press machine, however, since the upper metallic dies move downward toward the lower metallic dies, the two sides of the work as the pressing portions can be bent only at the same angle, i.e., the right angle.

Furthermore, in the conventional press machine described above, as shown in the partially enlarged view of FIG. 45A, when the force of a punch 102 is applied to a lower metallic die 19 of a movable die plate 13 during bending of a work W, the movable die plate 13 escapes through the lower metallic die 19, and one bent surface Wa of the work W cannot be bent at a preset angle (right angle in this case) or in a preset bending width.

In the conventional press machine, as shown in FIG. 45B, even when the position of the movable die plate 13 is stationarily held, since the load of the work W during bending is directly applied to a lower metallic die 18 and the lower metallic die 19, both the lower metallic dies 18 and 19 are deformed inwardly, and the bent surface Wa and a bent surface Wb of the work W cannot be bent at the preset angles or in the preset bending widths.

In this manner, in the conventional press machine, when each of the upper and lower metallic dies is constituted by divisional metallic dies for the purpose of simultaneously bending the two surfaces of a work, escape and deformation of the metallic dies arise, and the work W cannot be bent at high precision.

Furthermore, in conventional bending by the press machine as described above, regarding bending in a desired arbitrary size, only two surfaces of a work can be bent at only the right angle.

Since formation of a product by bending three or more surfaces cannot be performed, formation of a box by bending four surfaces, which is common as a product, and bending at an arbitrary angle other than the right angle cannot be performed.

When two opposing surfaces are to be bent at a short distance or are to be bent to have large heights, the metallic dies need to have a small thickness and a large height. Then, when the metallic dies are pushed by a horizontal force generated during work press, the metallic dies escape, or the metallic dies themselves are bent or deformed, and the work cannot be bent at an accurate angle or in an accurate size on the order of several tens of microns.

Furthermore, when works are to be pressed to have different materials, thicknesses, and bending shapes, thus providing different products, since the variations in the bending angles caused by the variations in hardness and rigidity of the materials and errors in thicknesses are large, high-precision bending on the order of several tens of microns cannot be performed.

More specifically, one of the background techniques requiring high precision as described above is so-called laminated sheet metal working.

Laminated sheet metal working is applied to working of a chassis of an amplifier used in, e.g., a satellite communication system that requires high-quality, stable communication free from wave leakage. Conventionally, a chassis of this type is formed by die casting and cutting. However, die casting and cutting cannot cope with the many requirements described above in the Field of the Invention.

For this reason, according to an application field of laminated sheet metal working, several thin plate chassis components each pressed into a box or the like in advance by a turret punch press are adhered by spot welding or the like to fabricate a thick target chassis. More specifically, this laminated sheet metal working requires high precision on the order of several tens of microns as described above in order to fabricate, e.g., a thick chassis free from electric wave leakage by laminating (fitting) several thin sheet metal works that are pressed in advance.

SUMMARY OF THE INVENTION

It is, therefore, an object of the present invention to provide a new and improved metallic die device for a press machine, in which not only works having different materials and thicknesses can be bent in arbitrary sizes and at desired angles by preventing escape and deformation of metallic dies, including bending the two sides of a work simultaneously at desired angles, but also a plurality of sizes of a work can be bent at accurate angles and in accurate sizes, so that this metallic die device can be used for formation of a box requiring bending of four surfaces.

According to the present invention, there is provided a metallic die device for a press machine, comprising: lower metallic die means having a major surface for supporting a work thereon and an edge portion which is formed on an end portion of the major surface and with which a work portion of the work is brought into contact; and upper metallic die means, having an edge portion rotatable in a direction to bend the work, for clamping the work together with the edge portion of the lower metallic die means, thereby bending the work portion of the work at a desired angle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

Figure 38:
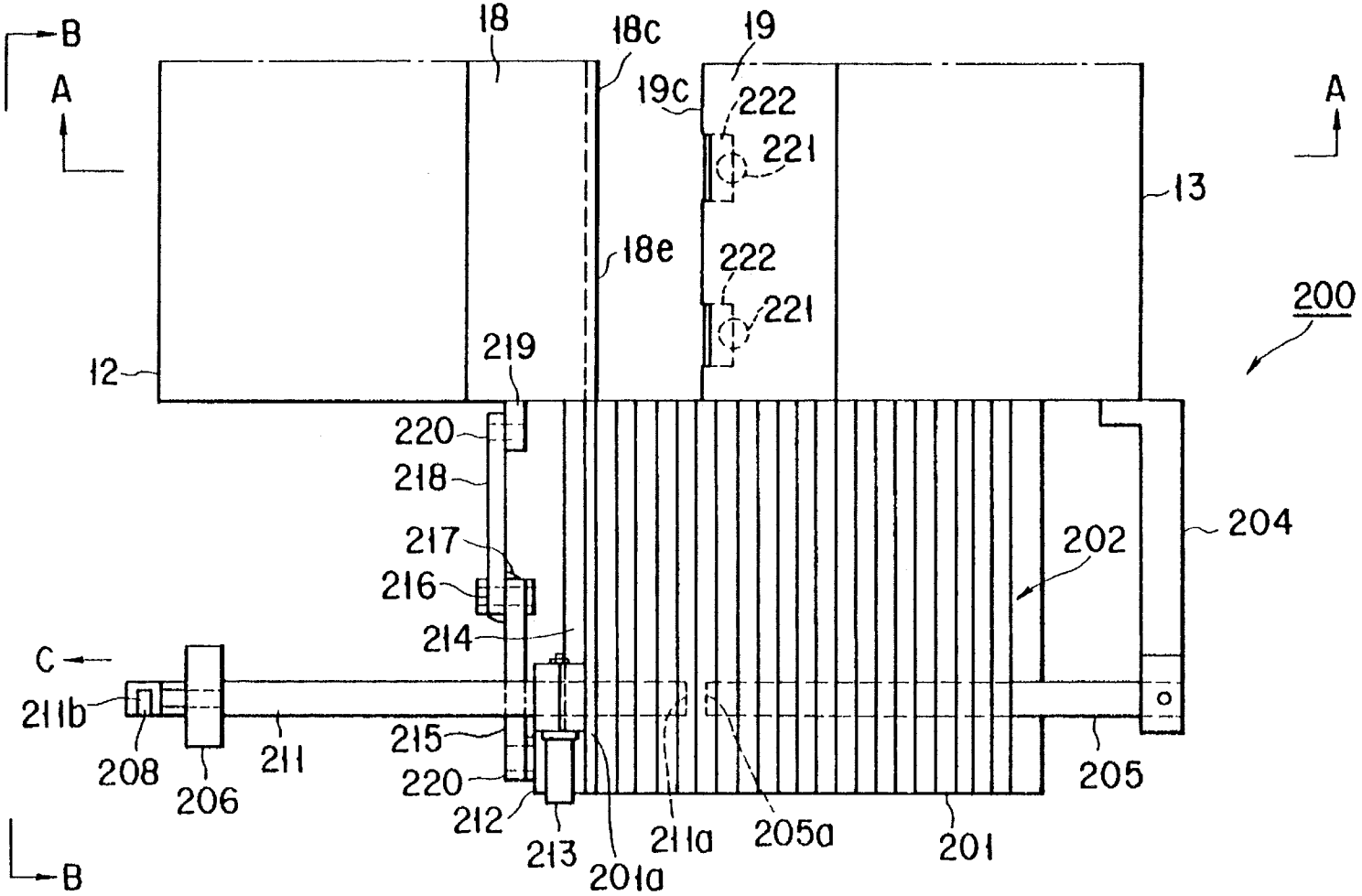
FIG. 38 is an enlarged plan view showing a spacer mechanism as a third modified main part of the present invention.
Figure 40:
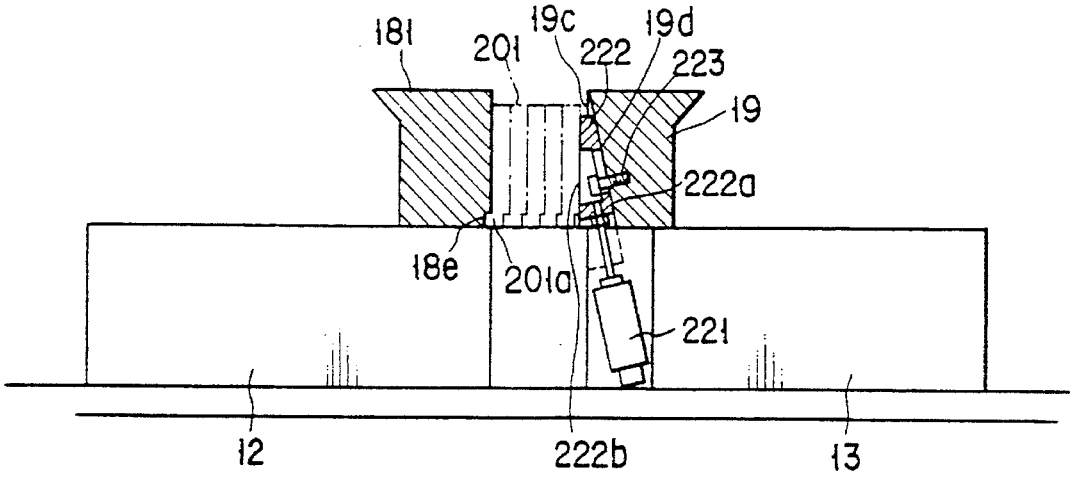
Figure 41:
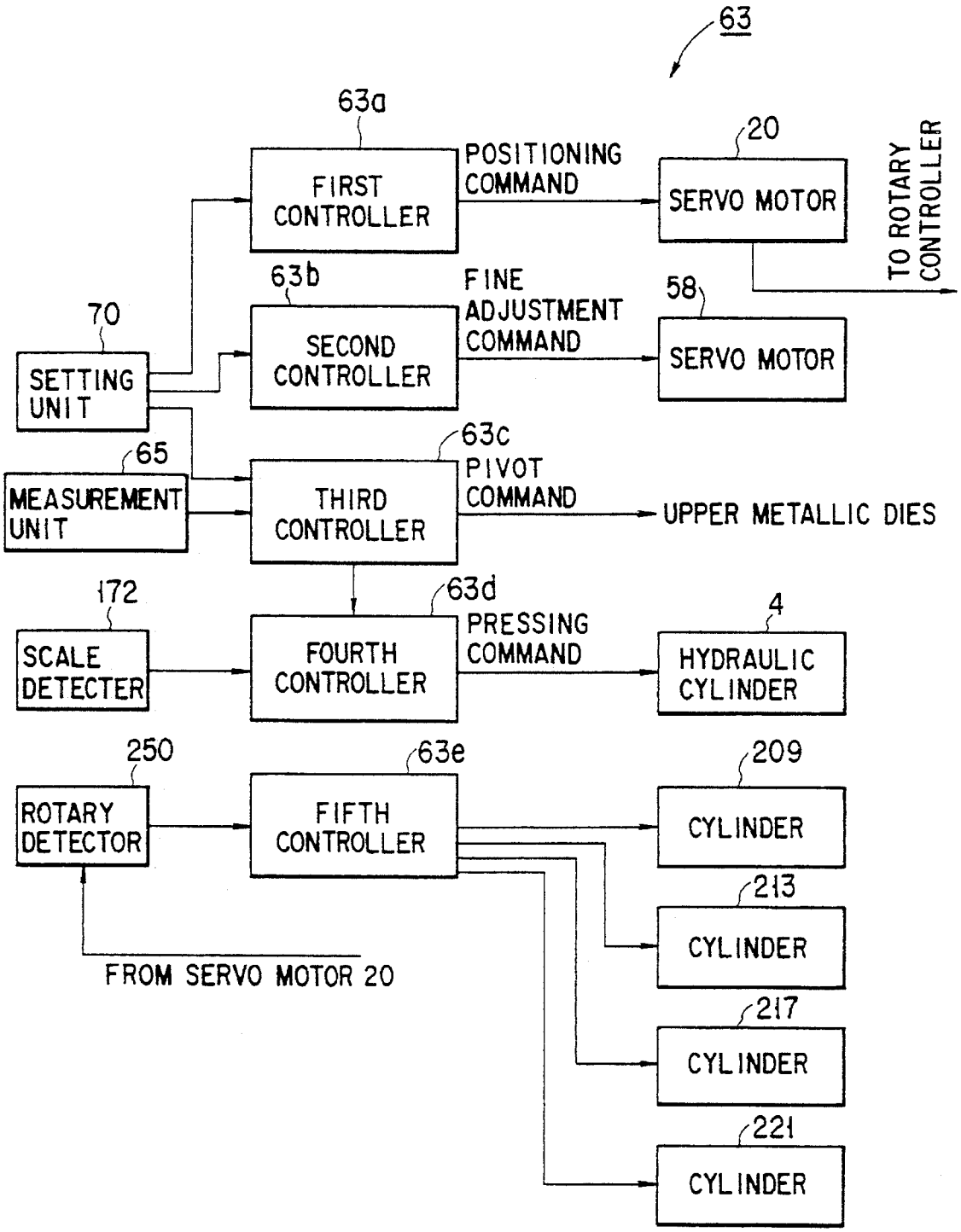
Figure 42:
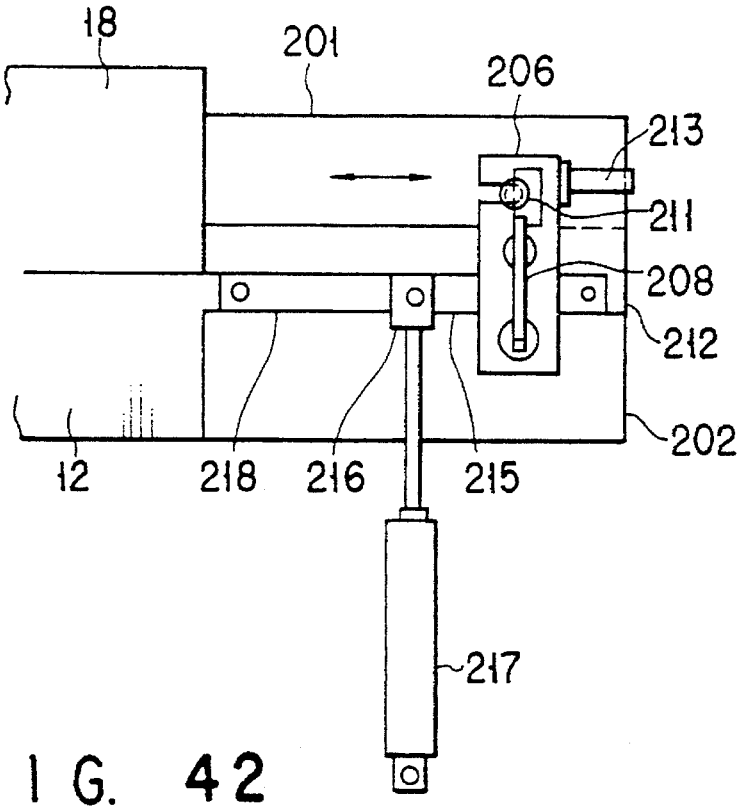
Figure 43:
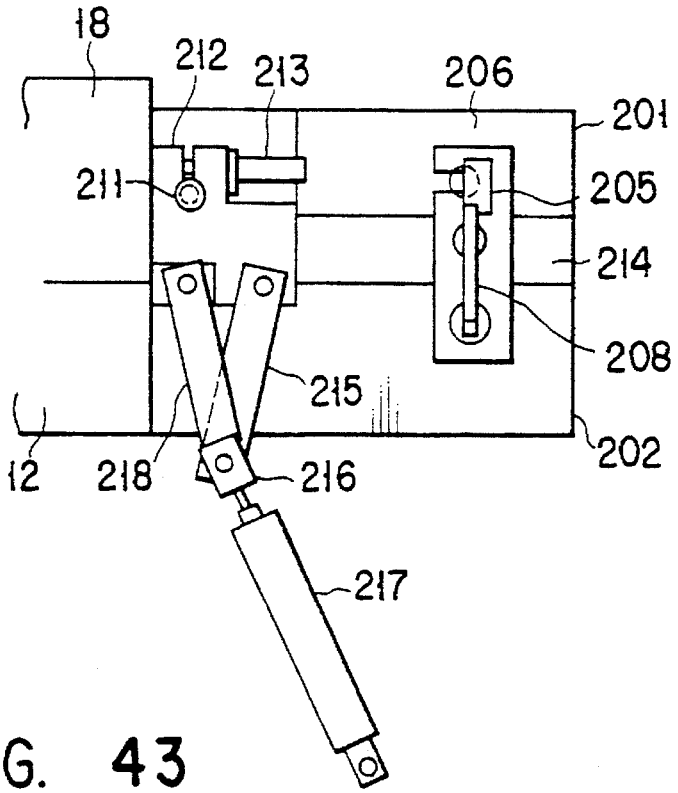
Figure 44:
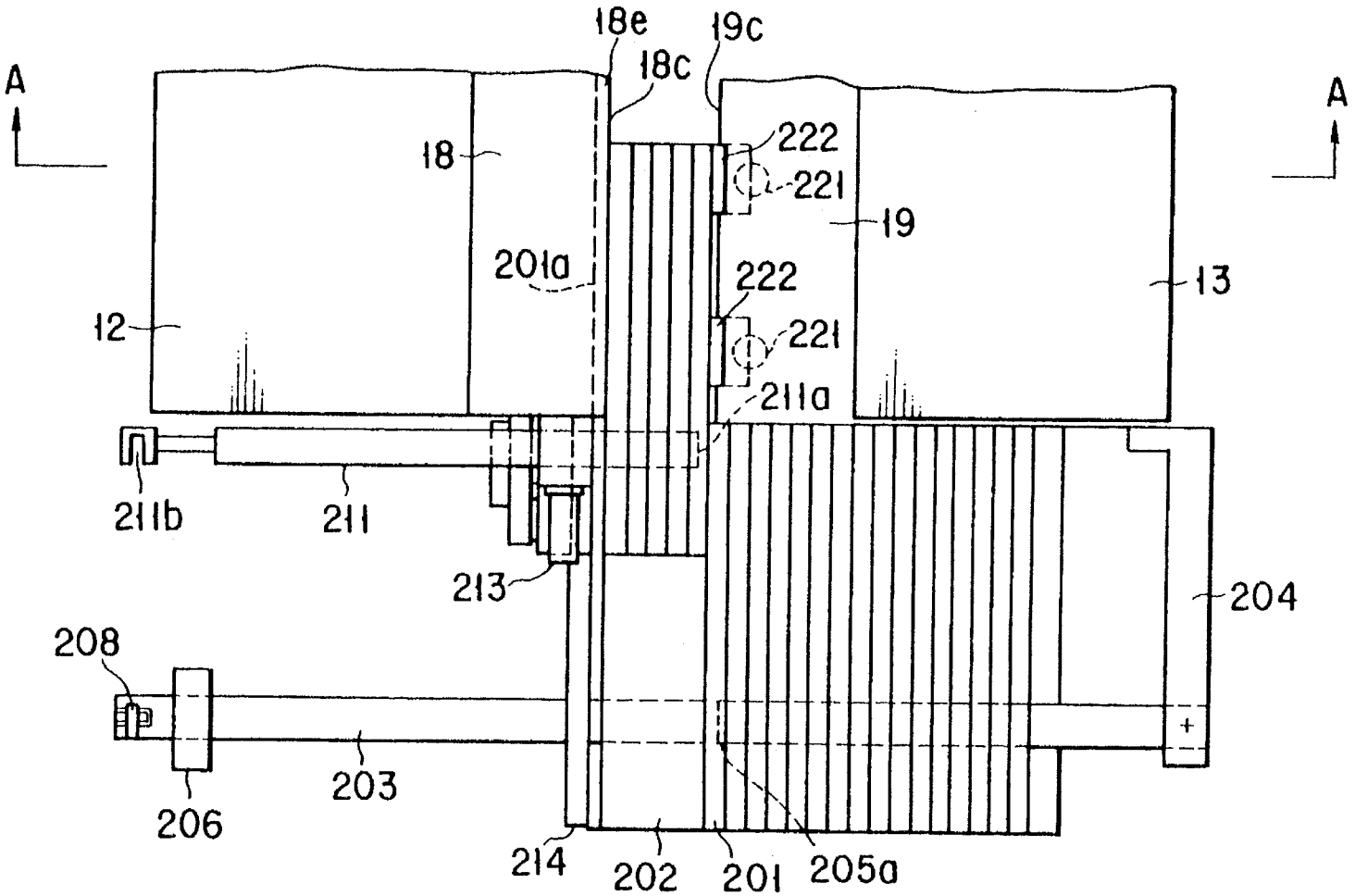
Figure 45A:
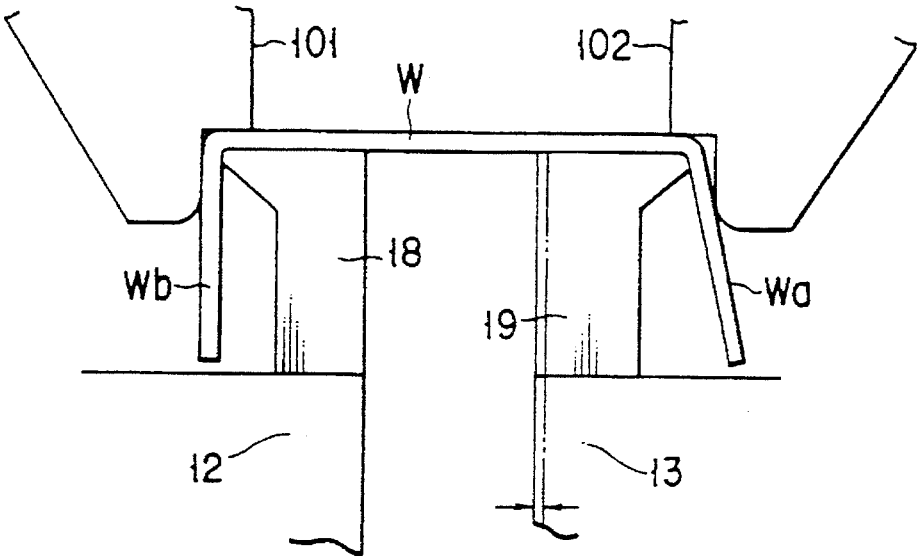
(PRIOR ART) F I G. 45A
Figure 45B:
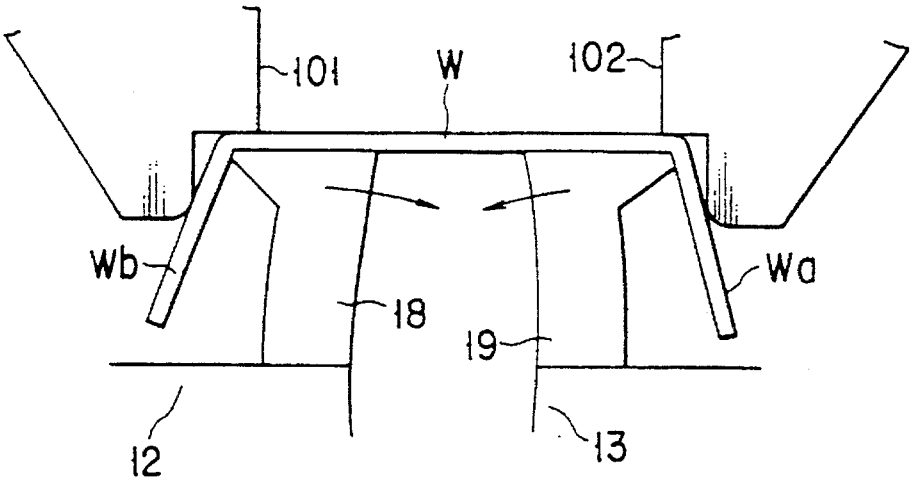
(PRIOR ART) F I G. 45B

38;

FIG. 40 is a side sectional view taken along the line A—A of FIG. 38;

FIG. 41 is a block diagram showing a control unit;

FIG. 42 is a view seen from the direction of arrows B—B of FIG. 38;

FIG. 43 is a view showing the operation of the spacer mechanism;

FIG. 44 is an enlarged plan view showing the operation of the spacer mechanism;

FIG. 45A is a view showing escape of a lower metallic die of a conventional metallic die device; and FIG. 45B is a view showing deformation of the lower metallic die of the conventional metallic die device.

DETAILED DESCRIPTION OF THE PREFERRED EMBODIMENTS

Reference will now be made in detail to the presently preferred embodiments of the invention as illustrated in the accompanying drawings, in which like reference characters designate like or corresponding parts throughout the several drawings.

Figure 1:
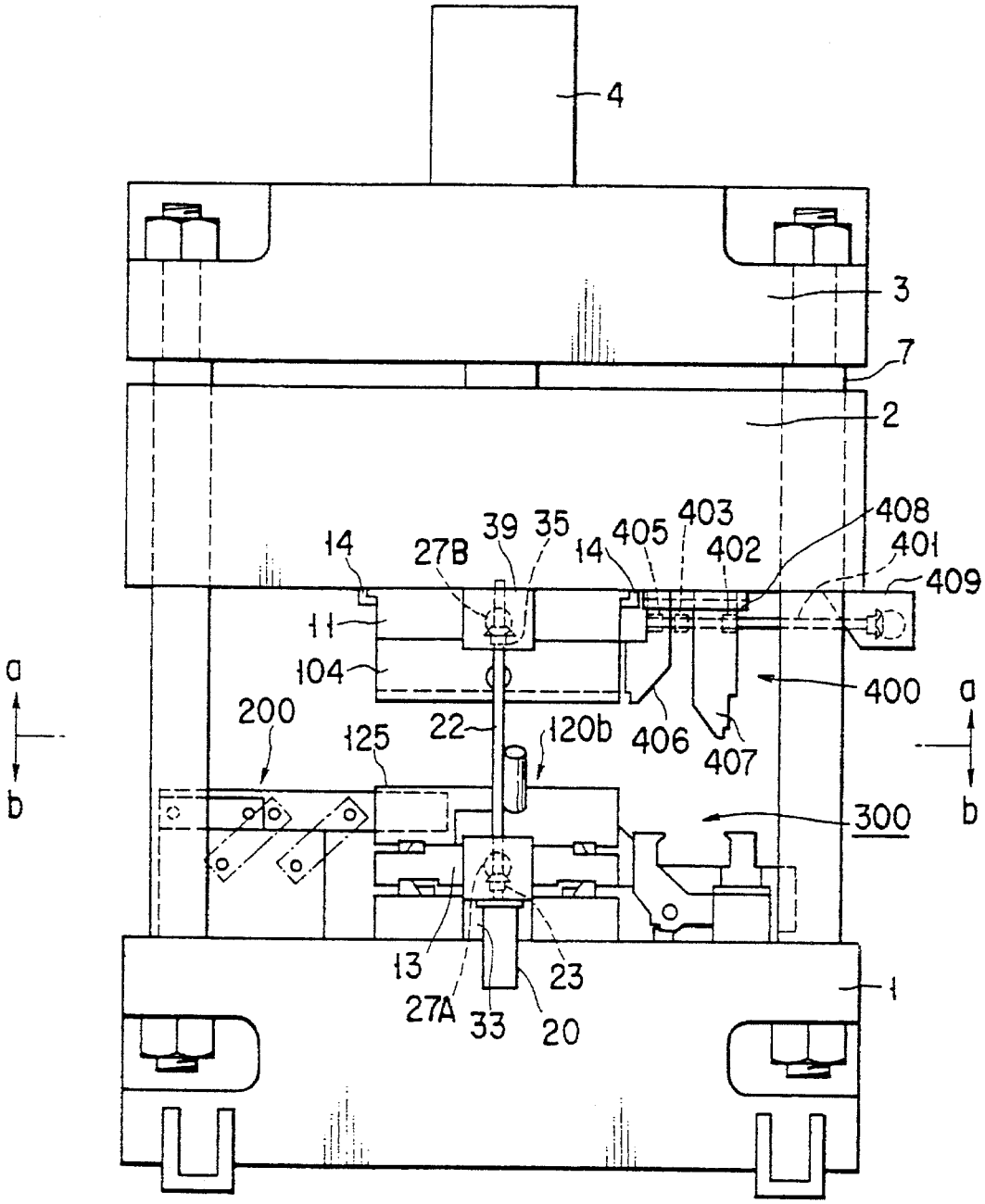
FIG. 1 is a rear view showing a press machine to which the first embodiment of the present invention is applied.
Figure 2:
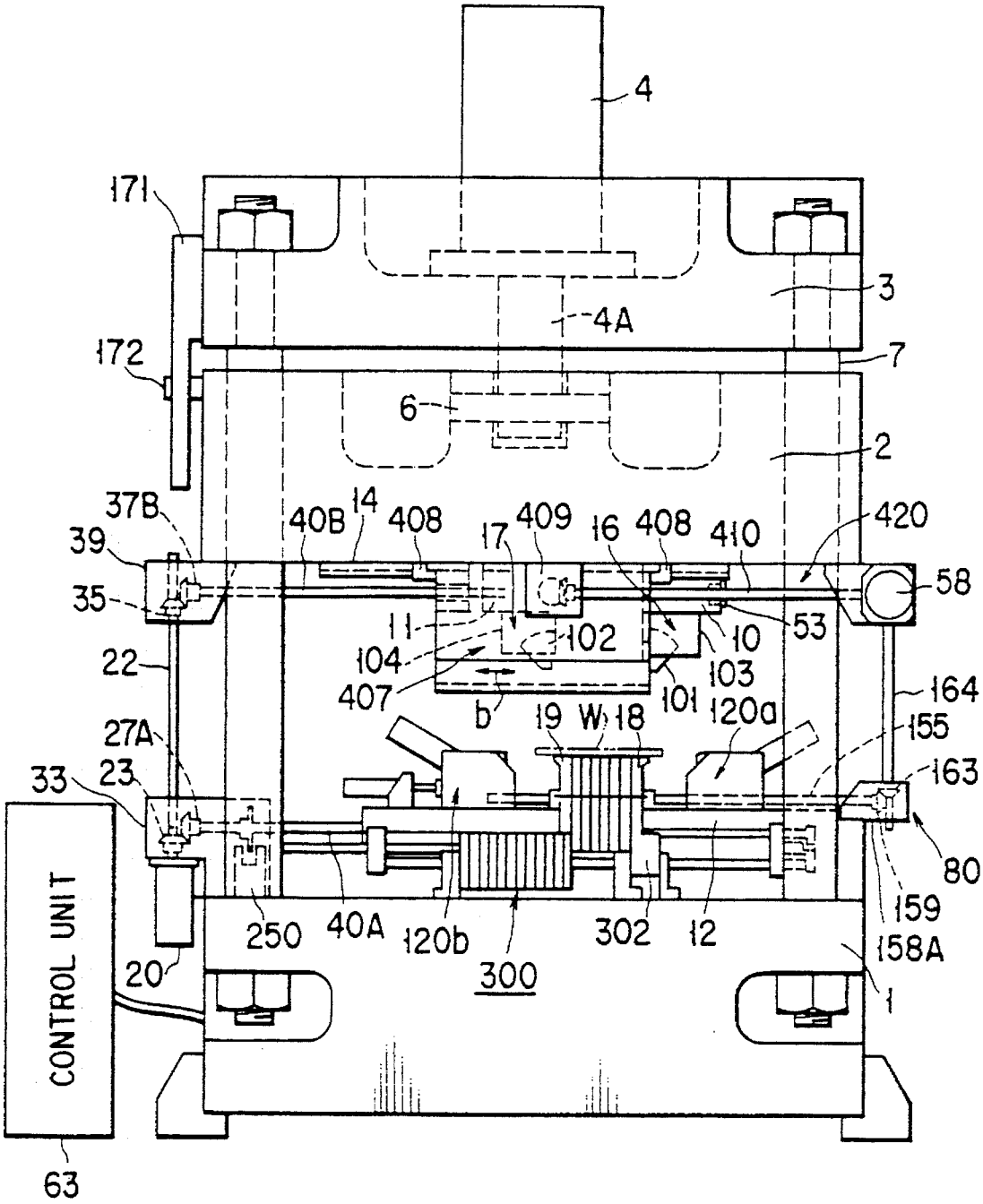
FIG. 2 is a left side view of the press machine of FIG. 1.
Figure 3:
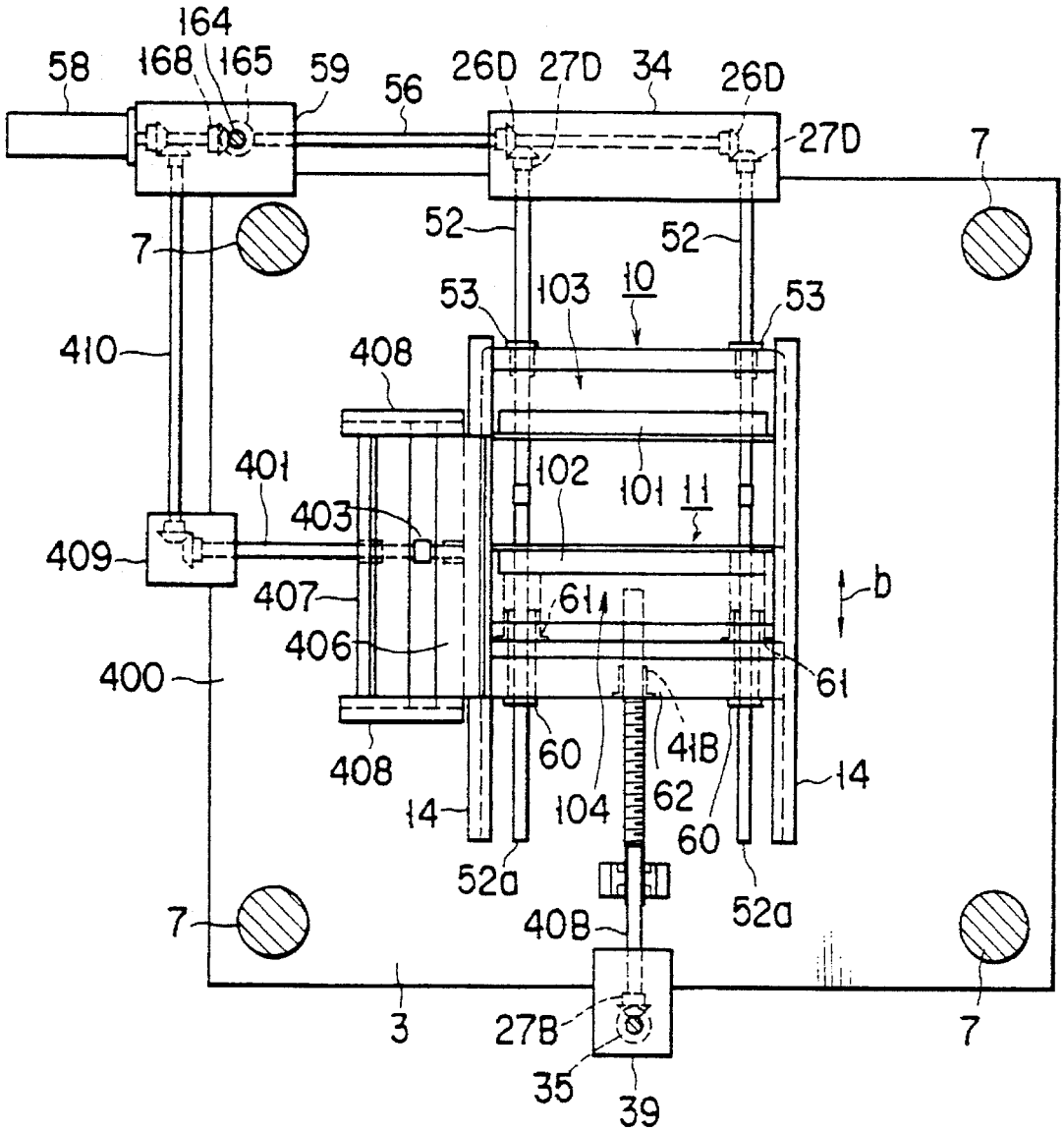
FIG. 3 is a sectional view seen from the direction of arrows a—a of FIG. 1.
Figure 4:
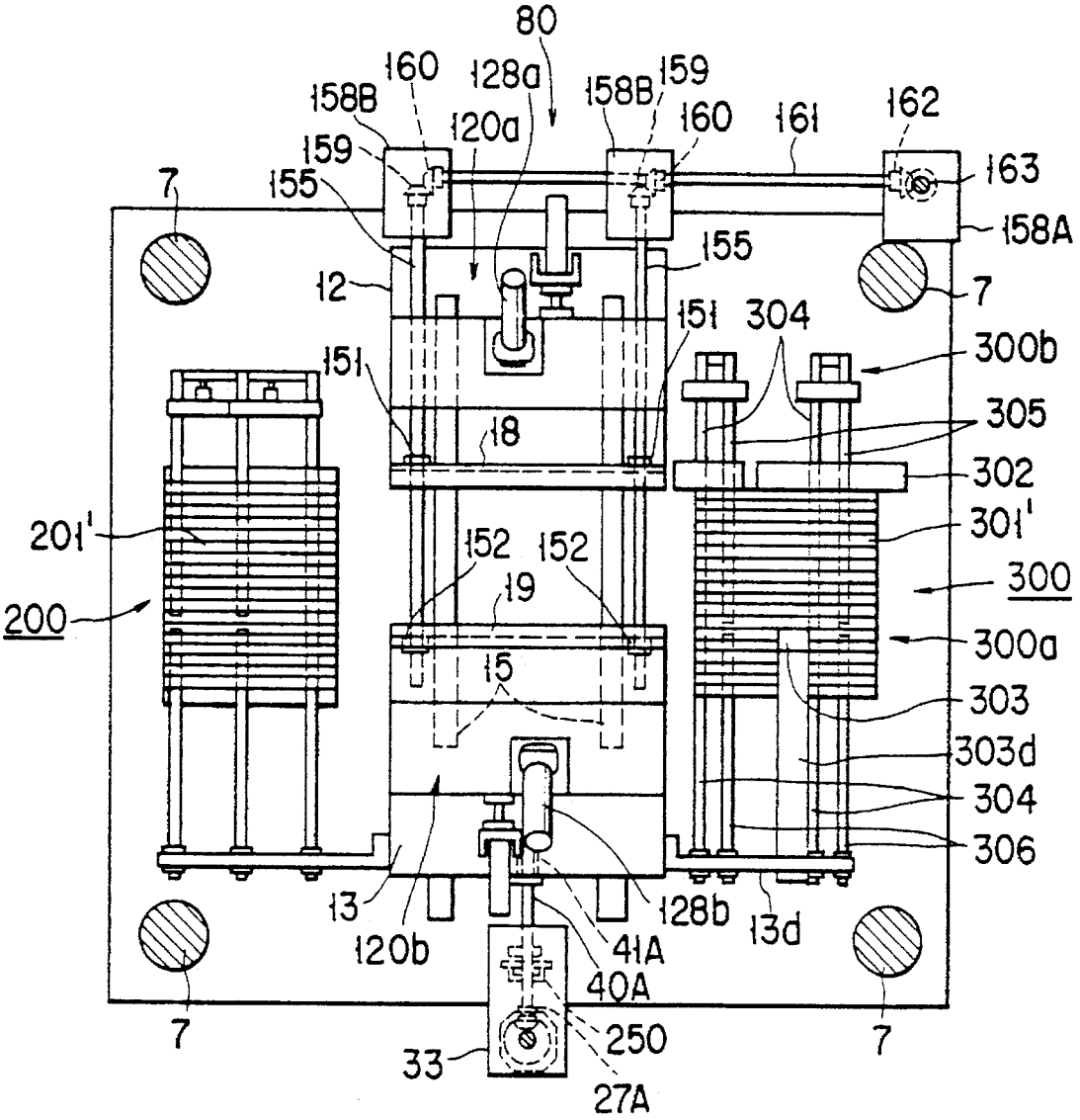
FIG. 4 is a sectional view seen from the direction of arrows b—b of FIG. 1.

A metallic die device for a press machine according to the first embodiment of the present invention will be described. FIGS. 1 and 2 are a rear view and left side views, respectively, a showing a press machine to which a metallic die device according to the embodiment of the present invention is applied; FIG. 3 is a sectional view along the line a—a of FIG. 1; and FIG. 4 is a sectional view along the line b—b of FIG. 1.

Referring to FIGS. 1 to 4, an upper bed 3 is fixed above a lower bed 1 of the press machine through columns 7. The columns 7 are fixed by the lower and upper beds 1 and 3 to guide a press slider 2 to be vertically movable.

A linear scale 171 is provided to the upper bed 3 to extend downward, and a scale detector 172 is provided to the press slider 2 for detecting movement of the linear scale 171. Then, the descending amount of the press slider 2 is detected by the scale detector 172 and sent to a control unit 63 to be described later.

A driving hydraulic cylinder 4 is provided to the upper bed 3, and a plunger 4A of the hydraulic cylinder 4 is coupled to the press slider 2 through a pin 6.

The hydraulic cylinder 4 is connected to a hydraulic source (not shown).

Movable and stationary punch plates 10 and 11 are provided on the lower surface of the press slider 2. The movable punch plate 11 is movable to and away from the stationary punch plate 10 along upper guide rails 14. The stationary and movable punch plates 10 and 11 are respectively provided with upper metallic die mechanisms 16 and 17 for moving pivotal upper metallic dies 101 and 102.

Stationary and movable die plates 12 and 13 are provided on the lower bed 1. The stationary die plate 12 is fixed on the lower bed 1, and the movable die plate 13 is movable to and away from the stationary die plate 12 along lower guide rails 15.

A lower metallic die 18 corresponding to the shape of the pivotal upper metallic die 101 of the upper metallic die mechanism 16 is provided on the stationary die plate 12. A lower metallic die 19 corresponding to the shape of the pivotal upper metallic die 102 of the upper metallic die mechanism 17 is provided on the movable die plate 13.

A servo motor 20 serving as the first driving source is coupled to a spline shaft 22. Bevel gears 23 and 35 are fixed to the lower and upper portions of the spline shaft 22. The bevel gears 23 and 35 are slidably engaged with the spline shaft 22 and meshed with corresponding bevel gears 27A and 27B, thereby respectively constituting gear mechanisms 33 and 39 and coupling the spline shaft 22 with screw shafts 40A and 40B. Hence, the gear mechanisms 33 and 39 do not interfere with the downward movement of the press slider 2.

Rotation of the screw shaft 40A is detected by a rotary detector 250. Reference numeral 41A denotes a nut threadably engaged with the screw shaft 40B and fixed to a punch fine adjustment base 62 (to be described later) provided to the side portion of the movable punch plate 11.

Upon rotation of the servo motor 20, the screw shafts 40A and 40B are rotated through the spline shaft 22, and the movable die plate 13 and the movable punch plate 11 are simultaneously moved in the directions of a double-headed arrow b in FIGS. 2 and 3.

The movable punch plate 11 and the movable die plate 13 can be simultaneously moved by drive of the metallic die positioning servo motor 20 serving as the first power supply.

As shown in FIG. 3, reference numerals 52 denote screw shafts for slightly moving the stationary punch plate 10 in accordance with the thickness or material of a work W.

Nuts 53 fixed to the stationary punch plate 10 are threadably engaged with the screw shafts 52. Upon rotation of the screw shafts 52, the nuts 53 move the stationary punch plate 10 as they are guided along the upper guide rails 14.

The screw shafts 52 are coaxially coupled to spline shafts 52*a* at a portion of the movable punch plate 11. Fine adjustment nuts 61 are fixed to the movable punch plate 11. Reference numerals 60 denote fine adjustment screws, slidably fitted in the grooves of the corresponding spline shafts 52*a*, for transmitting rotation, thereby slightly moving the position of the movable punch plate 11. The fine adjustment screws 60 are threadably engaged with the fine adjustment nuts 61.

Reference numeral 56 denotes a driving shaft for transmitting rotation to the screw shafts 52 that slightly move the movable punch plate 11, and the driving shaft 56 is coupled to a servo motor 58, serving as the second driving source for slightly moving the movable punch plate 11, through a gear in a gear case 59.

Bevel gears 26D in a gear case 34 are fixed to the driving shaft 56 and meshed with bevel gears 27D of the corresponding screw shafts 52. The punch fine adjustment base 62 fixes the fine adjustment screws 60 and a nut 41B thereon.

Accordingly, the movable punch plate 11 is moved both by positioning the screw shaft 40B and by rotation of the servo motor 58 serving as the second driving source for slightly moving the movable punch plate 11.

Figure 5:
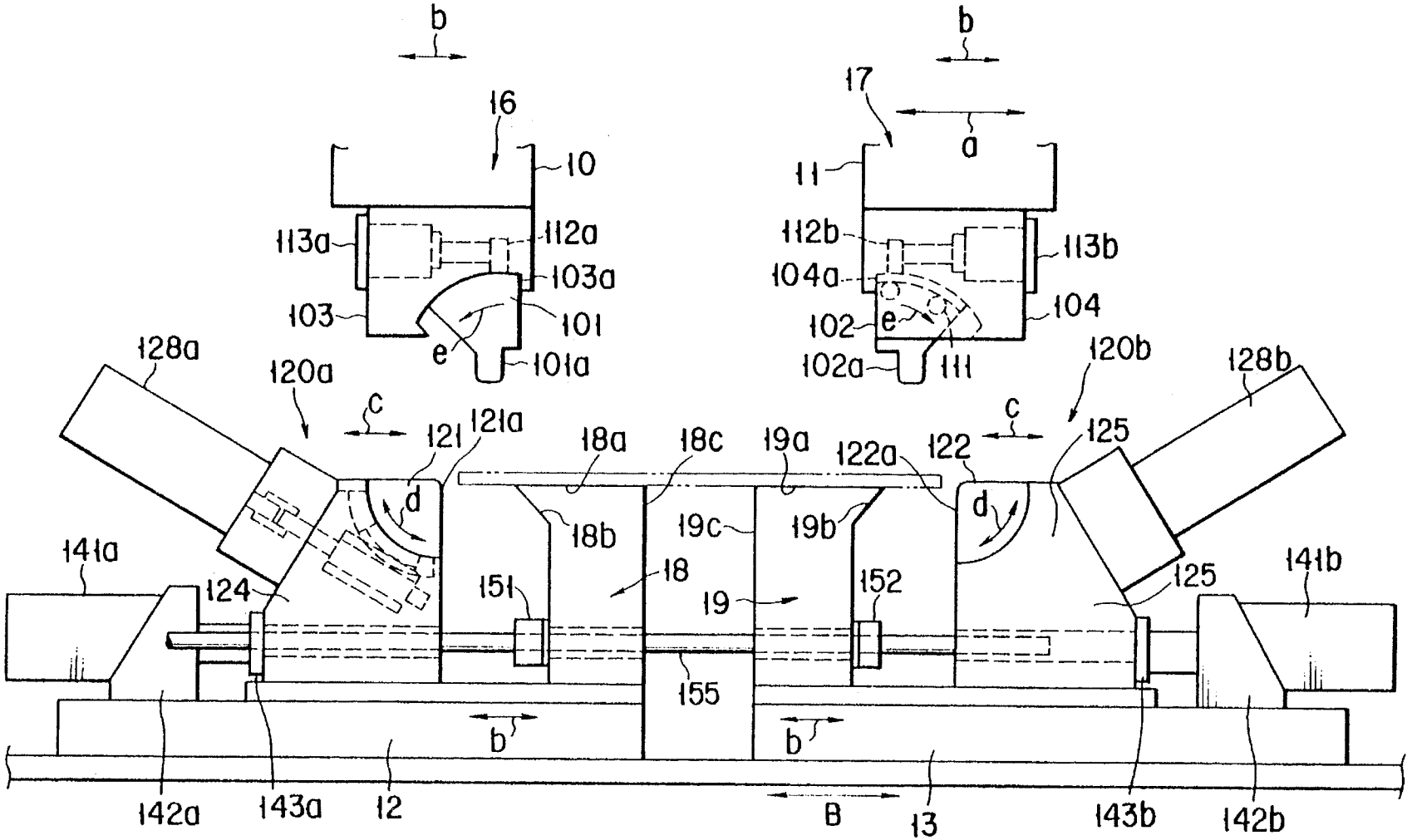
FIG. 5 is an enlarged side view showing upper metallic die mechanisms.

The upper metallic die mechanisms 16 and 17 are symmetrically provided as shown in the enlarged side view of FIG. 5.

The upper metallic die mechanisms 16 and 17 are respectively constituted by fixing upper metallic die bases 103 and 104 to the lower portions of the stationary and movable punch plates 10 and 11. Arcs having predetermined diameters are formed in the lower surfaces of the upper metallic die bases 103 and 104. The pivotal upper metallic dies 101 and 102 having arcs of diameters to correspond to the diameters of the corresponding arcs are pivotally provided on the arcuated surfaces of the upper metallic die bases 103 and 104, respectively, and cam followers 111 are provided along the arcs of the pivotal upper metallic dies 101 and 102 to support the pivotal upper metallic dies 101 and 102, respectively. The pivotal upper metallic dies 101 and 102 have linear edge portions 101*a* and 102*a* having predetermined steps, respectively. The lower end portions of the edge portions 101*a* and 102*a* serve as the pivot centers of the pivotal upper metallic dies 101 and 102, respectively.

The plane surfaces or edge portions 101*a* and 102*a* of the pivotal upper metallic dies 101 and 102 are set in the vertical state as the reference when the upper end portions of the pivotal upper metallic dies 101 and 102 are abutted against reference surfaces 103*a* and 104*a* of the upper metallic die bases 103 and 104.

For this purpose, metal press plates 112*a* and 112*b* project from the upper portions of the pivotal upper metallic dies 101 and 102. The upper metallic die bases 103 and 104 are respectively provided with pushers 113*a* and 113*b* comprising cylinders and the like. The rods of the pushers 113*a* and 113*b* push the metal press plates 112*a* and 112*b* to set the plane surfaces or edge portions 101*a* and 102*a* of the pivotal upper metallic dies 101 and 102 in the vertical reference state.

Figure 16:
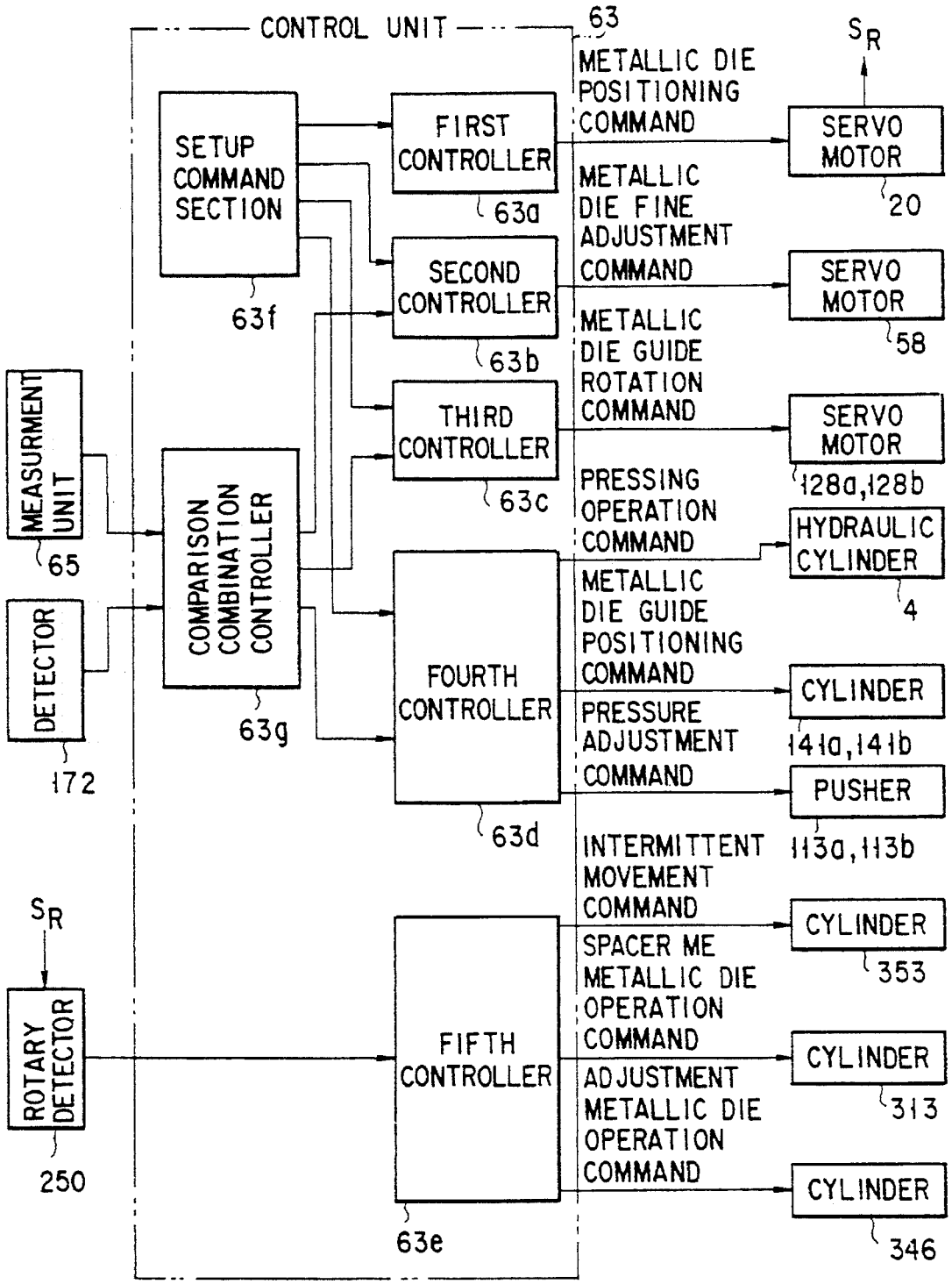
FIG. 16 is a block diagram showing a control unit.

The pushing forces of the pushers 113*a* and 113*b* are controlled by a fourth controller 63*d* of the control unit 63 shown in FIG. 16.

When forces larger than the forces of the pushers 113*a* and 113*b* act on the pivotal upper metallic dies 101 and 102, respectively, the pivotal upper metallic dies 101 and 102 can be pivoted in opposite directions indicated by arrows e in FIG. 5.

As shown in FIG. 5, the lower metallic dies 18 and 19 are formed to be symmetrical to each other, and respectively have horizontal surfaces 18*a* and 19*a* on which a work W is to be placed, and first and second inclined surfaces 18*b* and 19*b* serving as end faces inwardly inclined at predetermined angles with respect to the horizontal surfaces 18*a* and 19*a*.

The inclined surface 18*b* of the lower metallic die 18 defines a ridgeline along an intersection with horizontal surface 18*a* and serves to bend the first portion of the work W, as will be described later, and similarly the inclined surface 19*b* of the lower metallic die 19 defines a ridgeline along an intersection with horizontal surface 19*a* and serves to bend the second portion of the work W.

Lower guide mechanisms 120*a* and 120*b* are respectively provided to the side portions of the lower metallic dies 18 and 19. The lower guide mechanisms 120*a* and 120*b* respectively have lower bases 124 and 125 slidable in a direction indicated by a double-headed arrow c in FIG. 5.

Figure 6:
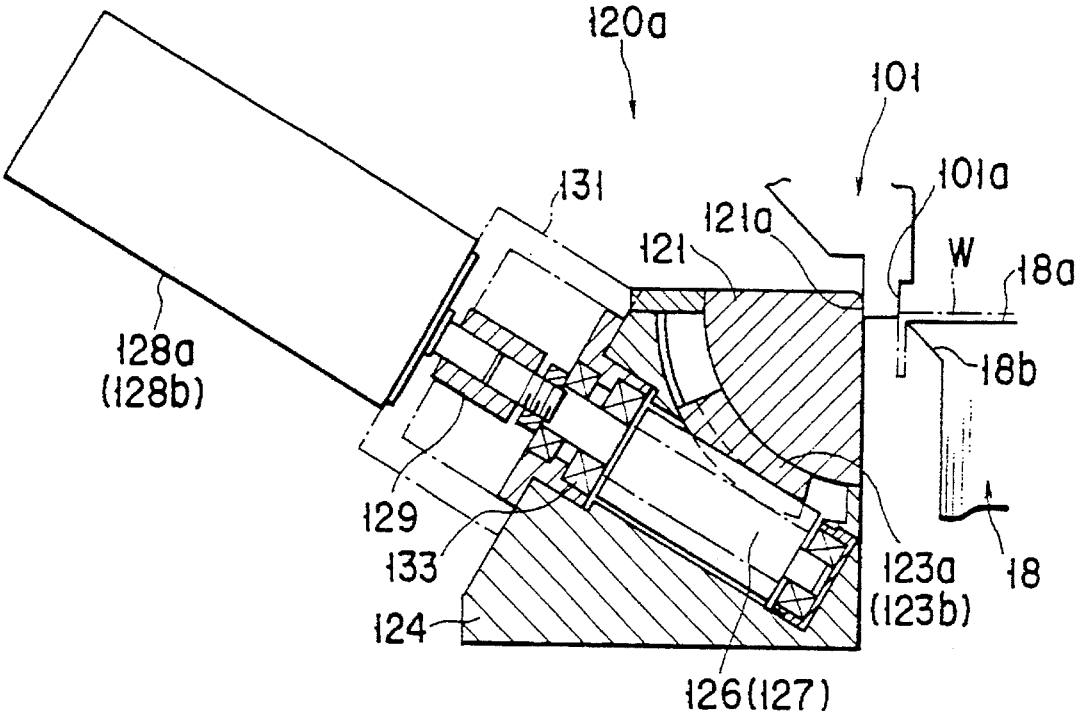
FIG. 6 is a sectional view of a lower guide mechanism.

FIG. 6 is a sectional view of one lower guide mechanism 120*a*. The other lower guide mechanism 120*b* has the same structure as the lower guide mechanism 120*a* and is symmetrical with the lower guide mechanism 120*a*.

Arcuated portions are formed on the lower bases 124 and 125 toward the corresponding lower metallic dies 18 and 19, and metal backup members 121 and 122 having arcs of diameters corresponding to the diameters of the arcuated portions of the lower bases 124 and 125 are pivotally provided to the lower bases 124 and 125, respectively. The metal backup members 121 and 122 are provided with vertical guide surfaces 121*a* and 122*a* brought into contact with the side surfaces of the plane surfaces or edge portions 101*a* and 102*a* of the pivotal upper metallic dies 101 and 102, respectively. The metal backup members 121 and 122 are pivotal about the upper end portions of the corresponding guide surfaces 121*a* and 122*a* as the pivot centers. Lower worm wheels 123*a* and 123*b* are formed on the arcuated portions of the metal backup members 121 and 122, respectively.

Lower worms 126 and 127 are respectively provided to the lower bases 124 and 125 through bearings and meshed with the lower worm wheels 123*a* and 123*b*, respectively.

Each of the lower worms 126 and 127 is coupled to the driving shaft of a corresponding lower servo motor 128*a* or 128*b*, serving as the third driving source, through a bearing 133 and a lower coupler 129. The lower servo motor 128*a* is obliquely fixed to a motor bracket 131.

Hence, when the lower servo motors 128*a* and 128*b* are driven, the guide surfaces 121*a* and 122*a* of the metal backup members 121 and 122 are rotated in directions indicated by a double-headed arrow d in FIG. 5.

Right- and left-handed screws 151 and 152 fitted in screw holes formed in the lower metallic dies 18 and 19, respectively, are threadably engaged with spline shafts 155. The spline shafts 155 are coupled to a driving source through a coupling mechanism 80.

As shown in FIGS. 2 and 4, in the coupling mechanism 80, gear boxes 158B each on one end of the corresponding screw shaft 155 are coupled to the servo motor 58 through a coupling shaft 161 and a gear box 158A.

In each gear box 158B, a bevel gear 159 is fixed to one end of the screw shaft 155, and a corresponding bevel gear 160 of the coupling shaft 161 is meshed with the bevel gear 159.

In the gear box 158A, a bevel gear 162 is provided to the end portion of the coupling shaft 161, and a bevel gear 163 fixed to the end portion of a spline shaft 164 is meshed with the bevel gear 162.

A bevel gear 165 is provided on the upper portion of the spline shaft 164 to be slidable in the groove of the spline shaft 164. The bevel gear 165 is meshed with a bevel gear 168 fixed to the driving shaft 56, and coupled to the servo motor 58.

Thus, when the servo motor 58 is driven, the stationary and movable punch plates 10 and 11 are slightly moved, and the right- and left-handed screws 151 and 152 respectively provided to the lower metallic dies 18 and 19 are slightly moved in directions of a double-headed arrow b in FIG. 5, thereby positioning the right- and left-handed screws 151 and 152.

The lower guide mechanisms 120*a* and 120*b* are respectively biased toward the lower metallic dies 18 and 19 by cylinders 141*a* and 141*b* serving as the power supplies shown in FIG. 5.

The cylinders 141*a* and 141*b* are respectively fixed to brackets 142*a* and 142*b* fixed to the stationary and movable die plates 12 and 13. The end portions of the rods of the cylinders 141*a* and 141*b* are respectively fixed to the lower guide mechanisms 120*a* and 120*b* through connection members 143*a* and 143*b*.

Therefore, when the cylinders 141*a* and 141*b* are actuated, their rods project, and the lower guide mechanisms 120*a* and 120*b* are moved toward the lower metallic dies 18 and 19, respectively, to be abutted against the end faces of the corresponding right- and left-handed screws 151 and 152, thereby positioning the guide surfaces 121*a* and 122*a*.

Figure 7:
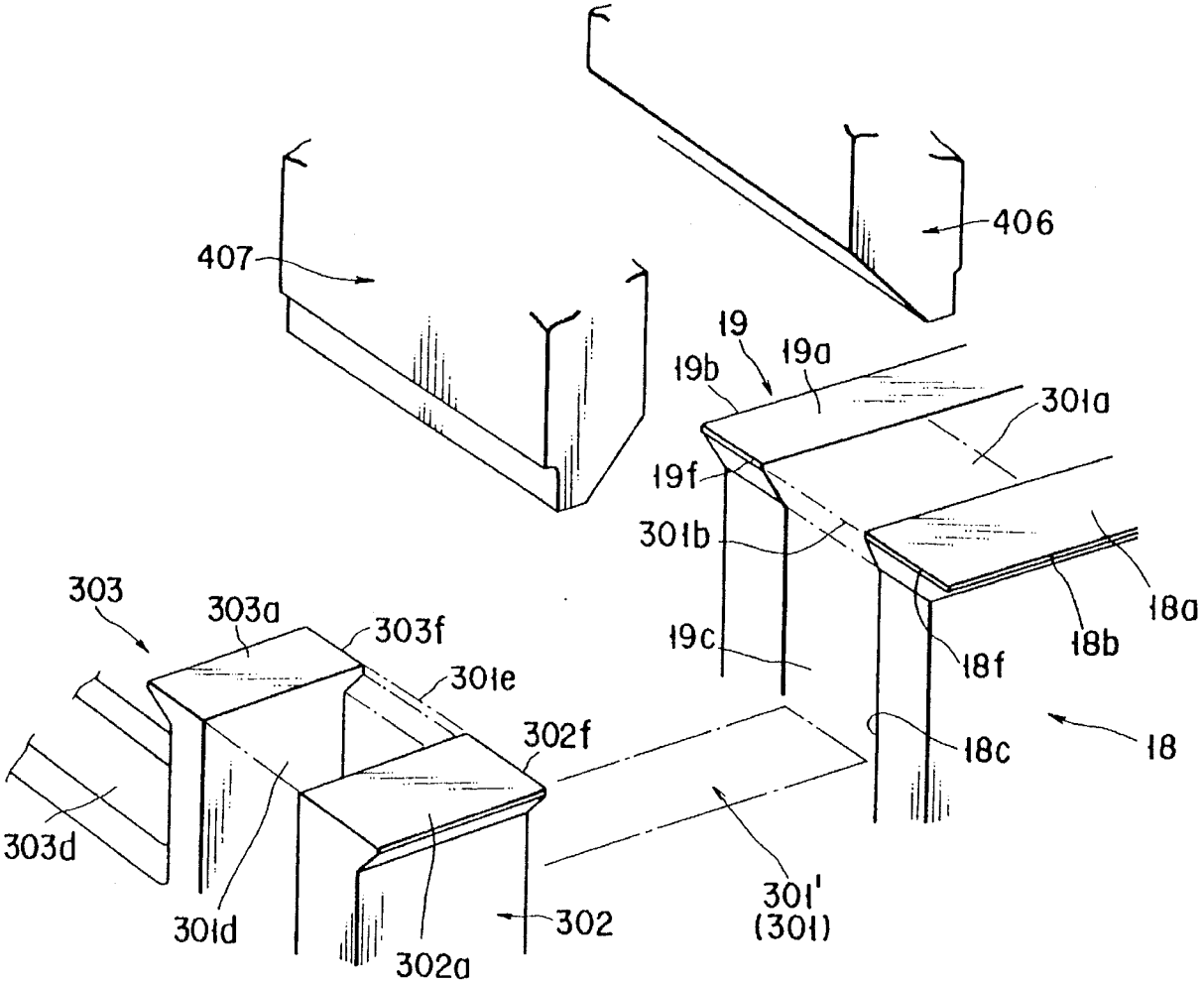
FIG. 7 is a perspective view showing a selective positioning mechanism of the metallic die device as a main part of the present invention.

Then, as shown in the partially enlarged perspective view of FIG. 7, third bent surfaces 18*f* and 19*f* are formed on the end portions of the lower metallic dies 18 and 19. The third bent surfaces 18*f* and 19*f* are formed to be perpendicular to the first and second inclined surfaces 18*b* and 19*b*, respectively, when seen from above, and communicate with each other at their end portions. The third bent surfaces 18*f* and 19*f* serve to bend the third portion of the work W, as will be described later.

On the side portions of the lower metallic dies 18 and 19 and below the lower metallic dies 18 and 19 by a predetermined distance, auxiliary lower metallic dies 302 and 303 are provided to be parallel to the lower metallic dies 18 and 19. The auxiliary lower metallic die 302 serves to bend the fourth portion of the work W, as will be described later. For this purpose, the auxiliary lower metallic dies 302 and 303 are formed with fourth bent surfaces 302*f* and 303*f* at portions opposing the third bent surfaces 18*f* and 19*f* of the lower metallic dies 18 and 19, respectively.

The position of the auxiliary lower metallic die 302 is fixed in the same manner as the lower metallic die 18. The position of the auxiliary lower metallic die 303 is movable in the same manner as the lower metallic die 19.

More specifically, as shown in FIG. 4, an extension piece 303*d* is formed on the side portion of the auxiliary lower metallic die 303 and fixed to a coupling piece member 13*d* fixed to the side portion of the movable die plate 13. Therefore, when the movable die plate 13 is moved, the lower metallic die 19 and the auxiliary lower metallic die 303 are integrally moved to change the gap between the lower metallic die 18 and the auxiliary lower metallic die 302.

As will be described later, a spacer metallic die 301 is inserted in the gap between the lower metallic dies 18 and 19 and between the auxiliary lower metallic dies 302 and 303. The spacer metallic die 301 has a thickness corresponding to this gap and serves to bend the third portion of the work W.

In this embodiment, the spacer metallic die 301 will be described as a plurality of multilayer spacer metallic dies 301' having a function of two-portion bending for bending both the third and fourth portions of the work W.

Cooperative metallic dies 406 and 407 serving as the corresponding upper metallic dies are provided above the third bent surfaces 18*f* and 19*f* of the lower metallic dies 18 and 19 and above the fourth bent surfaces 302*f* and 303*f* of the auxiliary lower metallic dies 302 and 303, respectively. The cooperative metallic dies 406 and 407 are movably supported by guide rails 408 provided under the press slider 2, as shown in FIGS. 1 and 3.

A second positioning mechanism 400 for positioning the cooperative metallic die 406 will be described. Note that a third positioning mechanism serves to position the cooperative metallic die 407 and is included in the second positioning mechanism 400. In the following description, the cooperative metallic dies 406 and 407 will be described to be positioned by the second positioning mechanism 400.

The cooperative metallic dies 406 and 407 are coupled to a rotating shaft 401. The rotating shaft 401 is threadably engaged to the cooperative metallic die 407 by its left-hand screw 402, and to the cooperative metallic die 406 by its right-hand screw 405 through a coupler 403.

The end portion of the rotary shaft 401 is coupled to the servo motor 58 through bevel gears in a gear box 409 and a shaft 410.

Accordingly, when the servo motor 58 is driven, the second positioning mechanism 400 slightly moves the cooperative metallic dies 406 and 407 in opposite directions. Fine positioning by the second positioning mechanism 400 is performed simultaneously by slight movement of the upper metallic die mechanisms 16 and 17 and nuts 151 and 152.

As shown in FIGS. 1, 2, and 4, selective positioning members 300 are provided at side portions of the lower metallic dies 18 and 19 where the auxiliary lower metallic dies 302 and 303 are located. Each selective positioning member 300 is constituted by a spacer mechanism 300*a* serving as the first positioning mechanism and a selecting mechanism 300*b*. In this embodiment, the spacer mechanism 300*a* and the selecting mechanism 300*b* are constituted by the same mechanism.

Figure 8:
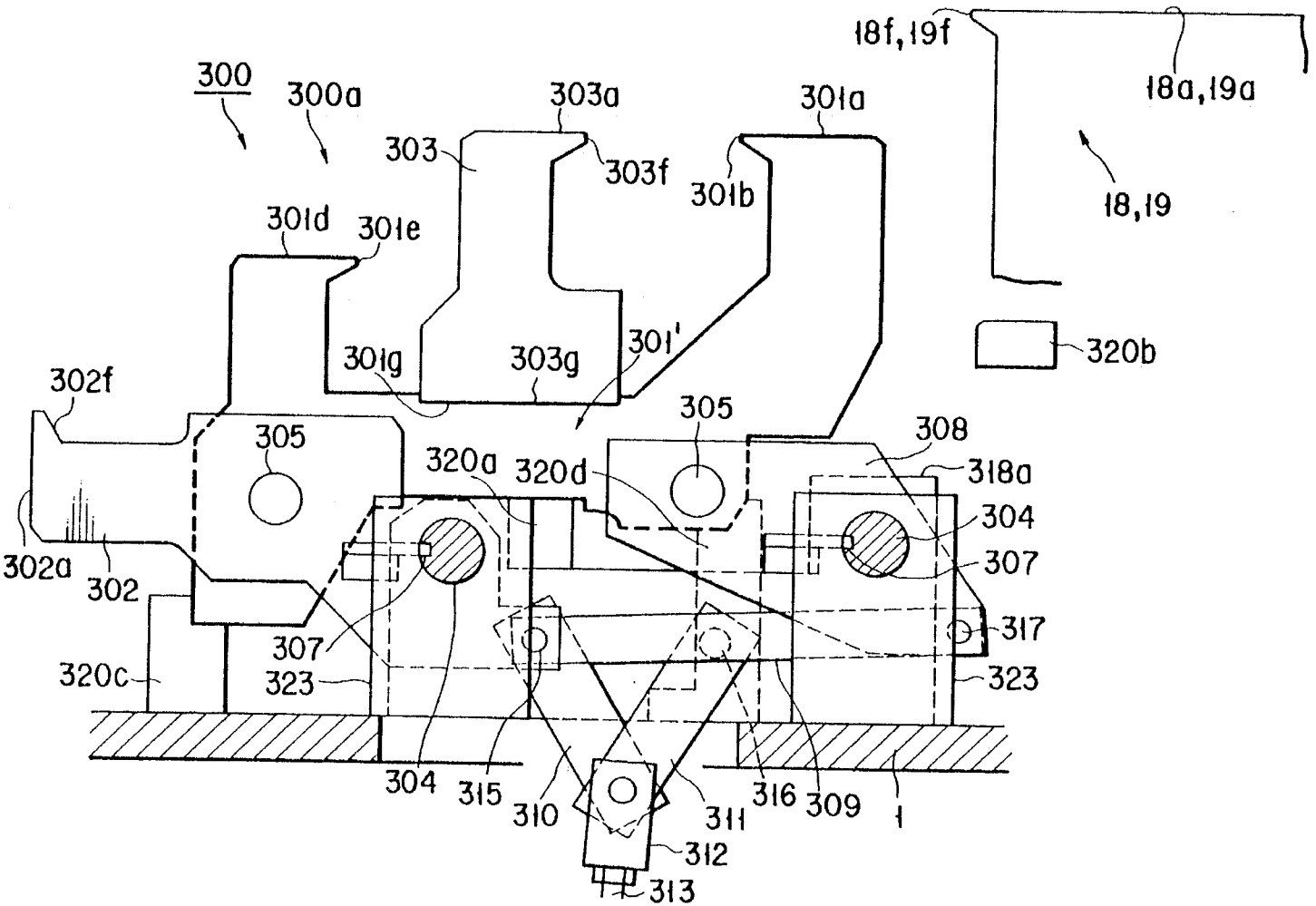
FIG. 8 is a front view showing the selective positioning mechanism.
Figure 9:
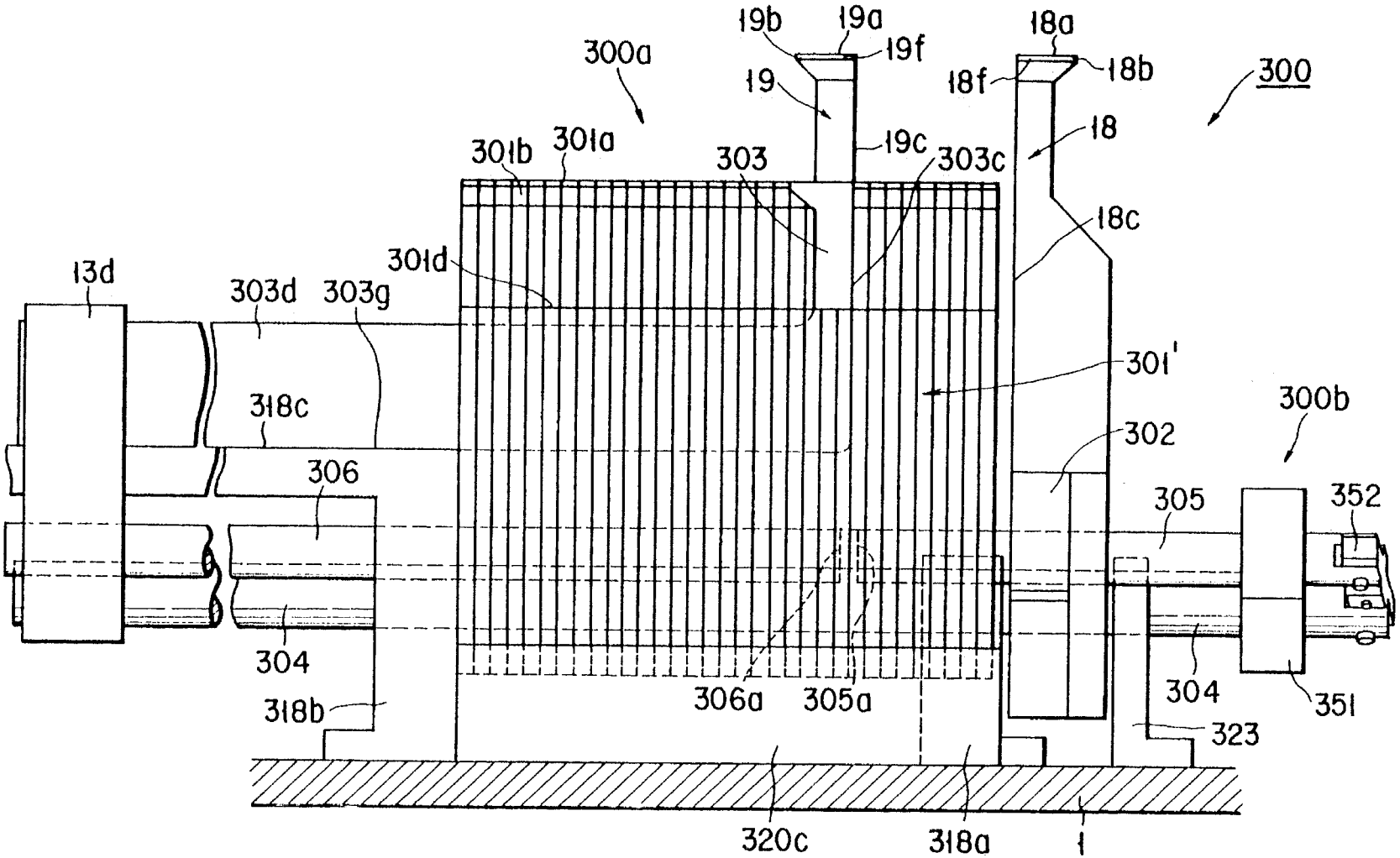
FIG. 9 is a left side view of the selective positioning mechanism.

FIG. 8 is an enlarged front view showing the selective positioning member 300; and FIG. 9 is an enlarged left side view of the same. The selective positioning members 300 are provided to the side portions of the lower metallic dies 18 and 19, respectively. A number of multilayer spacer metallic dies 301' selected by the spacer mechanisms 300*a* of the selective positioning members 300 are inserted between the lower metallic dies 18 and 19 by the selecting mechanisms 300*b*.

FIGS. 8 and 9 show a state before the multilayer spacer metallic dies 301' are inserted between the lower metallic dies 18 and 19 and between the auxiliary lower metallic dies 302 and 303.

As shown in FIGS. 8 and 9, interlocking main shafts 304 serving as two interlocking bodies are fixed to the coupling piece member 13*d*, projecting from the side portion of the movable die plate 13, to be parallel to the moving direction of the movable die plate 13. The interlocking main shafts 304 are axially supported by two bearing tables 318*a* and 318*b* fixed on the lower bed 1 in the axial direction.

Two support shafts 306 are fixed to the coupling piece member 13*d* to be parallel to and at the same distance from the two interlocking main shafts 304. End portions 306*a* of the support shafts 306 extend to a position substantially in the same plane as the inner end face 19*c* of the lower metallic die 19 and an inner end face 303*c* of the auxiliary lower metallic die 303.

A flat reception table portion 318*c* is formed on the upper end of the bearing table 318*b* to support part of a lower surface 303*g* of the extension piece 303*d* on the side portion of the auxiliary lower metallic die 303. As described above, the extension piece 303*d* is fixed to the coupling piece member 13*d*.

Figure 10A:
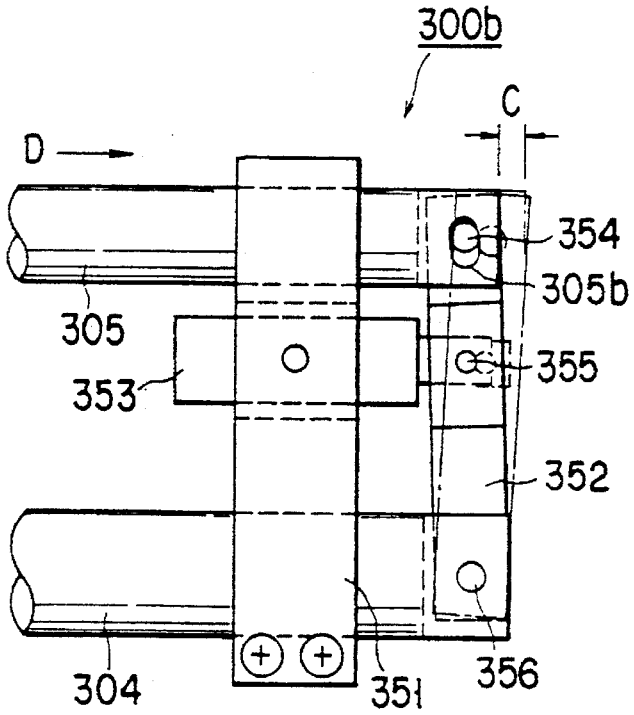
FIGS. 10A and 10B are side and front views, respectively, of a selecting mechanism.
Figure 10B:
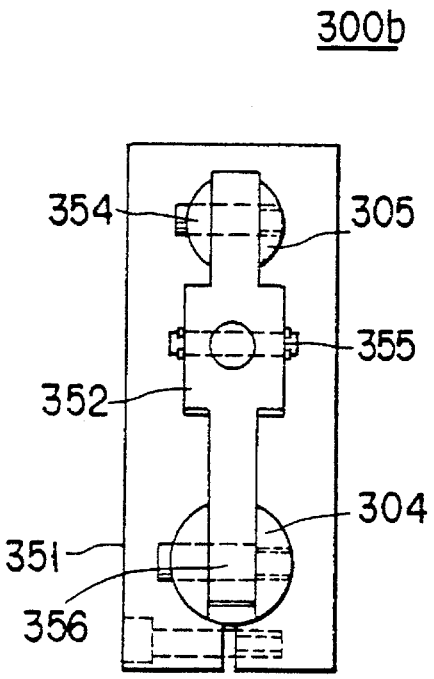

The selecting mechanism 300*b* shown in the side and front views, respectively, of FIGS. 10A and 10B is provided to the end portion of each interlocking main shaft 304.

The selecting mechanism 300*b* will be described. An intermittent table 351 is fixed to the corresponding interlocking main shaft 304, and a selecting shaft 305 serving as a selective body opposing the support shaft 306 is slidably provided on the upper end of the intermittent table 351. One end portion 305*a* of the selecting shaft 305 is spaced apart from the end portion 306*a* of the corresponding support shaft 306 by a distance corresponding to about one multilayer spacer metallic die 301'.

An engaging hole 305*b* is formed in the other end portion of the selecting shaft 305. A coupling pin 356 is provided to the end portion of the interlocking main shaft 304 to serve as the reciprocal pivot fulcrum of a corresponding intermittent member 352. A coupling pin 354 on the distal end of the intermittent member 352 is engaged with the engaging hole 305*b* of the selecting shaft 305.

The actuating piece of a cylinder 353 provided to the intermittent table 351 is coupled to the intermittent member 352 through a coupling pin 355. When the cylinder 353 is actuated, the selecting shaft 305 can be slid in the axial direction by a distance corresponding to about one multilayer spacer metallic die 301'.

Referring to FIG. 10A, when the cylinder 353 is not actuated, the selecting shaft 305 is moved in a direction of an arrow D to a position indicated by an alternate long and short dashed line, and its one end portion 305*a* is spaced apart from the end portions 306*a* of the of the support shafts 306 by a gap c corresponding to about one multilayer spacer metallic die 301' (to be described later).

The spacer mechanism 300*a* will be described with reference to FIGS. 8, 9, and 19. The auxiliary lower metallic die 302 and a coupling member 308 are interposed between the bearing table 318*a* and metal stopper members 323.

Keys 307 for obtaining slidable engagement with the interlocking main shafts 304 are formed in the interlocking main shafts 304 and the coupling member 308. When the selecting shafts 305 are pivoted about the corresponding interlocking main shafts 304, the postures of the auxiliary lower metallic die 302 and the coupling member 308 are changed.

Figure 11:
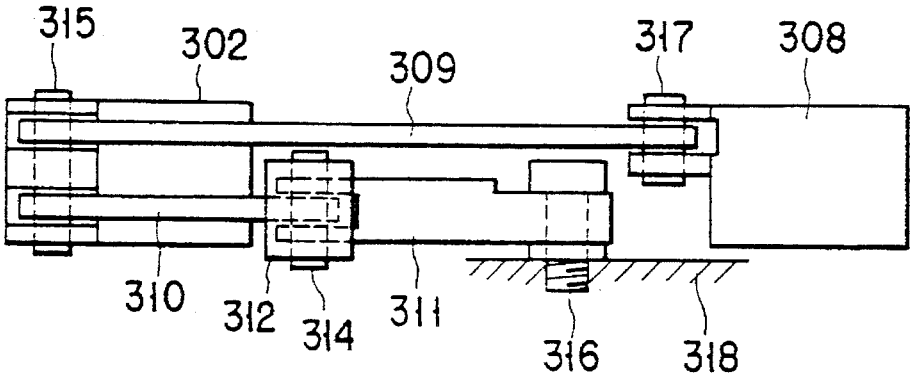
FIG. 11 is a bottom view showing a coupling link.

A coupling link 309 is provided between the auxiliary lower metallic die 302 and the coupling member 308 through pins 315 and 317, as shown in the bottom view of FIG. 11. FIG. 11 shows a state wherein a cylinder 313 is actuated, the auxiliary lower metallic die 302 and the coupling member 308 are pivoted, and the spacer metallic die 301 is inserted between the lower metallic dies 18 and 19.

Each of the holes through which the coupling link 309 is engaged with the pins 315 and 317 has a length equal to the distance between the selecting shafts 305.

Furthermore, two foldable links 310 and 311 are coupled between the auxiliary lower metallic die 302 and the bearing table 318a by a pin 314, the pin 315, and a pin 316. The portions of the foldable links 310 and 311 at the central pin 314 are coupled to each other through a coupling member 312. The rod of the cylinder 313 provided in the lower bed 1 is connected to the coupling member 312, as shown in FIG. 8.

As shown in FIG. 9, the plurality of multilayer spacer metallic dies 301' are provided between the auxiliary lower metallic die 302 and the bearing table 318*b* in an aligned state (the shape of which is indicated by the solid line in FIG. 8).

The multilayer spacer metallic dies 301' are axially supported by the support shafts 306 or the selecting shafts 305. As shown in FIG. 8, the two end portions of each multilayer spacer metallic die 301' have shapes partially corresponding to the lower metallic dies 18 and 19 and the auxiliary lower metallic dies 302 and 303. More specifically, the multilayer spacer metallic die 301' shown in FIGS. 7 and 9 is formed with an upper surface 301*a*, a third bent surface 301*b*, an upper surface 301*d*, and a fourth bent surface 301*e*. The upper surface 301*a* corresponds to the upper surfaces 18*a* and 19*a* of the lower metallic dies 18 and 19. The third bent surface 301*b* corresponds to the third bent surfaces 18*f* and 19*f* of the lower metallic dies 18 and 19. The upper surface 301*d* corresponds to upper surfaces 302*a* and 303*a* of the auxiliary lower metallic dies 302 and 303. The fourth bent surface 301*e* corresponds to the fourth bent surfaces 302*f* and 303*f* of the auxiliary lower metallic dies 302 and 303.

In a state shown in FIGS. 8 and 9 before pivoting, the bottom portion of the multilayer spacer metallic die 301' is placed on a reception table 320*c* fixed to the lower bed 1 and on a reference table 320*a* on the bearing table 318*a*.

A intermediate reception groove portion 301*g* of the multilayer spacer metallic die 301' placed on the reception table 320*c* and the reference table 320*a*, supports the lower surface 303*g* of the auxiliary lower metallic die 303.

Figure 12:
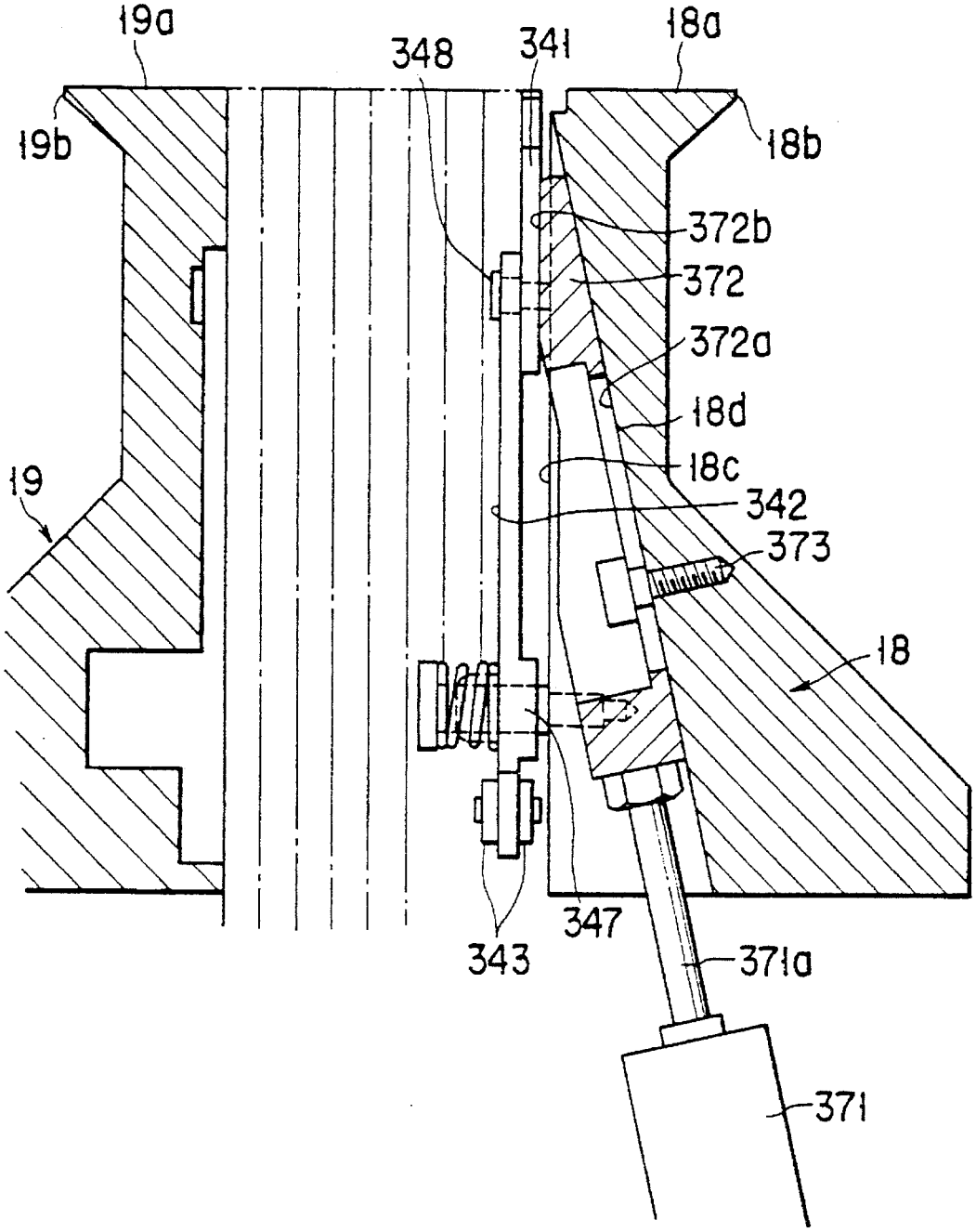
FIG. 12 is a sectional view showing an adjustment spacer.

FIG. 12 is an enlarged sectional view of the lower metallic dies 18 and 19 for showing an adjustment spacer 372.

Inclined surfaces 18*d* having predetermined inclinations are formed on an inner end face 18*c* of the lower metallic die 18 at predetermined pitches. The adjustment spacer 372 is provided to project along the inclined surfaces 18*d*.

More specifically, an inclined surface portion 372*a* is formed on the adjustment spacer 372 to correspond to the inclined surfaces 18*d* of the lower metallic die 18, and the adjustment spacer 372 is axially supported on the lower metallic die 18 by a guide pin 373 to be slidable. A rod 371*a* of a cylinder 371 is coupled to the lower portion of the adjustment spacer 372. The proximal portion of the cylinder 371 is axially supported on the stationary die plate 12.

The adjustment spacer 372 is provided such that its press surface 372*b* formed on its uppermost portion can project from the inner end face 18*c* of the lower metallic die 18. When the cylinder 371 is actuated, the press surface 372*b* can continuously press an adjustment spacer metallic die 341 from the inner end face 18*c* toward the multilayer spacer metallic dies 301' until approaching them at a gap corresponding to about ½ the thickness of one multilayer spacer 301'.

An inclined portion 372*a* of the adjustment spacer 372 is formed at an acute angle, and the press surface 372*b* can project near the upper position of the lower metallic die 18, thereby reliably preventing deformation or escape of the lower metallic die 18 or 19.

Figure 13:
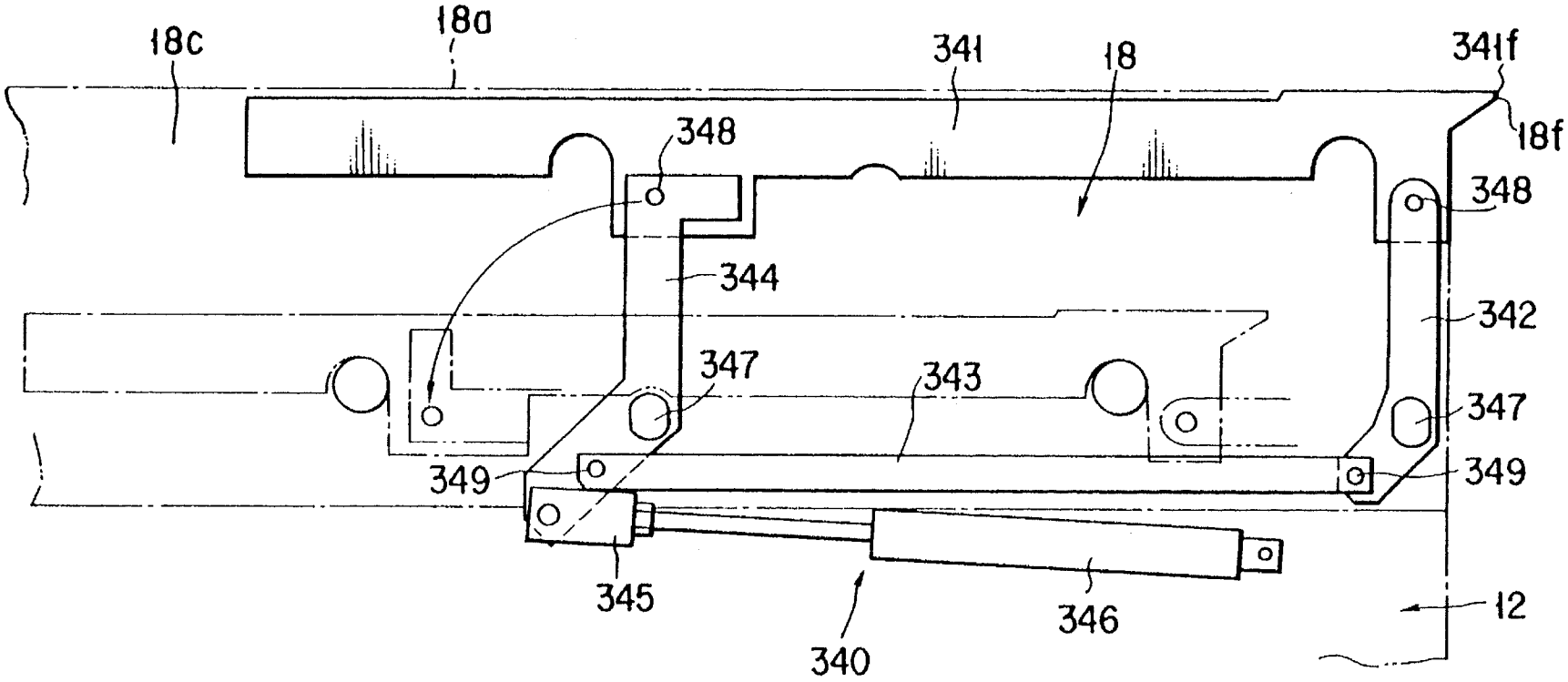
FIG. 13 is a partially enlarged view showing an adjustment spacer metallic die.

As shown in the partially enlarged view of FIG. 13, the adjustment spacer metallic die 341 is formed along the upper surface of the inner end face 18*c* of the lower metallic die 18 to extend for a predetermined length. As shown in FIG. 12, the adjustment spacer metallic die 341 has a thickness corresponding to about ½ the thickness of one multilayer spacer metallic die 301'.

The adjustment spacer metallic die 341 can be positioned at a position shown in FIG. 12 by a fourth positioning mechanism 340. More specifically, the positioning mechanism 340 is shown in FIG. 13. The two end portions of the adjustment spacer metallic die 341 are supported by levers 342 and 344 through caulking shafts 348, and the levers 342 and 344 are pivotally axially supported on the lower metallic die 18 through corresponding support shafts 347 at substantially the central portions thereof. The lower end portions of the levers 342 and 344 are coupled by a link 343 through pins 349.

Furthermore, the rod of a cylinder 346 is coupled to the lower end portion of the lever 344 through a coupling member 345. The proximal portion of the cylinder 346 is axially supported by the stationary die plate 12.

Hence, when the cylinder 346 is retracted, the adjustment spacer metallic die 341 is withdrawn to a position indicated by an alternate long and short dashed line in FIG. 13; when extended, the adjustment spacer metallic die 341 extends along the upper surface 18*a* of the lower metallic die 18 as indicated by a solid line in FIG. 13.

The operation of the cylinder 346 of the fourth positioning mechanism 340 is controlled by a fifth controller 63*e* of the control unit 63.

Figure 14:
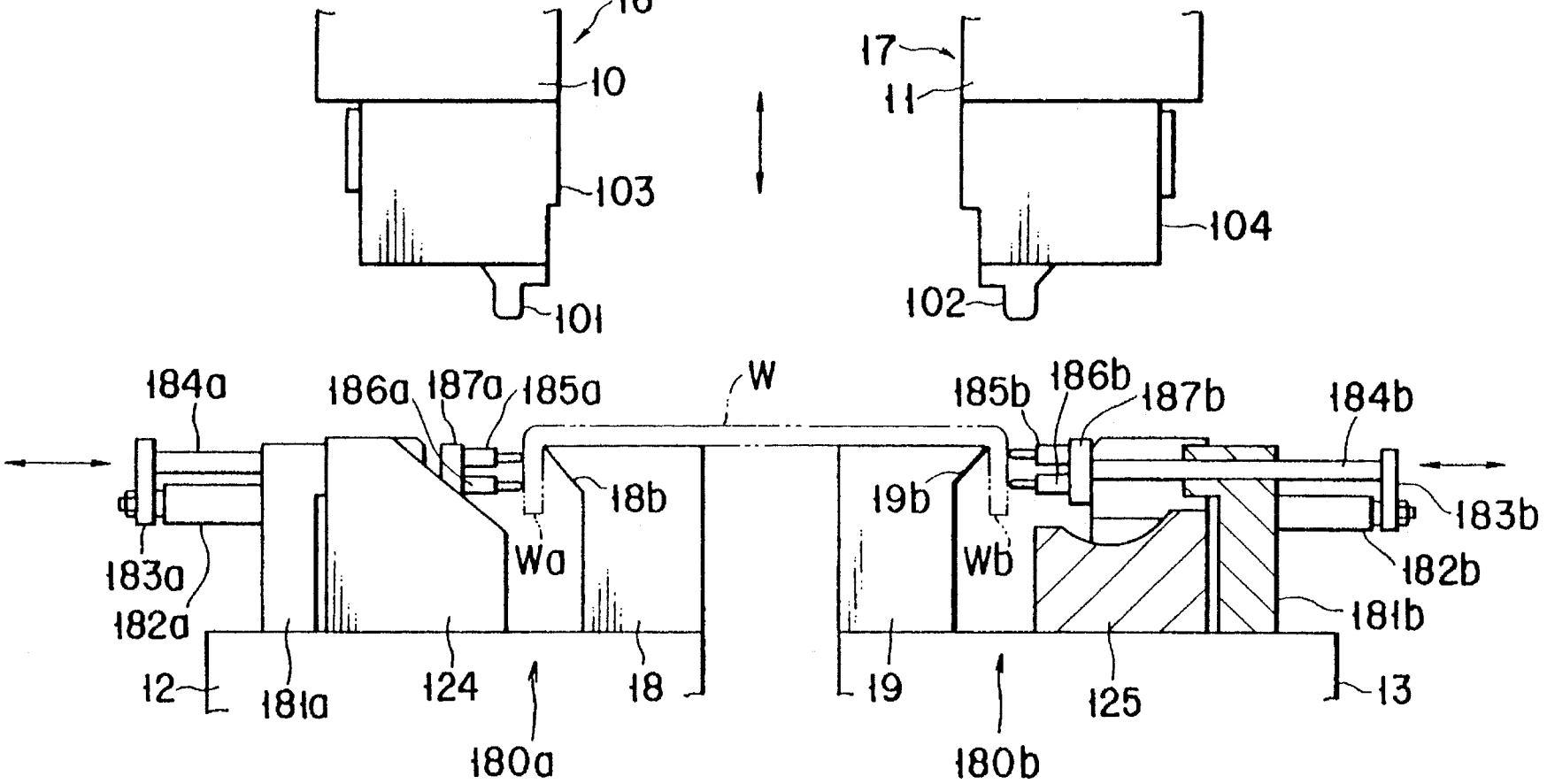
FIG. 14 is a partially cutaway enlarged side view showing a measurement mechanism.

As shown in the partially sectional enlarged side view of FIG. 14, measurement devices 180 having the same structure for measuring an angle are provided to the side portions of the lower metallic dies 18 and 19 to be symmetrical with each other. The symmetrical measurement device 180 will be described as measurement mechanisms 180*a* and 180*b* hereinafter.

A sensor bracket 181*a* of the measurement mechanism 180*a* is fixed at the side portion of the lower metallic die 18 on the stationary die plate 12, and a sensor bracket 181*b* of the measurement mechanism 180*b* is fixed at the side portion of the lower metallic die 19 on the movable die plate 13.

Cylinders 182*a* and 182*b* are fixed to the sensor brackets 181*a* and 181*b*, and the rods of the cylinders 182*a* and 182*b* are fixed to support shafts 184*a* and 184*b* through metal coupling members 183*a* and 183*b*, respectively.

The support shafts 184*a* and 184*b* are axially supported by the sensor brackets 181*a* and 181*b*, respectively, and movable. Sensor mount plates 187*a* and 187*b* are provided to the end portions of the support shafts 184*a* and 184*b*, respectively. Upper and lower sensors 185*a* and 186*a* are provided to the sensor mount plate 187*a*, and upper and lower sensors 185*b* and 186*b* are provided to the sensor mount plate 187*b*.

The two sensors 185*a* and 186*a*, and the two sensors 185*b* and 186*b* can project toward the first and second inclined surfaces 18*b* and 19*b* of the lower metallic dies 18 and 19, respectively when the cylinders 182*a* and 182*b* are actuated, the sensors 185*a* and 186*a*, and 185*b* and 186*b* are simultaneously brought into contact with portions Wa and Wb, respectively, of the work W which is bent, and measure the bending angles.

Detection signals from the sensors 185*a* and 186*a* (185*b* and 186*b*) are output to a measurement unit 190.

Figure 15:
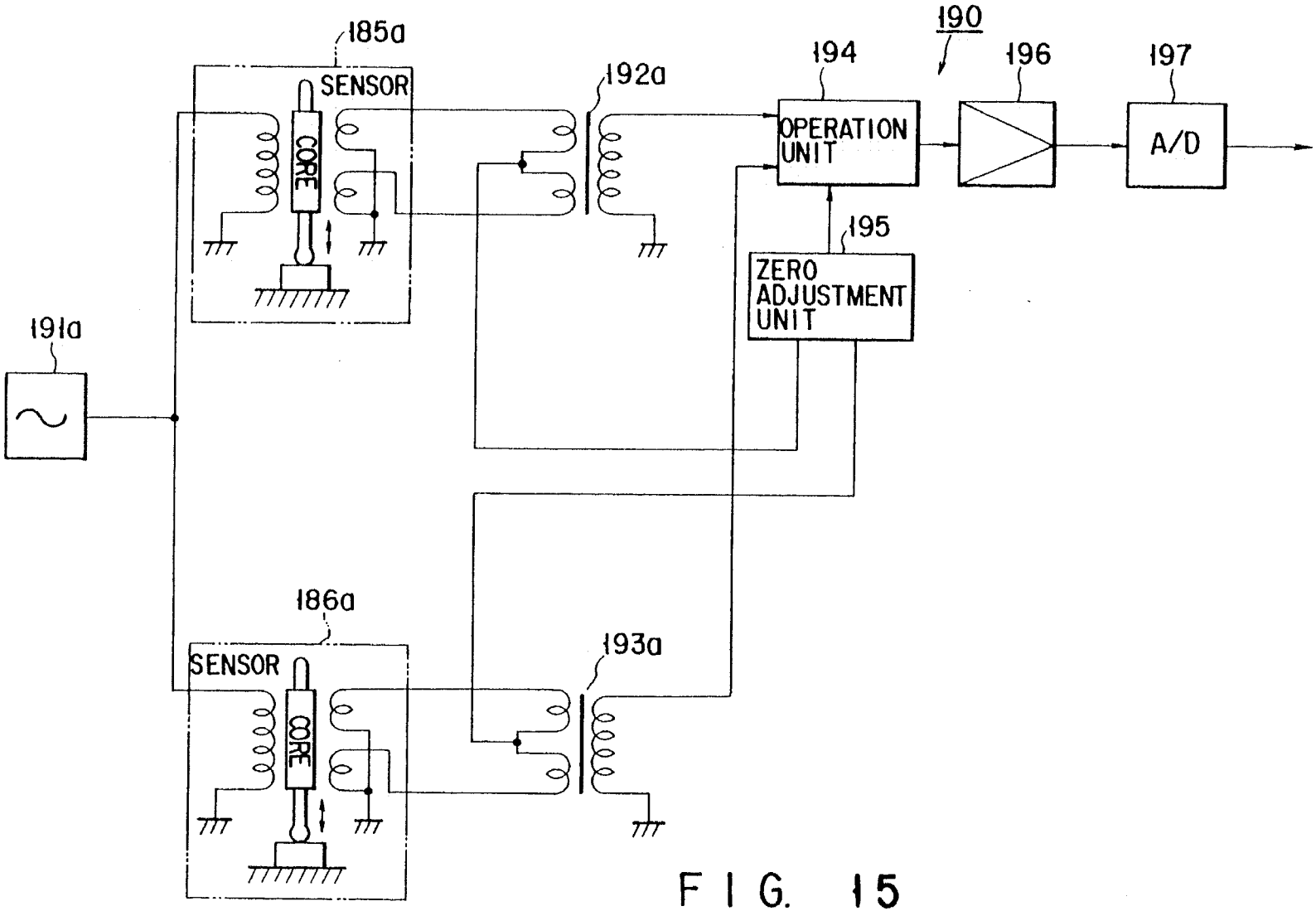
FIG. 15 is a functional block diagram showing a measurement unit.

FIG. 15 is a functional block diagram showing the measurement unit 190. The measurement unit 190 is illustrated to correspond to the sensors 185*a* and 186*a* for the first portion Wa. Another measurement unit 190 having the same arrangement to this and corresponding to the sensors 185*b* and 186*b* for the second portion Wb is also provided.

The measurement unit 190 will be described. An oscillator 191*a* for Supplying an oscillation signal having a predetermined period to the sensors 185*a* and 186*a* is provided.

The detection signals from the sensors 185*a* and 186*a* are supplied to corresponding differential transformers 192*a* and 193*a* to detect their differences, and the differential detection signals are output to an operation unit 194. The operation unit 194 calculates and outputs the bending angle of the first portion Wa of the work W by calculating a difference detection signal.

A zero adjustment unit 195 is connected to the center taps of the differential transformers 192*a* and 193*a*, respectively, to perform zero correction of the differential transformers 192*a* and 193*a*.

An operation output is amplified by a preamplifier 196, converted by an A/D converter 197, and output to a third controller 63*c* of the control unit 63.

The measurement mechanisms 180*a* and 180*b*, and the measurement unit 190 can be provided for each of third and fourth portions Wc and Wd, and the bending angle signals can be sent to the control unit 63.

FIG. 16 is a block diagram showing the control unit 63. The control unit 63 has the first and second controllers 63*a* and 63*b*, a third controller 63*c*, the fourth controller 63*d*, and a fifth controller 63*e*.

The first controller 63*a* controls the servo motor 20 serving as the first driving source and positions the upper metallic die mechanism 17 and the lower metallic die 19 on the side of the movable die plate 13.

The second controller 63*b* controls the servo motor 58 serving as the second driving source and finely positions the upper metallic die mechanisms 16 and 17, the cooperative metallic dies 406 and 407, and the nuts 151 and 152 through the second positioning mechanism 400.

The third controller 63*c* controls the lower servo motors 128*a* and 128*b* serving as the third driving sources in response to the bending angle command for the first and second portions Wa and Wb output from a setup command section 63*f*, and sets the angles of the guide surfaces 121*a* and 122*a* of the lower guide mechanisms 120*a* and 120*b*.

A comparison combination controller 63*g* compares the measured amount obtained by the measurement mechanisms 180*a* and 180*b* with the angle command output from the setup command section 63*f* and outputs a correction angle command to the third controller 63*c*. The third controller 63*c* changes the angles of the guide surfaces 121*a* and 122*a*.

At this time, the comparison combination controller 63*g* outputs a re-pressing command to the fourth controller 63*d*.

Upon reception of the pressing commands from the setup command section 63*f* and the comparison combination controller 63*g*, the fourth controller 63*d* actuates the cylinders 141*a* and 141*b* to push the lower guide mechanisms 120*a* and 120*b* to be abutted against the nuts 151 and 152, respectively. Simultaneously, the fourth controller 63*d* adjusts the pressures of the pushers 113*a* and 113*b* and actuates the hydraulic cylinder 4 to move the press slider 2 downward, thus performing pressing.

The fifth controller 63*e* determines, from the detection signal from the rotary detector 250, the number multilayer spacer metallic dies 301' corresponding to the gap between the lower metallic dies 18 and 19 and whether the adjustment spacer metallic die 341 can be inserted in the remaining gap after appropriate number of multilayer spacer metallic die 301' are inserted, and controls the operations of the selective positioning member 300 and the fourth positioning mechanism 340.

The operation of the metallic die device having the above arrangement will be described.

when the lower metallic die 19 and the upper metallic die mechanism 17 on the side of the movable die plate 13 are to be positioned, a positioning command is input to the servo motor 20 from the first controller 63*a* of the control unit 63 to rotate the servo motor 20, thereby rotating the spline shaft 22.

Then, the screw shafts 40A and 40B are rotated through the bevel gears to simultaneously move the lower metallic die 19 on the movable die plate 13 and the upper metallic die mechanism 17 on the movable punch plate 11, respectively, by the same distance.

When the lower metallic die 19 and the upper metallic die mechanism 17 reach desired positions, the servo motor 20 is stopped to stop the lower metallic die 19 and the upper metallic die mechanism 17, thereby positioning the lower metallic die 19 and the upper metallic die mechanism 17 at the desired positions. These positions are detected by the rotary detector 250, and detection signals are output to the fifth controller 63*e* of the control unit 63.

When a command value for fine adjustment positioning is input to the fine adjustment servo motor 58 from the second controller 63*b* of the control unit 63, the servo motor 58 starts rotation to rotate the driving shaft 56 for punch fine adjustment, and the screw shafts 52 are rotated through the bevel gears.

Upon rotation of the screw shafts 52, the nuts 53 threadably engaged with the screw shafts 52 are rotated, and the stationary punch plate 10 is moved as it is guided along the upper guide rails 14. Meanwhile, the screw shafts 52 rotate the corresponding spline 52*a*, thereby rotating the fine adjustment screws 60 threadably engaged with the spline shafts 52*a*. Since the fine adjustment screws 60 are integral with the punch fine adjustment base 62, when the fine adjustment screws 60 are rotated, the movable punch plate 11 is further moved, from the position where it is positioned by the metallic die positioning servo motor 20, by a small distance.

Similarly, the servo motor 58 is connected to the second positioning mechanism 400 to slightly move the cooperative metallic dies 406 and 407 in the opposite directions.

Then, the upper metallic die mechanisms 16 and 17 can be automatically positioned at positions slightly moved toward the lower metallic dies 18 and 19. Simultaneously, the cooperative metallic dies 406 and 407 shown in FIG. 7 can be automatically positioned at positions slightly moved toward the third bent surfaces 18*f*, 19*f*, and 301*b*, and toward the fourth bent surfaces 302*f*, 303*f*, and 301*e*, respectively.

The fifth controller 63*e* of the control unit 63 calculates the gap between the lower metallic dies 18 and 19 from the detection signal from the rotary detector 250 and controls the selective positioning members 300 so as to insert a number of multilayer spacer metallic die 301' corresponding to this gap between the lower metallic dies 18 and 19.

Figure 17:
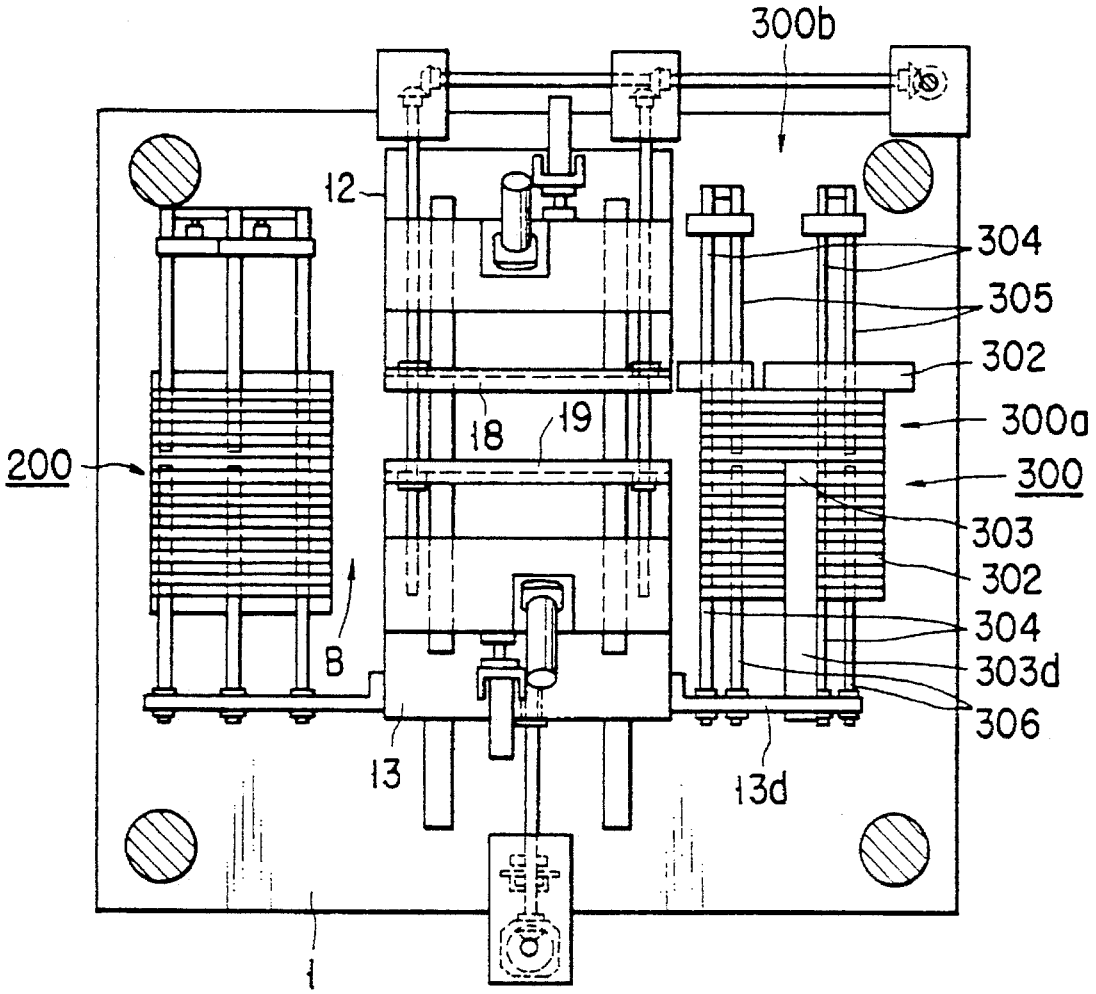
FIG. 17 is a sectional view showing the operation of the enter metallic die device.

The operation of the spacer mechanisms 300*a* of the selective positioning members 300 at this time will be described. As shown in FIG. 17, when the movable die plate 13 and the lower metallic die 19 are moved toward the lower metallic die 18 (FIG. 4) in a direction indicated by an arrow B, the extension piece 303*d* on the side portion of the auxiliary lower metallic die 303 slides on the reception table portion 318*c* and the reception groove portion 301*g* of a multilayer spacer metallic die 301' through the coupling piece member 13*d* fixed to the movable die plate 13. Then, predetermined equal gaps are formed between the lower metallic dies 18 and 19, and between the auxiliary lower metallic dies 302 and 303 shown in FIGS. 8 and 9.

The fifth controller 63*e* calculates the difference between the gap, between the lower metallic dies 18 and 19, and the total thickness of the multilayer spacer metallic dies 301', and determines whether to actuate the cylinders 353 for the intermittent members 352 of the selecting mechanisms 300*b* from the obtained difference, thereby deciding the operation of the cylinder 353.

One end portion 305*a* of each selecting shaft 305 is located in the corresponding multilayer spacer metallic die 301' next to a multilayer spacer metallic die 301' located at the end portion 306*a* (the inner end face 19*c* of the lower metallic die 19) of the corresponding support shaft 306.

Figure 18:
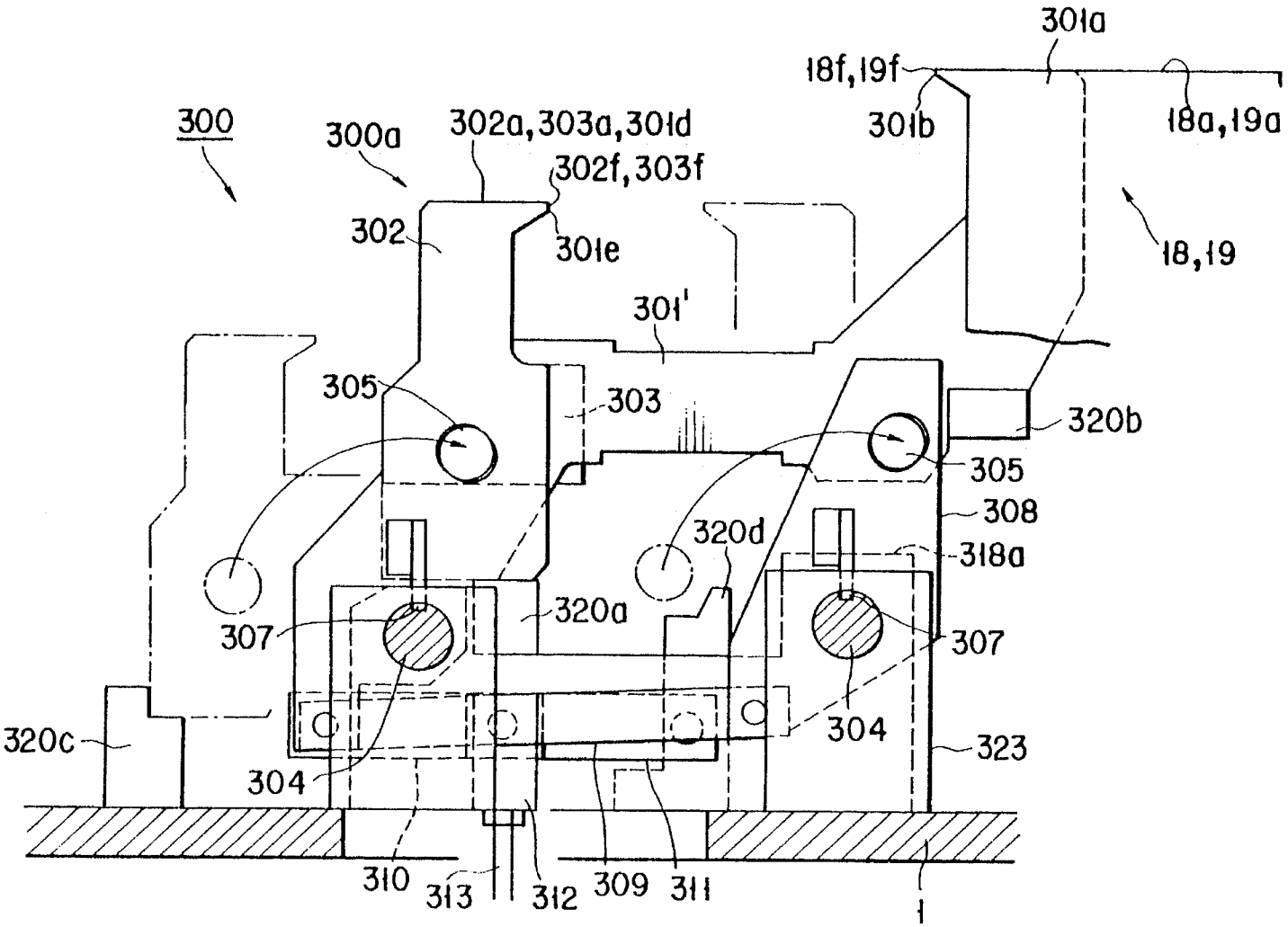
FIG. 18 is a front view showing the operation of the selective positioning mechanism.
Figure 19:
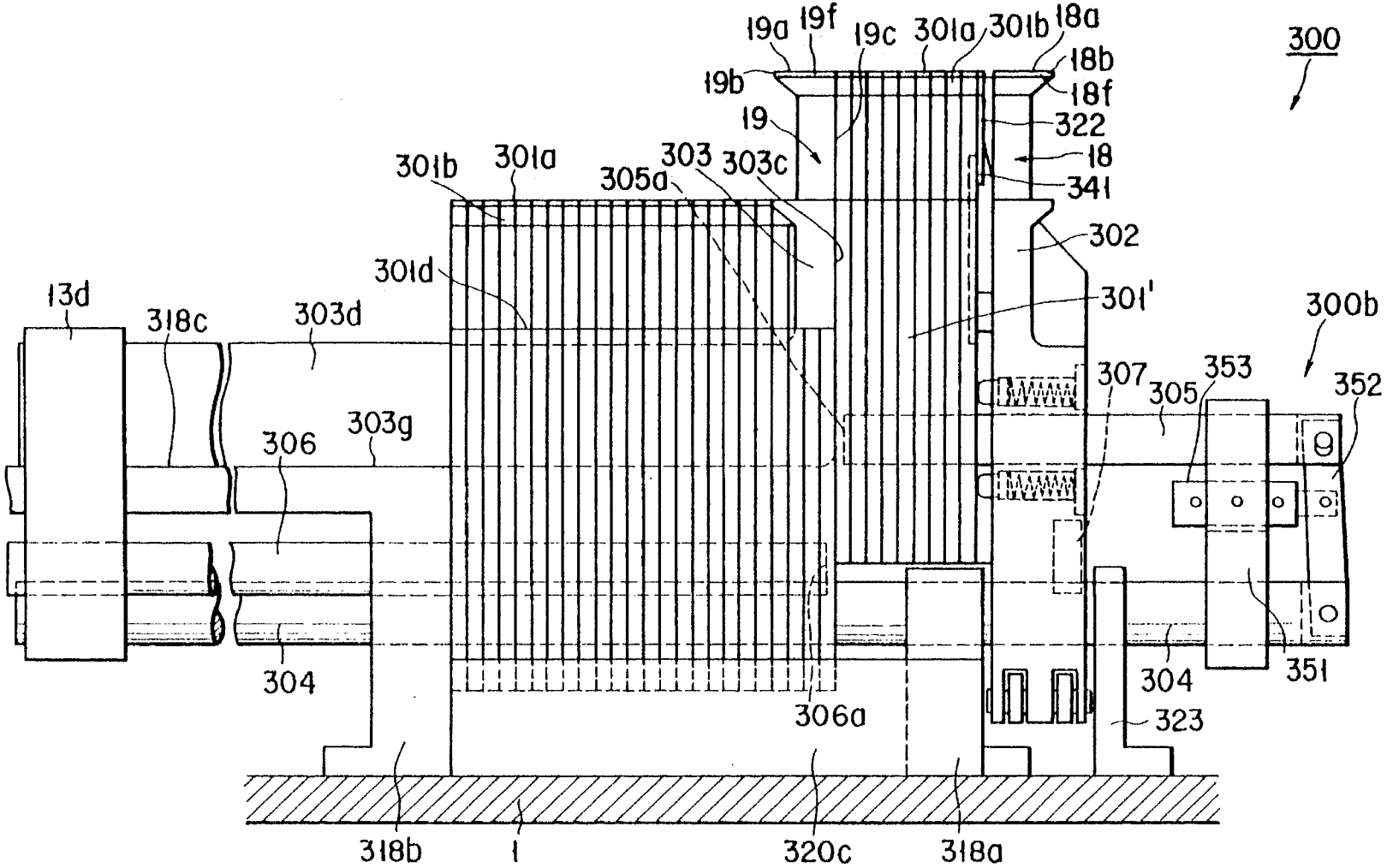
FIG. 19 is a left side view showing the operation of the selective positioning mechanism.

Thereafter, as shown in the operational views of FIGS. 18 and 19, when the cylinder 313 of each spacer mechanism 300*a* is controlled to extend its rod, the foldable links 310 and 311 are extended substantially linearly, and thus the auxiliary lower metallic die 302 is pivoted about the corresponding interlocking main shaft 304 and set in the upright state. Simultaneously, the coupling member 308 coupled to the auxiliary lower metallic die 302 through the coupling link 309 is also pivoted about the corresponding interlocking main shaft 304 and set in the upright state.

Upon rotation of the auxiliary lower metallic die 302 and the coupling member 308, the selecting shafts 305 inserted through them are rotated as indicated by the traces indicated as arrows in FIG. 18. Then, a predetermined number of multilayer spacer metallic dies 301' through which the selecting shafts 305 are inserted are lifted while maintaining the parallel state, as shown in FIGS. 18 and 19, and are moved toward the lower metallic dies 18 and 19. By the operation of the selecting mechanisms 300*b*, the selecting shafts 305 are inserted between the lower metallic dies 18 and 19 while having a number of multilayer spacer metallic dies 301', equal to or less than the gap between the lower metallic dies 18 and 19, engaged thereto.

In this state, the multilayer spacer metallic dies 301' are placed on the reference table 320*a* and a reference table 320*b*. The reference tables 320*a* and 320*b* are provided to correspond to the selecting shafts 305 in the downward movement, and can stably place the multilayer spacer metallic die 301' thereon.

When a multilayer spacer metallic die 301' is placed on the reference tables 320*a* and 320*b*, the third bent surface 301*b* formed on it is located along the third bent surfaces 18*f* and 19*f* of the lower metallic dies 18 and 19, and the fourth bent surface 301*e* is located along the fourth bent surfaces 302*f* and 303*f* of the auxiliary lower metallic dies 302 and 303.

Thereafter, the fifth controller 63*e* actuates the cylinder 346, as shown in FIGS. 12 and 13, to push the adjustment spacer 372 and the adjustment spacer metallic die 341 between the multilayer spacer metallic dies 301' and the lower metallic die 19, thereby eliminating the gap between the multilayer spacer metallic die 301' and the lower metallic die 19.

Figure 20:
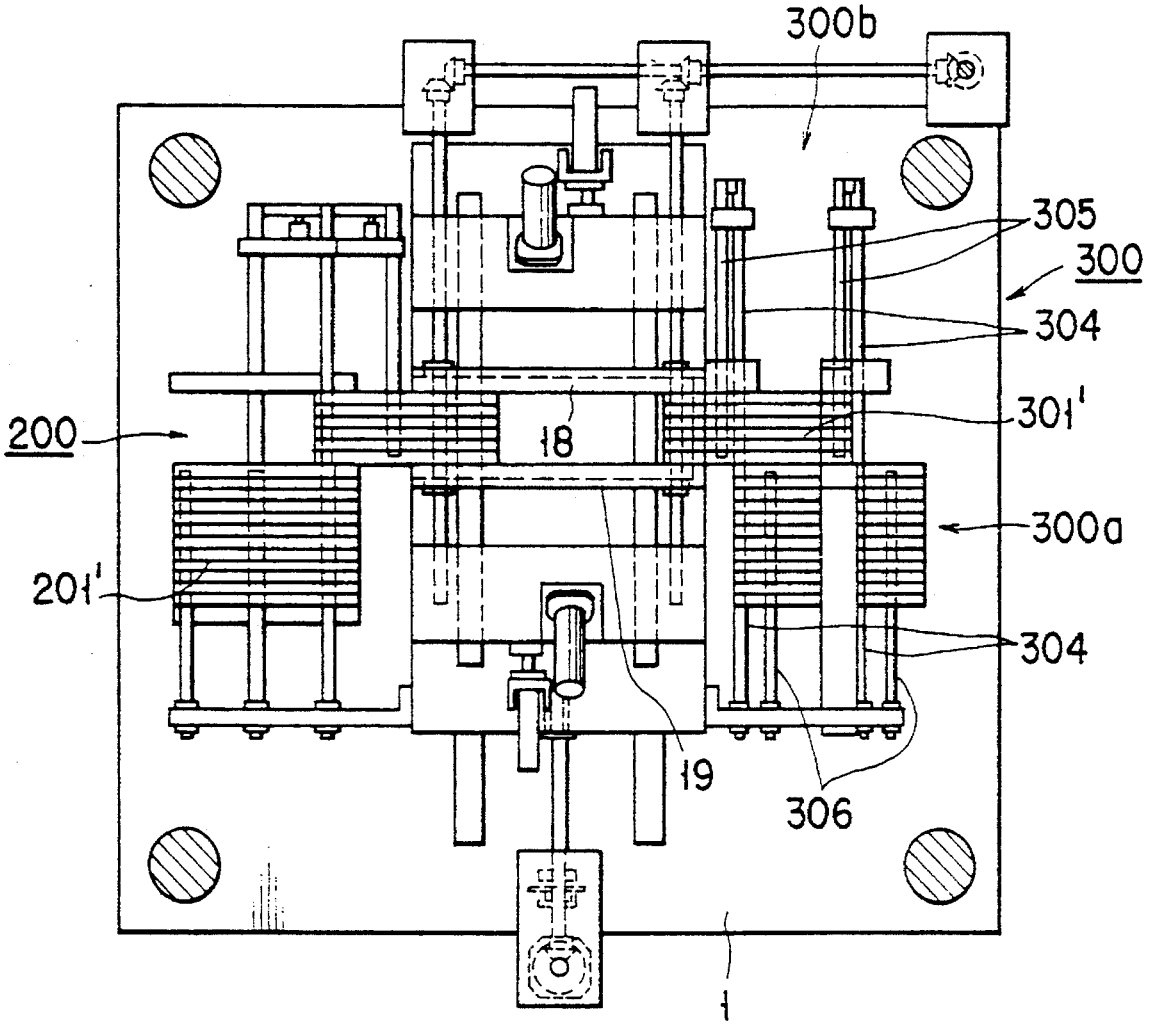
FIG. 20 is a sectional view showing the operation of the entire metallic die device.

In this state, as shown in FIG. 20, the plurality of multilayer spacer metallic dies 301', the adjustment spacers 372, and the adjustment spacer metallic die 341 are inserted between the lower metallic dies 18 and 19.

Figure 21:
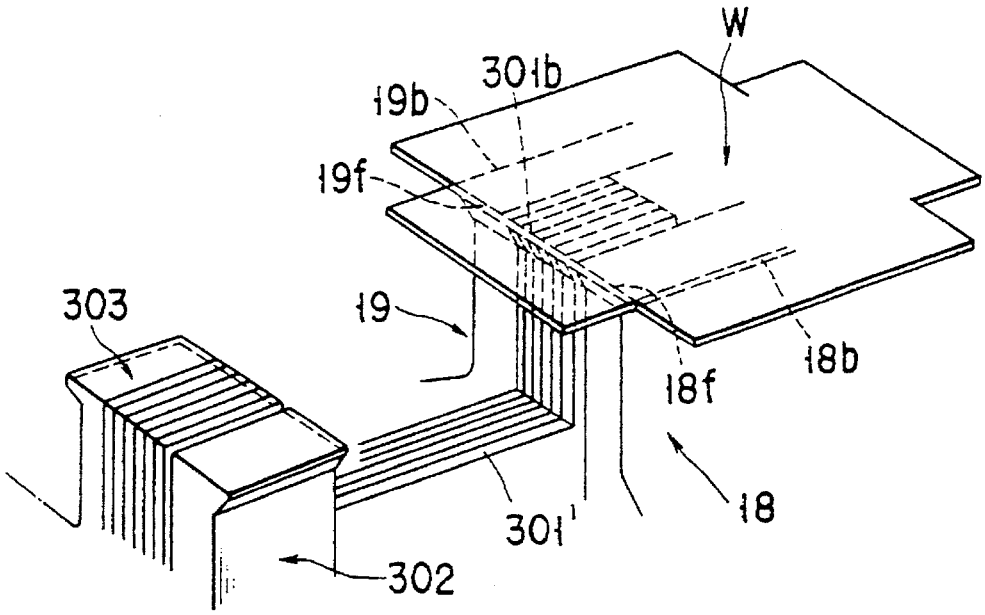
FIG. 21 is a perspective view showing a work bending process of the metallic die device.

In the pressing process, as shown in the perspective view of FIG. 21, the work W is conveyed by a convey unit (not shown) and positioned on the lower metallic dies 18 and 19.

In this embodiment, notches are formed at the four corners of the work W. The work W is formed into a box by bending it at the first to fourth portions.

Then, in order to bend the two sides of the work W, the control unit 63 outputs a signal for moving the press slider 2 (FIGS. 1 and 2) downward when the hydraulic cylinder 4 is driven to move the plunger 4A downward, the press slider 2 is moved downward through the pin 6.

Even after the upper metallic die mechanisms 16 and 17 are brought into contact with the work W, the press slider 2 is further moved downward to simultaneously bend the first and second portions Wa and Wb as the two sides of the work W with the first and second inclined surfaces 18*b* and 18*b* of the lower metallic dies 18 and 19, respectively.

Figure 22:
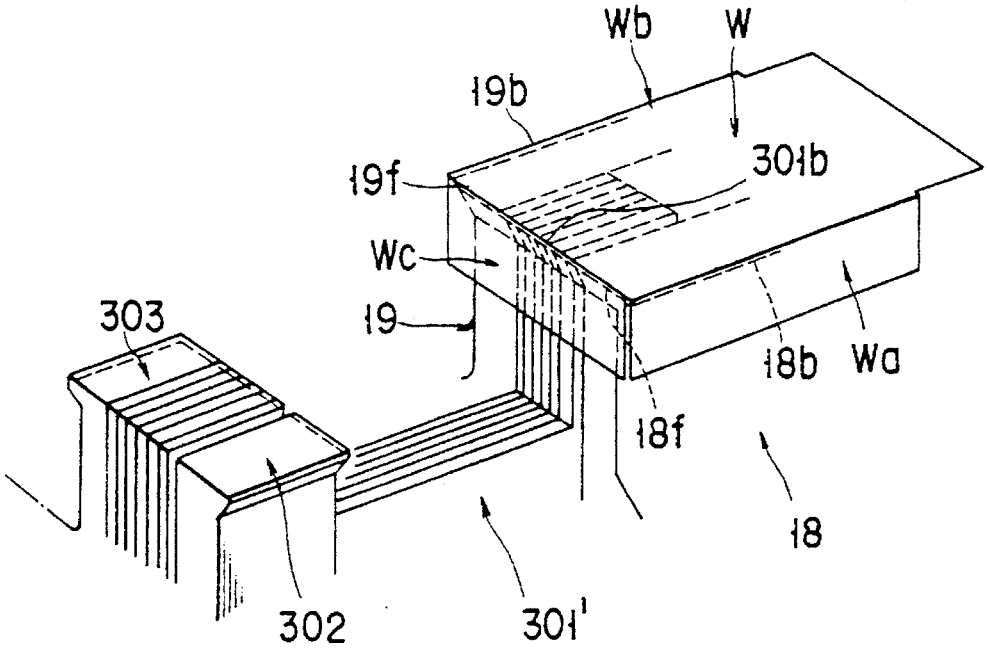
FIG. 22 is a view similarly showing a work bending process.

At this time, as shown in FIG. 22, the cooperative metallic die 406 is moved downward onto the third bent surfaces 18*f* and 19*f* of the lower metallic dies 18 and 19, and the third bent surfaces 301*b* of the multilayer spacer metallic dies 301' simultaneously, in order to bend the third portion Wc of the work W.

At this time, when the press slider 2 is moved downward, the bevel gear 35 of the press slider 2 is moved downward as it slides in the groove of the spline shaft 22.

After the work W is bent, the press slider 2 reaches the lower dead point, is moved upward, and then stopped at the upper dead point as the uppermost position.

Figure 23:
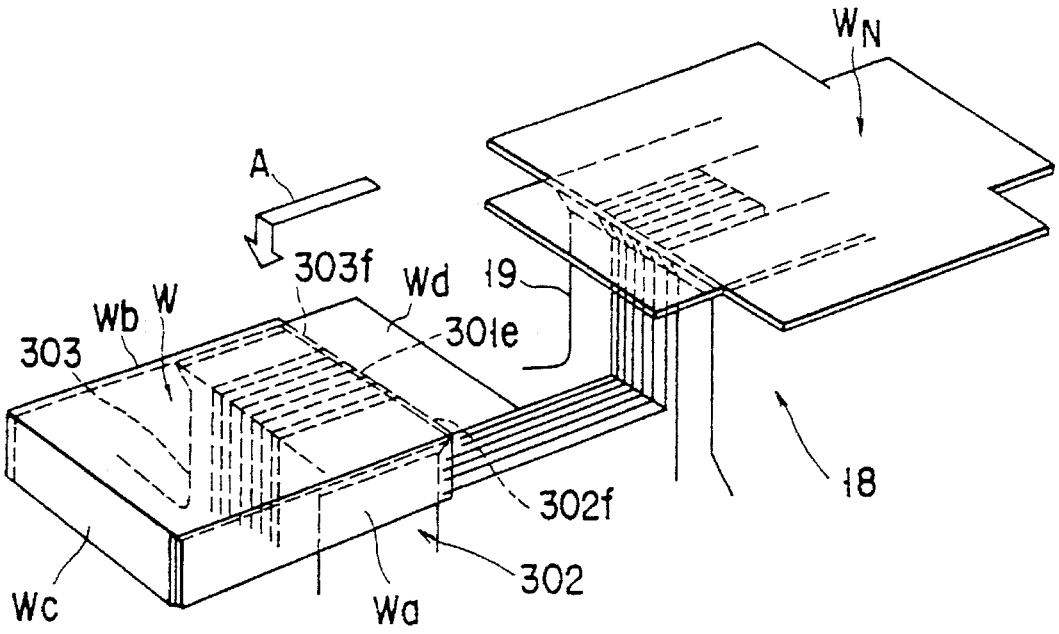
FIG. 23 is a view similarly showing a work bending process.

Then, the convey unit conveys the work W, having the first to third portions, to a position above the auxiliary lower metallic dies 302 and 303, as shown in FIG. 23. This conveyance can be easily performed by only moving the work W horizontally and then placing the work W on the auxiliary lower metallic dies 302 and 303 with a predetermined step, as indicated by an arrow A in FIG. 23. The fourth portion Wd of the work W is located to correspond to the fourth bent surfaces 302*f*, 303*f*, and 301*e*. Then, the convey unit places a subsequent work Wn on the lower metallic dies 18 and 19, thereby performing continuous pressing.

Figure 24:
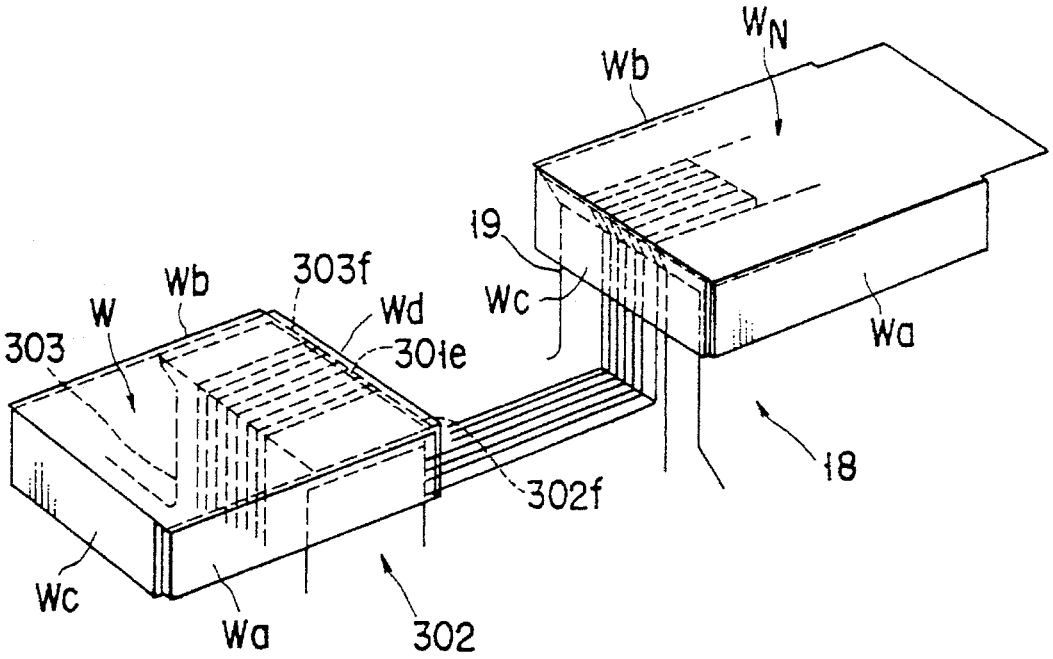
FIG. 24 is a view similarly showing a work bending process.

When the press slider 2 is moved downward again, as shown in FIG. 24, the cooperative metallic die 407 is moved downward onto the fourth bent surfaces 302*f* and 303*f* of the auxiliary lower metallic dies 302 and 303, and the fourth bent surfaces 301*e* of the spacer metallic die 301' simultaneously, thereby bending the fourth portion Wd of the work W.

At this time, first to third portions Wa to Wc of the subsequent work Wn are bent simultaneously.

When the first to fourth portions of the work W are to be bent, since the multilayer spacer metallic dies 301' are inserted between the lower metallic dies 18 and 19 and between the auxiliary lower metallic dies 302 and 303, escape or deformation does not occur in the lower metallic die 18 or 19, and the work W can be bent at high precision.

The first and second portions Wa and Wb of the work W can be bent at an arbitrary angle other than the right angle shown in FIGS. 23 and 24. In this case, the third controller 63*c* of the control unit 63 only need to pivot the pivotal upper metallic dies 101 and 102 of the upper metallic die mechanisms 16 and 17 in accordance with the lower position of the press slider 2.

Then, the pivotal upper metallic dies 101 and 102 can simultaneously bend the first and second portions Wa and Wb of the work W at predetermined angles. The maximum bending angles are set to the inclination angles of the first and second inclined surfaces 18*b* and 19*b*.

A case will be described wherein the bending width, thickness, or material of the work W is to be changed. In this case, the servo motor 20 is driven by a positioning command signal from the first controller 63*a* of the control unit 63 to move the lower metallic die 19 and the upper metallic die mechanisms 16 and 17, and the servo motor 58 is driven by a punch fine positioning command to move the upper metallic die mechanisms 16 and 17 and the cooperative metallic dies 406 and 407 by a small distance. After necessary adjustment is performed, bending is performed by the same operation as described above. In this case, since the multilayer spacer metallic dies 301' are inserted between the lower metallic dies 18 and 19 and between the auxiliary lower metallic dies 302 and 303 by the selective positioning member 300 in the same manner as described above, high-precision pressing can be performed.

In this embodiment, the multilayer spacer metallic dies 301' are inserted between the lower metallic dies 18 and 19. However, the multilayer spacer metallic dies 301' (multilayer spacer 201') can be inserted between the divided upper metallic die mechanisms 16 and 17 instead, while obtaining the same effect as that described above.

In this embodiment, the selective positioning member 300 is provided on one side portion of the lower metallic dies 18 and 19. However, a selective positioning mechanism 200 shown in FIGS. 1 and 3 having almost the same structure as that of the selective positioning member 300 can be arranged to the other side portion of the lower metallic dies 18 and 19 to be symmetrical to the selective positioning member 300.

In the selective positioning mechanism 200, third and fourth portions of the work W are not bent. Therefore, a multilayer spacer 201' only need be inserted between the lower metallic dies 18 and 19 to prevent escape or deformation of the lower metallic die 18 or 19, and an auxiliary lower metallic die need not be provided.

Figure 25:
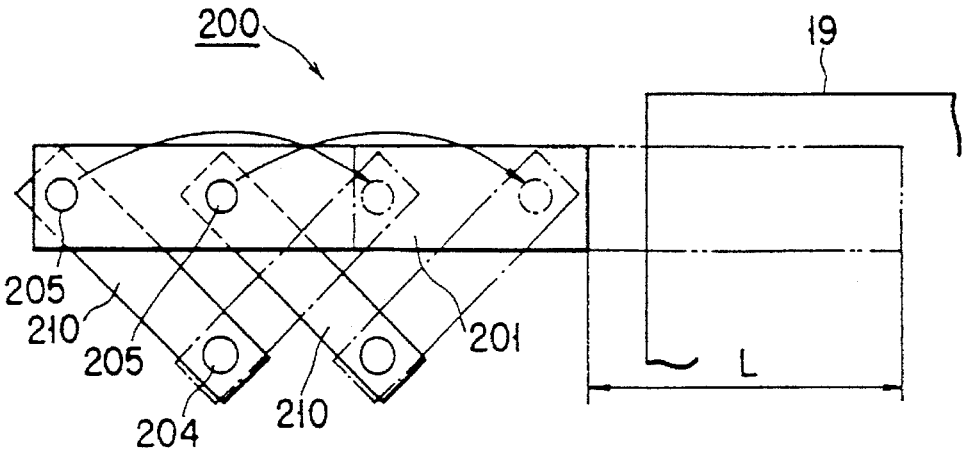
FIG. 25 is a partially enlarged rear view of another selective positioning mechanism.

FIG. 25 is a partially enlarged rear view of a selective positioning mechanism having another arrangement. As shown in FIG. 25, an elongated multilayer spacer 201' is formed to extend along the longitudinal direction of the lower metallic-die 18 or 19 and supported by two link arms 210. One end of each link arm 210 is axially supported by a corresponding metal coupling member 204, and the other end thereof is provided on a support shaft 205.

Then, when the link arms 210 are pivoted by the operation of a driving source (not shown), the multilayer spacer 201' can be moved toward the lower metallic dies 18 and 19 by a distance L, as indicated by an alternate long and short dashed line in FIG. 25, in order to increase the insertion amount between the lower metallic dies 18 and 19, thereby preventing escape or deformation of the lower metallic die 18 or 19. The insertion operation of the spacer 201' by the selective positioning mechanism 200 is performed simultaneously with the operation of the selective positioning member 300, as shown in FIGS. 4, 17, and 20.

According to the metallic die device for the press machine of the embodiment of the present invention, the spacer metallic dies have the third bent surfaces. In addition to bending of the first and second portions, the third and fourth portions of a work can be bent to have desired sizes and angles with respect to the first and second bent surfaces only by inserting the spacer metallic dies between the divided metallic dies by the first positioning mechanism. As a result, the three surfaces of the work can be simultaneously bent by a single pressing operation.

According to the embodiment of the present invention, in addition to the first to third bent surfaces, a fourth bent surface is also formed in the spacer metallic die, thus enabling bending of a total of four surfaces. Hence, a work can be formed into, e.g., a box.

The first and fourth bent surfaces are integrally formed on the spacer metallic die. Thus, the structure can be simplified, and the first positioning mechanism can be commonly used, thereby decreasing the number of components and simplifying the operation.

According to the embodiment of the present invention, the spacer metallic die is constituted as divided multilayer spacer metallic dies. Therefore, the selecting mechanism can select an appropriate number of multilayer spacer metallic dies to be inserted between the divided metallic dies in accordance with the gap between the first and second bent surfaces.

As a result, the degree of freedom of the bending size of the work is increased, and number of types of spacer metallic dies to be used for pressing can be greatly decreased. Also, the selecting mechanism can be greatly simplified, appropriate insertion is enabled, and automated operation of the press machine can be achieved, thus achieving a decrease in manufacturing cost and maintenance cost.

According to the embodiment of the present invention, as a practical example of the selecting mechanism described above, an appropriate number of selectors to be engaged with the multilayer spacer metallic die can be selected and reliably inserted by the operation of the intermittent member. With this structure, a high-speed, accurate operation can be performed with a simple structure, and the size and position of a selector to be engaged with a spacer metallic die can be controlled.

According to the embodiment of the present invention, in addition to the multilayer spacer metallic die described above, an adjusting spacer metallic die can project between the first and second divided metallic dies having variable gaps therebetween. Therefore, the gap between the divided metallic dies and the spacer metallic die is decreased regardless of the gap between the divided metallic dies. Hence, the third and fourth portions can be accurately bent, and a displacement, strain, or deformation of the divided metallic die itself will not be caused by the pressing force, thus achieving high-precision bending.

Furthermore, according to the embodiment of the present invention, the end portion of the fourth surface can be accurately bent by the auxiliary metallic dies.

According to the embodiment of the present invention, the lower position of the upper metallic die with respect to the lower metallic die is measured by the detector, and the bending size of the bent surface is measured by the measurement mechanism. The upper metallic die is movable and can be pivoted by the lower guide mechanisms. The control unit can freely change the angle or position of the metallic die during the pressing operation by the metallic die ① on the basis of the control command corresponding to the content of predetermined bending, or ② to correspond to the lower position. As a result, pressing of the work can be freely performed.

Furthermore, the control unit can perform determination by combining three pieces of data, i.e., ① a control command, ② a lower position, and ③ a bending size. Since the angle and position of the metallic die can be optimally arbitrarily set, pressing can be performed under more optimum conditions to increase the degree of freedom of pressing, thereby enabling higher-precision pressing.

The effects described above will be summarized. When metal sheet products having various sizes, shapes, and materials are to be formed, the most characteristic feature of the metallic die device of the embodiment of the present invention is high-precision pressing.

This is due to the following reasons. That is, in addition to the basic structure wherein the two opposing surfaces can be simultaneously bent, positional displacement, distortion, or deformation of the metallic die does not occur according to the embodiment of the present invention. Also, due to the embodiment of the present invention, the optimum bending conditions can be set in the metallic die in units of work targets, and the bent portion can be measured and correction bending can be performed.

As a result, the metallic die device according to the present invention can cope even with the manufacture of a product of an advanced technology having a light-weight and a high density.

The second characteristic feature of the embodiment is free pressing.

This is because the bending metallic die can automatically cope with different products, ranging from small to large products, based on commands without exchanging the metallic die in accordance with the size or surface of the work target, and because the angle or shape of bending can be changed only by a command. This is put into practice in accordance with the embodiment of the present invention based on the pivotal movement of the metallic die.

The third characteristic feature of the embodiment is the pressing speed.

According to the embodiment of the present invention, any pressing can be automatically performed without exchanging a metallic die that performs bending, as described above. Therefore, exchange/adjustment time is not necessary, and the position and angle of the metallic die can be freely, automatically changed in accordance with the size, angle, material, and thickness of the work target according to the embodiment aspect of the present invention.

Furthermore, according to the embodiment of the present invention, three surfaces of a work can be simultaneously bent. When a plurality of identical products are to be pressed, the first, second, and third bending operations are performed, and thereafter the product is sent to a position for performing the fourth bending operation. A subsequent product is set at a position for performing the first, second and third bending operations, and the first, second, and third bending operations can be simultaneously performed by a single downward movement of the slider. Therefore, even when a box is to be formed by bending its four surfaces, it can be completed with a number of operations exceeding the number of products by one. According to the embodiment of the present invention, when compared to a conventional machine that bends each side of a sheet separately with the number of operations that is four times that of the number of products, pressing can be performed with a greatly decreased number of operations, and the productivity is remarkably increased.

The fourth characteristic feature of the embodiment is automated operation.

Exchange of the metallic die is not needed, the multilayer spacer metallic dies are automatically inserted, and the metallic die can be adjusted only by a command from the control unit to correspond to the size, angle, material, and the thickness of the work target. Therefore, pressing can be performed without requiring a manual operation at all. If a robot or the like is used for conveyance of the work, full-automated pressing can be performed.

As a result, the automated operation can be performed even for fabricating different products, thus enabling an automated line (FMS) combined with a turret punch press or a laser processing machine.

The fifth characteristic feature of the embodiment is a decrease in manufacturing cost.

Since all pressing can be performed with only a standard metallic die provided to the press machine, and simultaneous bending of three or four surfaces can be performed, the running cost of the machine is decreased. In addition, since high-speed pressing can be performed, the manufacturing cost is greatly decreased when compared to the conventional press machine.

A first modified main part of the metallic die device for a press machine according to the present invention will be described.

Figure 26:
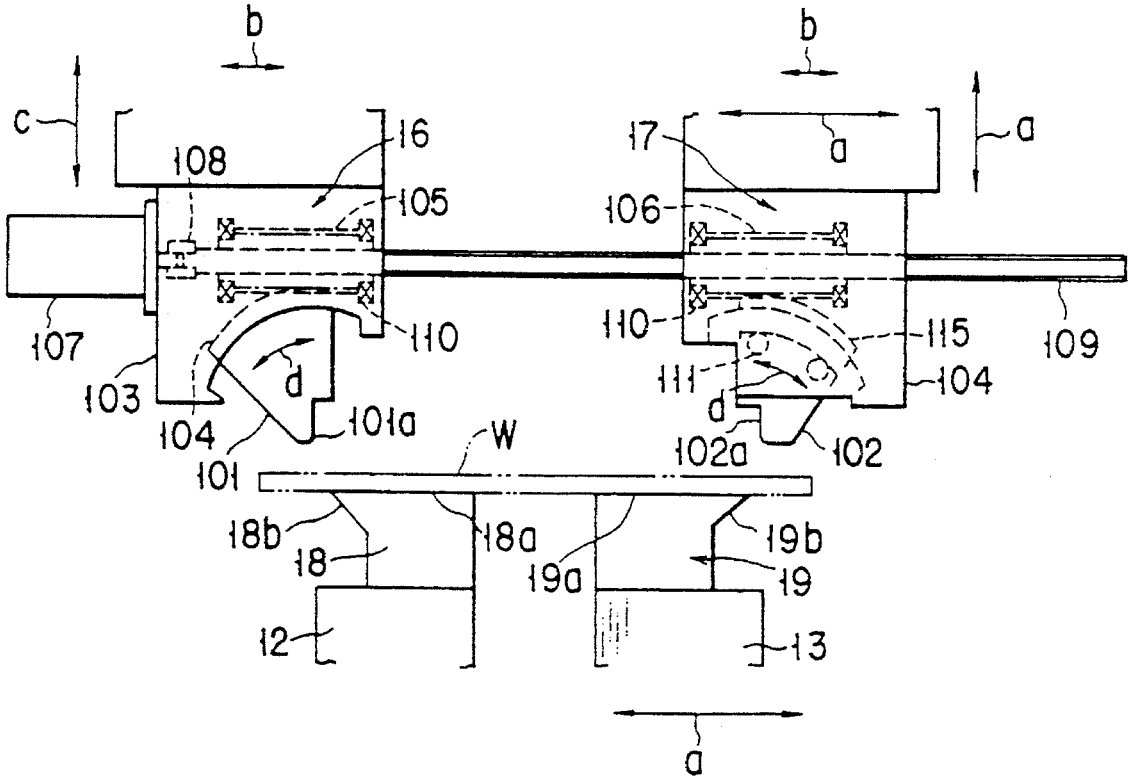
FIG. 26 is an enlarged side view showing a metallic die device as a first modified main part of the present invention.

The upper metallic die mechanisms 16 and 17 are symmetrically provided as shown in the enlarged side view of FIG. 26.

The upper metallic die mechanisms 16 and 17 are respectively constituted by fixing upper metallic die bases 103 and 104 to the lower portions of the stationary and movable punch plates 10 and 11. Arcs having predetermined diameters are formed in the lower surfaces of the upper metallic die bases 103 and 104. The pivotal upper metallic dies 101 and 102 having arcs of diameters to correspond to the diameters of the corresponding arcs are provided on the lower surfaces of the upper metallic die bases 103 and 104, respectively, to be pivotal through predetermined angles. Cam followers 111 are provided along the arcs of the pivotal upper metallic dies 101 and 102 to support the pivotal upper metallic dies 101 and 102, respectively.

The pivotal upper metallic dies 101 and 102 have predetermined steps and linear edge portions 101*a* and 102*a*, respectively. The lower end portions of the edge portions 101*a* and 102*a* serve as the pivot centers of the pivotal upper metallic dies 101 and 102, respectively.

Worm gears 105 and 106 are rotatably provided to the upper metallic die bases 103 and 104 through bearings 110, respectively. One worm gear 105 is fixed to a spline shaft 109, and the other worm gear 106 is slidably fitted in the groove of the spline shaft 109.

Furthermore, the gear surfaces formed on the outer surfaces of the worm gears 105 and 106 are meshed with worm wheels 114 and 115 formed on the arcuated portions of the pivotal upper metallic dies 101 and 102, respectively. The worms on the worm gears 105 and 106 are formed in opposite directions.

A servo motor 107 serving as the third driving source is fixed to a side portion of one upper metallic die bases 103, and the rotating shaft of the servo motor 107 is coupled to the spline shaft 109 through a coupler 108. Accordingly, when the servo motor 107 is driven, the pivotal upper metallic dies 101 and 102 are rotated in a symmetrical manner.

As shown in FIG. 26, the lower metallic dies 18 and 19 are formed to be symmetrical to each other, and respectively have horizontal surfaces 18*a* and 19*a* on which the work W is to be placed and inclined surfaces 18*b* and 19*b* inwardly inclined at predetermined angles with respect to the horizontal surfaces 18*a* and 19*a*. The inclined surfaces 18*b* and 19*b* are formed for the purpose of escape corresponding to the pivot angles of the pivotal upper metallic dies 101 and 102.

Figure 27A:
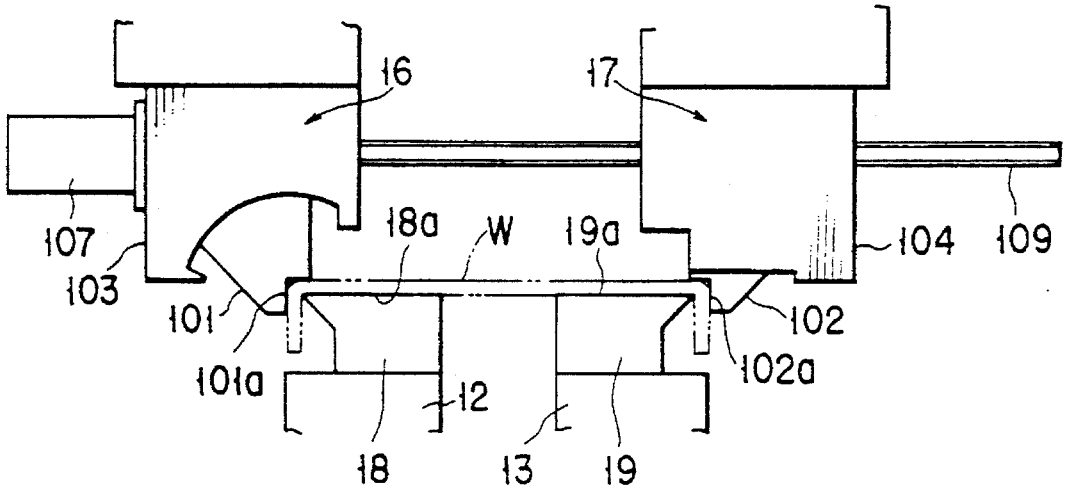
FIGS. 27A and 27B are views showing the operation of the metallic die device.

A case wherein the two sides of the work W are to be bent at a right angle will be described. The control unit 63 outputs a signal for moving the press slider 2 downward. When the hydraulic cylinder 4 is driven to move the plunger 4A downward, the press slider 2 is moved downward through the pin 6, and the upper metallic die mechanisms 16 and 17 are brought into contact with the work W. Thereafter, the press slider 2 is moved further downward (in a direction indicated by a double-headed arrow c in FIG. 26), and the two sides of the work W are simultaneously bent at the right angle, as shown in FIG. 27A.

At this time, as the press slider 2 is moved downward, a bevel gear 35 of the press slider 2 is moved downward as it slides in the groove of the spline shaft 22.

When the work W is subjected to predetermined bending, the press slider 2 reaches the lower dead point and then starts to move upward, and is stopped at the uppermost position as the upper dead point.

Thereafter, the bending angles of the work W are measured by the measurement unit 65. The third controller 63*c* can perform control such that it repeats bending and angle measurement until the preset bending angle is obtained, thereby bending thee work W at the target angle.

A case wherein the two sides of the work W are to be bent at angles other than the right angle will be described.

In this case, as shown in FIG. 27A, the hydraulic cylinder 4 is driven by a signal output from the control unit 63 for moving the press slider 2 downward. The press slider 2 is moved downward to bend the two sides of the work W, and is returned to the upper dead point.

Figure 27B:
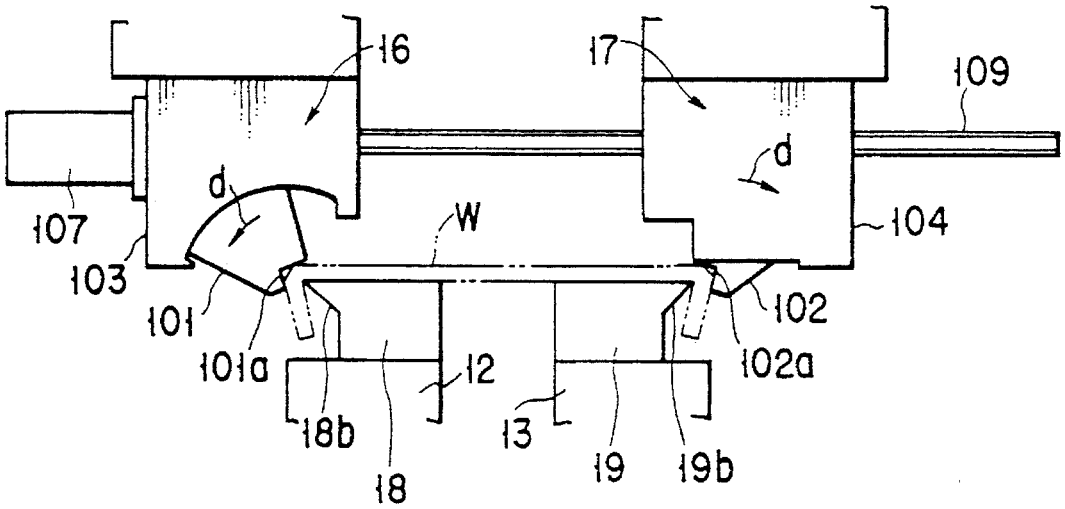

Then, as shown in FIG. 27B, the third controller 63*c* of the control unit 63 drives the servo motor 107 in accordance with the lower position detected by the scale detector 172, to rotate the pivotal upper metallic dies 101 and 102 of the upper metallic die mechanisms 16 and 17, respectively, through the spline shaft 109 (in directions of arrows d in FIG. 27B).

As a result, the edge portions 101*a* and 102*a* of the pivotal upper metallic dies 101 and 102 advance inward to inwardly bend the two sides of the work W simultaneously. The maximum bending angles of the two sides of the work W are set at the inclination angles of the inclined surfaces 18*b* and 19*b*.

Thereafter, the servo motor 109 is controlled in the reverse direction, the edge portions 101*a* and 101*b* are set in the vertical state, and the press slider 2 is moved upward to return to the uppermost position as the upper dead point.

Thereafter, the bending angles of the work W are measured by the measurement unit 65. The third controller 63*c* can control bending until the preset bending angles are obtained.

A case will be described wherein the bending width, thickness, or material of the work W is to be changed. In this case, the servo motor 20 is driven by a positioning command signal from the first controller 63*a* of the control unit 63 to move the lower metallic die 19 and the upper metallic die mechanism 17, and the servo motor 58 is driven by a punch fine positioning command to move the upper metallic die mechanisms 16 and 17 by a small distance. Necessary adjustment is performed, and bending is performed by the same operation as described above.

If the fine adjustment screw 52*b* is removed from the screw shaft 52 and rotated by an independent servo motor 107*b*, the stationary and movable punch plates 10 and 11 can be separately moved by a small distance. In this manner, movement of the lower metallic die 19 and the upper metallic die mechanism 17 by the positioning command, which is sent from the first controller 63*a* of the control unit 63 for positioning the lower metallic die 19 and the upper metallic die mechanism 17, slight movement of the upper metallic die mechanisms 16 and 17 by the fine positioning command control, which is sent from the second controller 63b for finely positioning the upper metallic die mechanisms 16 and 17, positioning of the work W, and downward movement and upward movement of the press slider 2 are performed by a series of operations. Therefore, simultaneous bending of the two portions of the work W can be performed, the bending width of the work W can be freely automatically changed, and size correction necessary when the thickness or material is changed can be freely automatically performed.

Furthermore, the work W can be bent at an angle other than the right angle by rotation of the upper metallic die mechanisms 16 and 17 in accordance with a control command from the third controller 63*c*.

Figure 28:
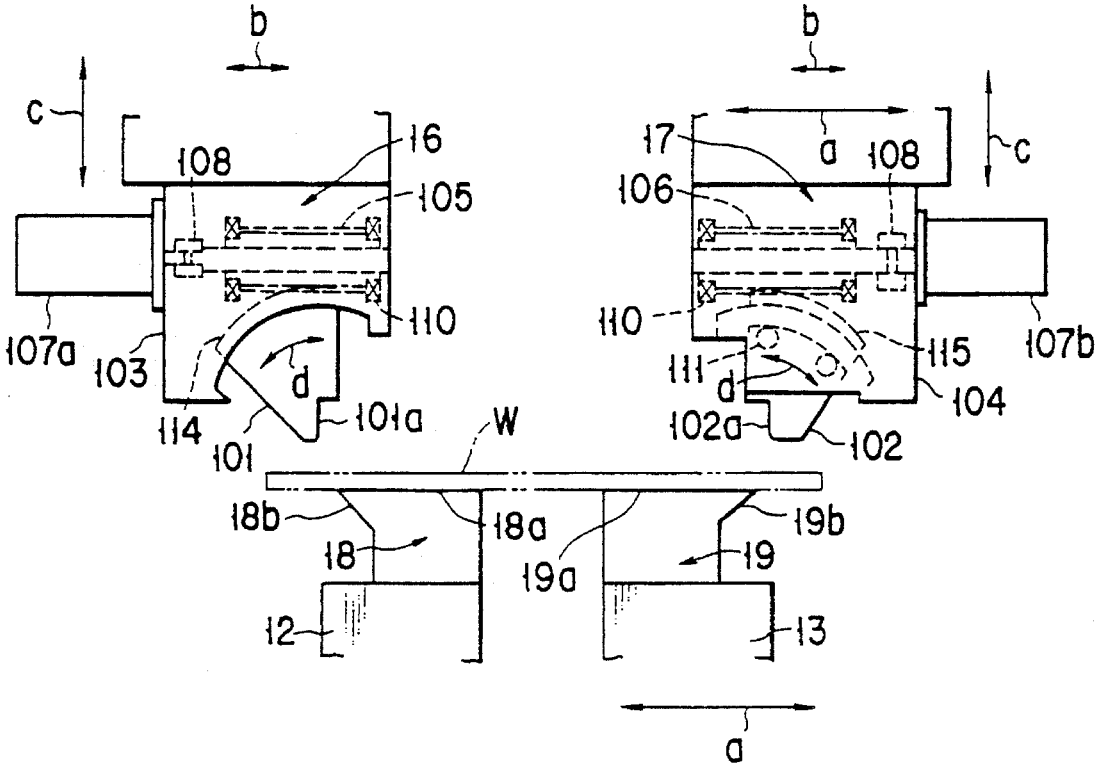
FIG. 28 is an enlarged side view showing another metallic die device.

FIG. 28 is an enlarged side view showing a modification of another modified embodiment of the present invention.

As shown in FIG. 28, separate servo motors 107*a* and 107*b* can be provided to upper metallic die mechanisms 16 and 17, respectively, and the pivotal upper metallic dies 101 and 102 can be separately rotated, while obtaining the same effect as the embodiment described above. The separate servo motors 107*a* and 107*b* can be synchronously controlled by the third controller 63*c*.

Furthermore, the spline shaft 109 need not be provided, and the portions Wa and Wb on the two sides of the work W can be bent at different angles.

Figure 29:
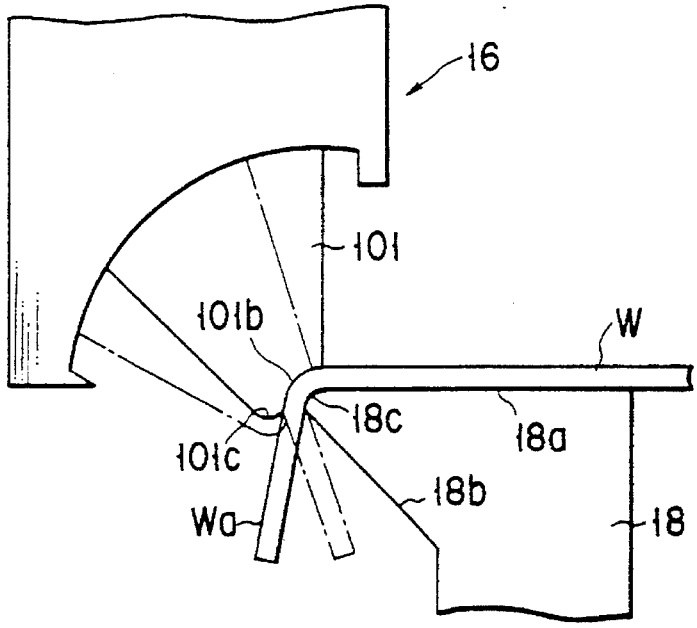
FIG. 29 is a partially enlarged side view showing still another metallic die device.

FIG. 29 is a partially enlarged side view showing another modification of the first embodiment of the present invention. Although FIG. 29 shows only one upper metallic die mechanism 16 and one lower metallic die 18, but the other upper metallic die mechanism 17 and the other lower metallic die 19 are provided to be symmetrical to the upper metallic die mechanism 16 and the lower metallic die 18, respectively.

An arcuated surface 101*b* is formed on the distal end portion of the pivotal upper metallic die 101 of the upper metallic die mechanism 16 about the pivot center. A predetermined cylindrical surface 101*c* is formed on a side portion of the arcuated surface 101*b* in the rotational direction.

A predetermined arcuated portion 18*c* is formed at the connecting portion of the horizontal and inclined surfaces 18*a* and 18*b* of the lower metallic die 18.

Hence, when the press slider 2 is moved downward, the arcuated surface 101*b* formed on the pivotal upper metallic die 101 of the upper metallic die mechanism 16 starts to bend the portion Wa of the work W.

Thereafter, the pivotal upper metallic die 101 is rotated, so that the arcuated surface 101*b* can bend the portion Wa of the work W to a predetermined angle to have a predetermined arc.

The portion Wb (not shown) of the work W is similarly bent by the other lower metallic die 18.

According to the first modified metallic die device for the press machine of the present invention, the upper metallic dies having edge portions are pivotal through a predetermined angle, and inclined surfaces are formed on the lower metallic dies. Thus, the two sides of each of flat works having various sizes, thicknesses, and materials can be simultaneously bent at desired angles in arbitrary sizes. Since high-speed pressing in which the pressing time required for bending is shortened and automatic operations are enabled, a high productivity can be obtained, and this metallic die device for the press machine has an excellent adaptability to production in small quantity with many items, so that this press machine can be easily assembled even in an automated manufacturing line.

According to the first modified embodiment of the present invention, the upper metallic die mechanisms can be independently provided, and the two sides of a work can be bent at different angles.

Furthermore, according to the first modified embodiment of the present invention, portions of a work can be bent to have predetermined arcs.

Figure 30:
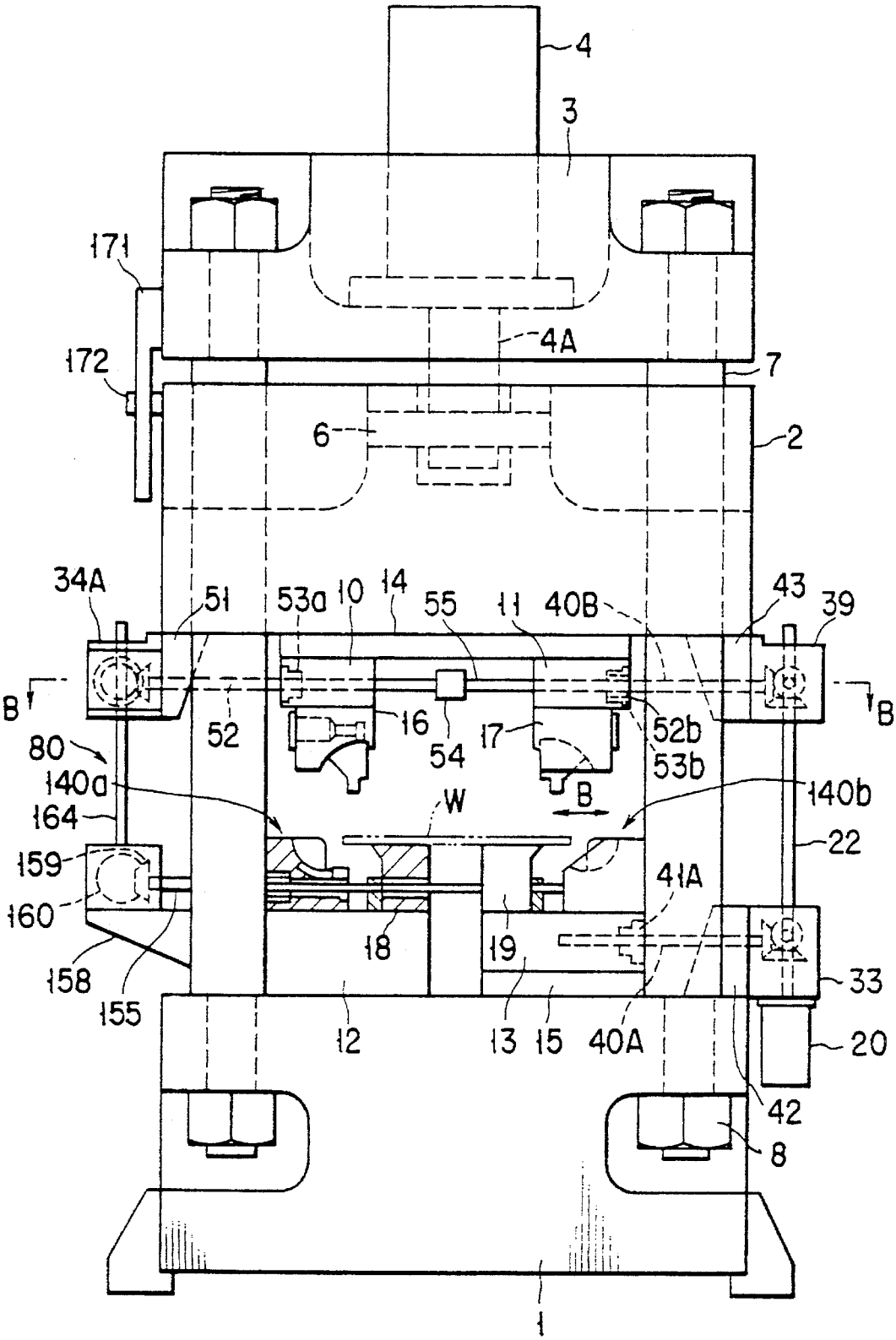
FIG. 30 is a side view showing a press machine to which the second modified embodiment of the present invention is applied.

A second modified main part of the metallic die device for a press machine according to the present invention will be described. FIG. 30 is a side view, showing the press machine to which the metallic die device according to the second modified embodiment of the present invention is provided.

Referring to FIG. 30, components which have the same arrangement and operate in the same manner as in FIGS. 1 and 2 of the first embodiment described above are denoted by the same reference numerals to omit their description. Only components different from those in the first embodiment will be described.

A lower guide mechanism 140*a* is provided on a stationary die plate 12, in addition to a lower metallic die 18 having a shape to correspond to a pivotal upper metallic die 101 of an upper metallic die mechanism 16. A lower guide mechanism 140*b* is provided on a movable die plate 13, in addition to a lower metallic die 19 having a shape to correspond to a pivotal upper metallic die 102 of an upper metallic die mechanism 17.

Figure 31:
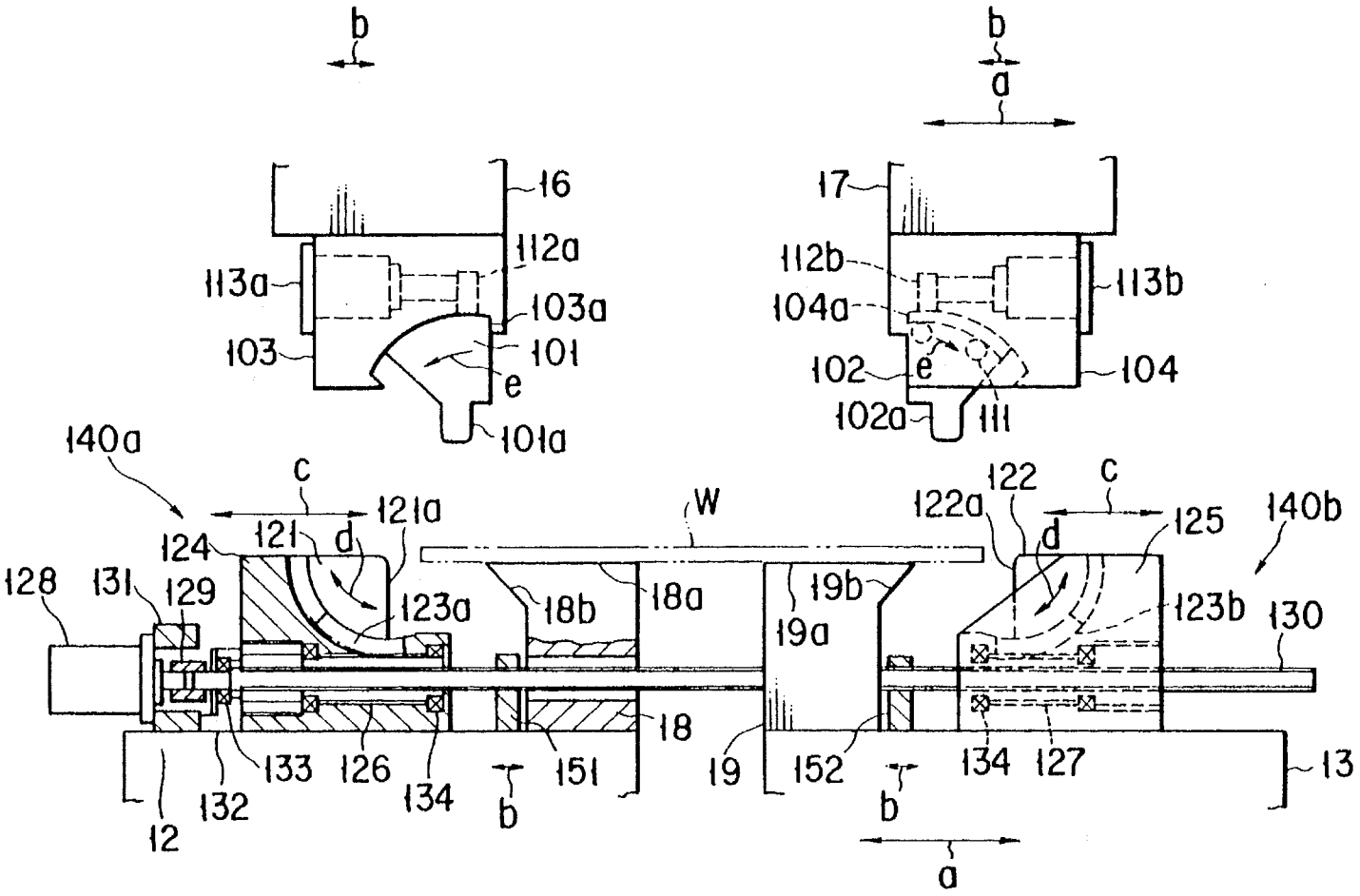
FIG. 31 is an enlarged side view showing a metallic die device as another modified main part of the present invention.

The upper metallic die mechanisms 16 and 17 are symmetrical as shown in the enlarged side view of FIG. 31.

The pivotal upper metallic dies 101 and 102 are set in the vertical state as the reference when their upper end portions are abutted against reference surfaces 103*a* and 104*a* of upper metallic die bases 103 and 104.

For this purpose, metal press plates 112*a* and 112*b* project from the upper portions of the pivotal upper metallic dies 101 and 102. The upper metallic die bases 103 and 104 are respectively provided with pushers 113*a* and 113*b* comprising cylinders and the like. The rods of the pushers 113*a* and 113*b* push the metal press plates 112*a* and 112*b* to set edge portions 101*a* and 102*a* of the pivotal upper metallic dies 101 and 102 at the vertical reference state.

The operations of the pushers 113*a* and 113*b* are controlled by a fourth controller 63*d* of a control unit 63.

When the operations of the pushers 113*a* and 113*b* are canceled, the pivotal upper metallic dies 101 and 102 are pivotal in the directions indicated by arrows e in FIG. 31. Even at this time, a predetermined biasing force acts on the pivotal upper metallic dies 101 and 102 to the vertical state.

The lower guide mechanisms 140*a* and 140*b* are respectively provided to the side portions of the lower metallic dies 18 and 19. The lower guide mechanisms 140*a* and 140*b* respectively have lower bases 124 and 125 that are guided by a lower spline shaft 130 extending between the stationary and movable die plates 12 and 13 to be slidable in a direction indicated by a double-headed arrow c in FIG. 31.

Arcuated portions are formed on the lower bases 124 and 125 toward the corresponding lower metallic dies 18 and 19, and metal backup members 121 and 122 having arcs of diameters corresponding to the diameters of the arcuated portions of the lower bases 124 and 125 are provided to the lower bases 124 and 125 to be pivotal through predetermined angles, respectively. The metal backup members 121 and 122 are provided with vertical guide surfaces 121*a* and 122*a* brought into contact with the edge portions 101*a* and 102*a* of the pivotal upper metallic dies 101 and 102, respectively. The metal backup members 121 and 122 are pivotal about the upper end portions of the corresponding guide surfaces 121*a* and 122*a* as the pivot centers. Lower worm wheels 123*a* and 123*b* are formed on the arcuated portions of the metal backup members 121 and 122, respectively.

Lower worms 126 and 127 are respectively provided to the lower bases 124 and 125 through bearings 134. The lower worms 126 and 127 are slidable in the grooves of the lower spline shaft 130 and meshed with the corresponding lower worm wheels 123*a* and 123*b*.

One end of the lower spline shaft 130 is coupled to the driving shaft of a lower servo motor 128, serving as the third driving source, through a bearing 133, a spline bracket 132, and a lower coupler 129. The lower servo motor 128 is fixed to a motor bracket 131 on the stationary die plate 12.

Hence, when the lower servo motor 128 is driven, the guide surfaces 121*a* and 122*a* of the metal backup members 121 and 122 are rotated in directions indicated by a double-headed arrow d in FIG. 31 through the lower spline shaft 130.

Metal positioning members 151 and 152 for respectively positioning the moving positions of the lower guide mechanisms 140*a* and 140*b* are provided between the lower metallic die 18 and the lower guide mechanism 140*a*, and between the lower metallic die 19 and the lower guide mechanism 140*b*.

The metal positioning members 151 and 152 are respectively provided below inclined surfaces 18*b* and 19*b* of the lower metallic dies 18 and 19, as shown in the enlarged side sectional view of FIG. 32. The metal positioning members 151 and 152 are movable by a distance corresponding to a predetermined thickness, i.e., the thickness of a work W, and are positioned to be abutted against the corresponding lower guide mechanisms 140*a* and 140*b*, thereby positioning the lower guide mechanisms 140*a* and 140*b*, respectively.

Through holes 18*d* and 19*d* are respectively formed in the lower metallic dies 18 and 19, and a screw shaft 153 extends through the through holes 18*d* and 19*d*. A right-hand screw portion 153A is formed on one end of the screw shaft 153, and a left-hand screw portion 153B is formed on the other end of the screw shaft 153.

The screw portions 153A and 153B are threadably engaged with the screw portions of the metal positioning members 151 and 152, respectively.

The screw shaft 153 is coupled to the driving source through a coupling mechanism 80. The coupling mechanism 80 is connected to a coupling shaft 155 through a stopper coupler 154. The coupling shaft 155 is axially supported in a bracket 156 through bearings 157, and a bevel gear 159 is provided to one end of the coupling shaft 155.

The bevel gear 159 is provided in a gear box 158 on a side portion of the stationary die plate 12 and coupled to a bevel gear 160 and a coupling shaft 161.

As shown in FIGS. 1, 2, and 30, the bevel gear 160 is meshed with a bevel gear 163, fixed on the end portion of a spline shaft 164, through the coupling shaft 161 axially supported by bearings 167 in a bracket 166, and a bevel gear 162.

A bevel gear 165 is provided on the upper portion of the spline shaft 164 to be slidable in the groove of the spline shaft 164. The bevel gear 165 is meshed with a bevel gear 168 fixed to a driving shaft 56, and coupled to a servo motor 58.

Figure 32:
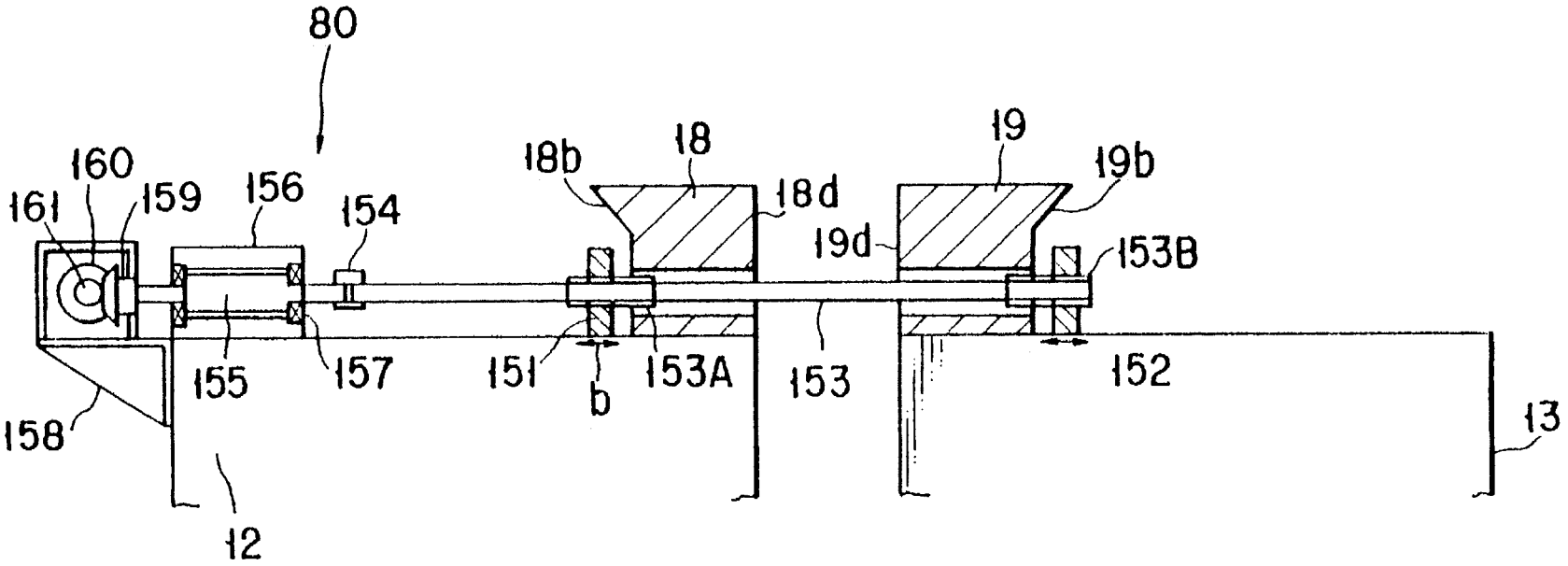
FIG. 32 is an enlarged side sectional view showing modified metal positioning members.

Thus, when the servo motor 58 is driven, stationary and movable punch plates 10 and 11 are slightly moved, and the metal positioning members 151 and 152 are slightly moved in a direction of a double-headed arrow b in FIG. 32, thereby positioning the metal positioning members 151 and 152.

The screw shaft 153 can be separated at the screw portions 153A and 153B and driven by separate driving sources.

Figure 34:
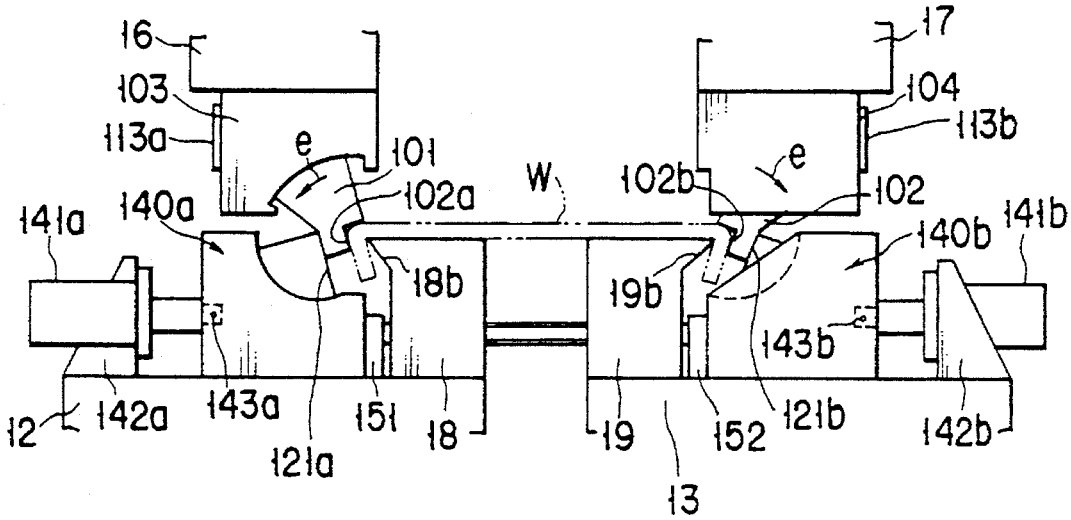

The lower guide mechanisms 140*a* and 140*b* are respectively biased toward the metal positioning members 151 and 152 by cylinders 141*a* and 141*b* serving as the power supplies shown in FIG. 34.

The cylinders 141*a* and 141*b* are respectively fixed to brackets 142*a* and 142*b* fixed to the stationary and movable die plates 12 and 13. The end portions of the rods of the cylinders 141*a* and 141*b* are respectively fixed to the lower guide mechanisms 140*a* and 140*b* through connection pins 143*a* and 143*b*.

Therefore, when the cylinders 141*a* and 141*b* are actuated, their rods project, and the lower guide mechanisms 140*a* and 140*b* hold the state to abut against the corresponding metal positioning members 151 and 152, thereby positioning the guide surfaces 121*a* and 122*a*.

As shown in the partially cutaway enlarged side view of FIG. 14, measurement mechanisms 180*a* and 180*b* for measuring angles and having the same structures as those of FIG. 30 are symmetrically provided to the side portions of the lower metallic dies 18 and 19.

The operation of the metallic die device having the above arrangement will be described.

The lower metallic die 19 and the upper metallic die mechanism 17 on the side of the movable die plate 13 are to be positioned. When a positioning command is input to the servo motor 20 from the first controller 63*a* of the control unit 63, the servo motor 20 is rotated to rotate a spline shaft 22.

Then, screw shafts 40A and 40B are rotated through the corresponding bevel gears to simultaneously move the lower metallic die 19 on the movable die plate 13 and the upper metallic die mechanism 17 on the movable punch plate 11, respectively, by the same distance (a distance indicated by a double-headed arrow a in FIG. 31).

When the lower metallic die 19 and the upper metallic die mechanism 17 reach desired positions, the servo motor 20 is stopped to stop the lower metallic die 19 and the upper metallic die mechanism 17, thereby positioning the lower metallic die 19 and the upper metallic die mechanism 17 at the desired positions.

When a command value for punch fine adjustment positioning is input to the servo motor 58 for moving the punches by a small distance from the second controller 63*b* of the control unit 63, the servo motor 58 starts rotation to rotate a driving shaft 56 for punch fine adjustment, and a screw shaft 52 is rotated through the corresponding bevel gear.

Upon rotation of the screw shaft 52, a fine adjustment nut 53*a* threadably engaged with the screw shaft 52 is moved in the right-and-left direction, and the stationary punch plate 10 is moved as it is guided along upper guide rails 14. Meanwhile, upon rotation of the screw shaft 52, a spline shaft 55 is rotated through a coupler 54, thereby rotating a fine adjustment screw 52*b* fitted with the spline shaft 55.

Upon rotation of the fine adjustment screw 52*b* and movement of a fine adjustment nut 53*b* engaged with the fine adjustment screw 52*b*, the movable punch plate 11 is further moved, from the position where it is positioned by the metallic die positioning servo motor 20, by a small distance (a distance indicated by a double-headed arrow b in FIG. 31).

In this manner, the upper metallic die mechanisms 16 and 17 can be automatically positioned at positions slightly moved toward the lower metallic dies 18 and 19, respectively. Then, the work W is conveyed and positioned at a position to correspond to the respective lower metallic dies 18 and 19, and the respective upper metallic die mechanisms 16 and 17.

Simultaneously, rotation of the servo motor 58 slightly, similarly moves the metal positioning members 151 and 152 in the directions indicated by the double-headed arrow b in FIG. 31 through the coupling mechanism 80. The metal positioning members 151 and 152 are moved in the opposite directions.

As a result, the positions of the lower guide mechanisms 140*a* and 140*b* after being moved toward the corresponding lower metallic dies 18 and 19 (to be described later) can be preset in advance.

A case wherein the two sides of the work W are to be bent at a right angle will be described. The control unit 63 outputs a signal for moving the press slider 2 downward. When the hydraulic cylinder 4 is driven to move a plunger 4A downward, the press slider 2 is moved downward through a pin 6, and the upper metallic die mechanisms 16 and 17 are brought into contact with the work W. Thereafter, the press slider 2 is moved further downward, and the two sides of the work W are simultaneously bent at the right angle, as shown in FIG. 33A, by the edge portions 101*a* and 101*b* of the pivotal upper metallic dies 101 and 102.

At this time, as the press slider 2 is moved downward, a bevel gear 35 of the press slider 2 is moved downward as it slides in the groove of the spline shaft 22.

When the work W is subjected to predetermined bending, the press slider 2 reaches the lower dead point and then starts to move upward, and is stopped at the uppermost position as the upper dead point.

Thereafter, the third controller 63*c* can perform control to repeat bending and angle measurement, by measuring the bending angles of the work W by the measurement unit 65, correcting the angle of the lower servo motor 128, and bringing the lower guide mechanisms 140*a* and 140*b* into contact with the corresponding metal positioning members 151 and 152, until the preset bending angle is obtained, thereby bending the work W at the target angle.

A case wherein the two sides of the work W are to be bent at angles other than the right angle will be described.

Figure 33:
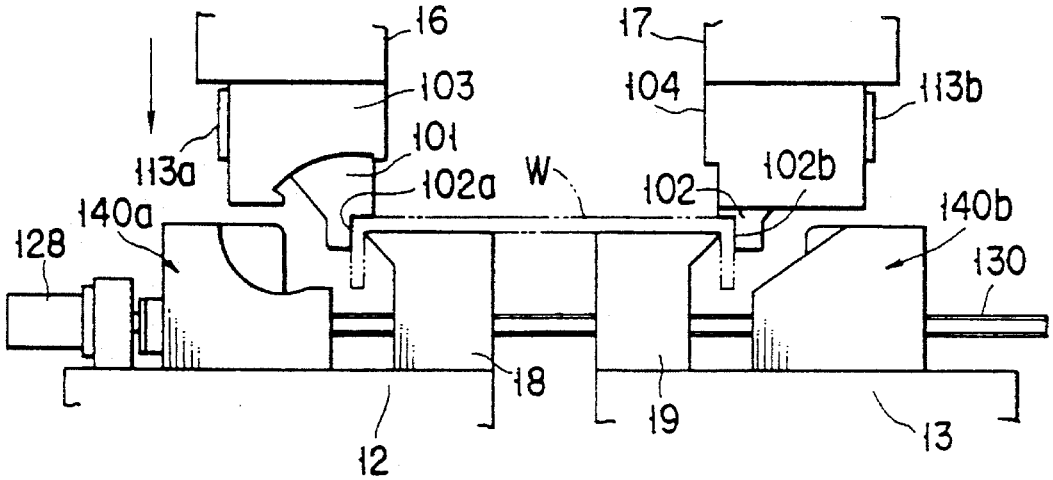
FIGS. 33 and 34 are views showing the operation of the modified metallic die device.

In this case, as shown in FIG. 33, the hydraulic cylinder 4 is driven by a signal output from the control unit 63 for moving the press slider 2 downward. The press slider 2 is moved downward to bend the two sides of the work W.

Then, as shown in FIG. 34, the fourth controller 63*d* of the control unit 63 actuates the cylinders 141*a* and 141*b* to bring the lower guide mechanisms 140*a* and 140*b* into contact with the corresponding metal positioning members 151 and 152. Simultaneously, the fourth controller 63*d* controls the forces of the pushers 113*a* and 113*b*, and the pivotal upper metallic dies 101 and 102 are pivotal at a force equal to or exceeding a predetermined force. In this state, the guide surfaces 121*a* and 122*a* of the metal backup members 121 and 122 are set in the vertical state, and the edge portions 101*a* and 102*a* are vertically moved downward.

Thereafter, the third controller 63*c* drives the lower servo motor 128 to rotate the metal backup members 121 and 122 of the lower guide mechanisms 140*a* and 140*b*, respectively, through the lower spline shaft 130. Upon rotation of the lower guide mechanisms 140*a* and 140*b*, the edge portions 101*a* and 102*a* of the pivotal upper metallic dies 101 and 102 are pivoted in directions indicated by arrows e, respectively, in FIG. 34.

As a result, the edge portions 101*a* and 102*a* of the pivotal upper metallic dies 101 and 102 advance inward to inwardly bend the two sides of the work W simultaneously. The maximum bending angles of the two sides of the work W are set at the inclination angles of the inclined surfaces 18*b* and 19*b*.

The control unit 63 can also perform control so as to operate the third and fourth controllers 63*c* and 63*d* to be parallel to each other, thereby setting the rotational angles of the metal backup members 121 and 122 caused by rotation of the lower servo motor 128 in accordance with the lower position of the press slider 2 detected by the scale detector 172.

Thereafter, the lower servo motor 128 is driven in the reverse direction, the edge portions 101*a* and 101*b* are set in the vertical state, and the press slider 2 is moved upward to return to the uppermost position as the upper dead point.

Thereafter, the bending angles of the work W are measured by the measurement unit 65. The third controller 63*c* can correct control of the lower servo motor 128 by using the values of the measured bending angles of the work W so as to control bending until the preset bending angles are obtained.

In contrast to the above process, it is also possible to set the angles of the backup heels so that the work W will be bent at desired angles.

A case will be described wherein the bending width, thickness, or material of the work W is to be changed. In this case, the servo motor 20 is driven by a positioning command signal from the first controller 63*a* of the control unit 63 to move the lower metallic die 19 and the upper metallic die mechanism 17, and the servo motor 58 is driven by a punch fine positioning command to move the upper metallic die mechanisms 16 and 17 by a small distance. Also, the metal positioning members 151 and 152 are positioned, and bending is performed by the same operation as described above.

In this manner, in the control unit 63, movement of the lower metallic die 19 and the upper metallic die mechanisms 16 and 17 by the positioning command, which is sent from the first controller 63*a* for positioning the lower metallic die 19 and the upper metallic die mechanisms 16 and 17, slight movement of the upper metallic die mechanisms 16 and 17 and positioning of the metal positioning members 151 and 152 by the fine positioning command control, which is sent from the second controller 63*b* for finely positioning the upper metallic die mechanisms 16 and 17, and downward movement and upward movement of the press slider 2 and control of the pushers 113*a* and 113*b*, and control of the lower guide mechanisms 140*a* and 140*b* by the fourth controller 63*d* are performed by a series of operations. Therefore, simultaneous bending of the two portions of the work W can be performed, the bending width of the work W can be freely automatically changed, and size correction necessary when the thickness or material is changed can be freely automatically performed.

Furthermore, the work W can be bent at an angle other than the right angle by rotation of the lower guide mechanisms 140*a* and 140*b* in accordance with a control command from the third controller 63*c*.

Figure 35:
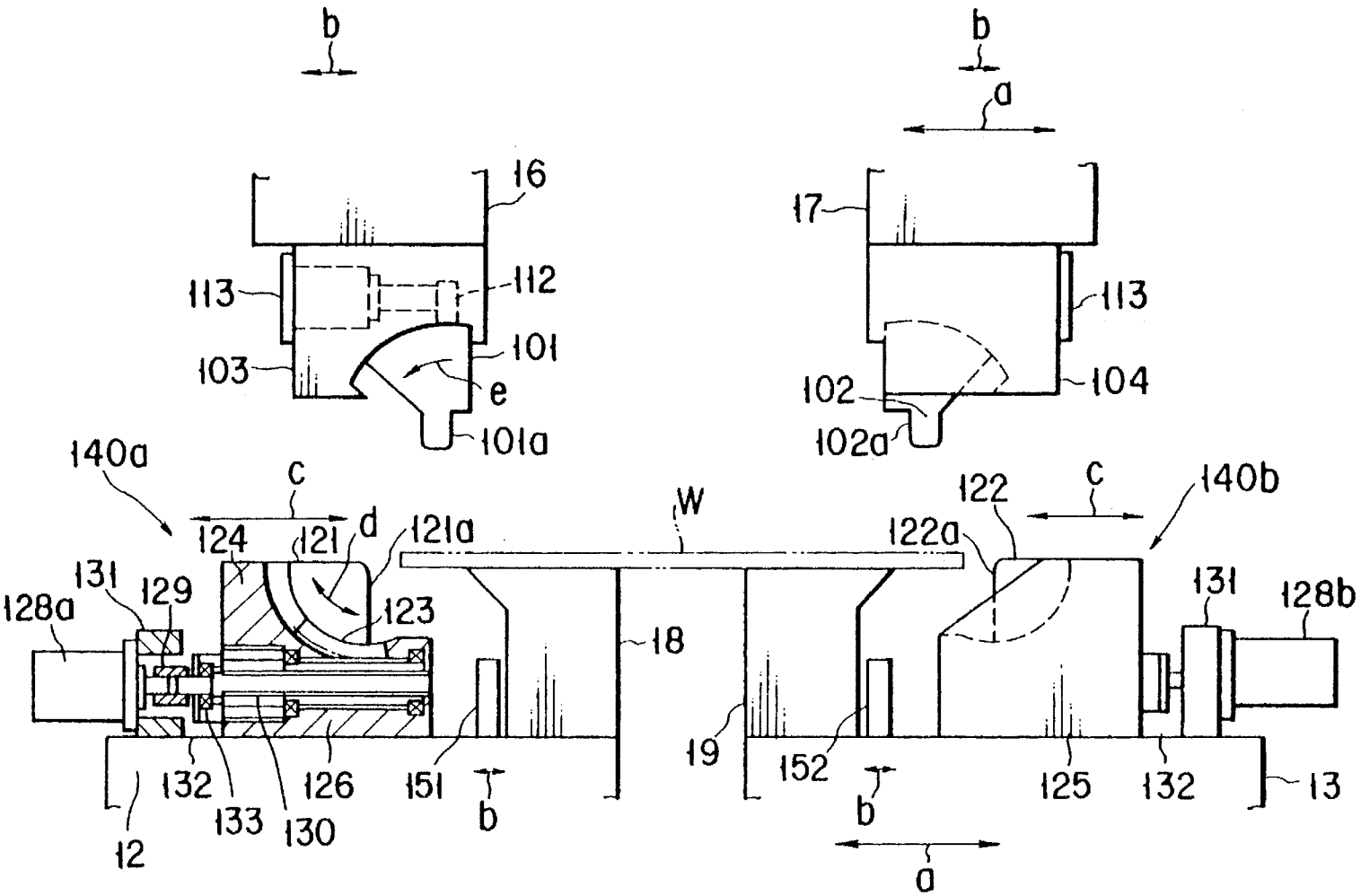
FIG. 35 is an enlarged side view showing another metallic die device.

FIG. 35 is an enlarged side view showing a modification of the second embodiment of the present invention.

As shown in FIG. 35, separate servo motors 128*a* and 128*b* can be provided to the lower guide mechanisms 140*a* and 140*b*, respectively, and edge portions 101*a* and 102*a* of the pivotal upper metallic dies 101 and 102 can be separately guided, while obtaining the same effect as the embodiment described above.

Furthermore, in this case, the spline shaft 130 need not be provided, and the portions Wa and Wb on the two sides of the work W can be bent at different angles.

The separate lower servo motors 128*a* and 128*b* can be synchronously controlled by the third controller 63*c*.

According to the metallic die device for the press machine of the second modified embodiment of the present invention, the upper metallic dies having edge portions are rotatable at predetermined angles along the guide surfaces of the lower guide mechanisms provided to the side portions of the lower metallic dies, and inclined surfaces are formed on the lower metallic dies. Thus, the two sides of each of flat works having various sizes, thicknesses, and materials can be simultaneously bent at desired angles equal to or exceeding the right angle. Since high-speed pressing in which the pressing time required for bending is shortened and automatic operations are enabled, high productivity can be obtained, and this metallic die device for the press machine has an excellent adaptability production in small quantity with many items, so that this press machine can be easily assembled even in an automated manufacturing line.

According to the second modified embodiment of the present invention, positioning of the lower guide mechanisms is not directly performed at all, but is performed through the metal positioning members. Therefore, positioning of the lower guide mechanisms by repeated operations for the same work to be bent can be easily performed at high repeating precision, thus shortening the pressing time.

Furthermore, during the bending operation, since the angles of the upper metallic dies can be largely changed during the short movement of the upper metallic dies, the angle can be changed to an acute angle. Since the lower guide mechanisms are provided to the same bases as those on which the lower metallic dies are mounted, escape or deformation of the upper metallic dies does not occur, and the work can be bent at an accurate angle.

According to the second modified embodiment of the present invention, the lower positions of the upper metallic dies are detected by the scale detector and the rotational angles of the upper metallic die mechanisms are controlled by the control unit. Therefore, arbitrariness of the bending angle of a work is further enhanced, and a wider choice of a work target is enabled.

According to the second modified embodiment of the present invention, since arbitrariness of the bending angle and arbitrariness of the shape described above are enhanced, limitations on the bent target items are minimized.

According to the second modified embodiment of the present invention, the bent state of a work can be confirmed by the measurement mechanism. Therefore, precision of correction of the angle of the flat surface of an upper metallic die and the bending angle for repressing in accordance with the measurement value can be further increased.

According to the second modified embodiment of the present invention, since detection precision of the measurement mechanism is stabilized and increased, precision of the bending angle can be further increased.

According to the second modified embodiment of the present invention, the lower metallic die mechanisms can be independently provided, and the two sides of a work can be bent at different angles.

Figure 36:
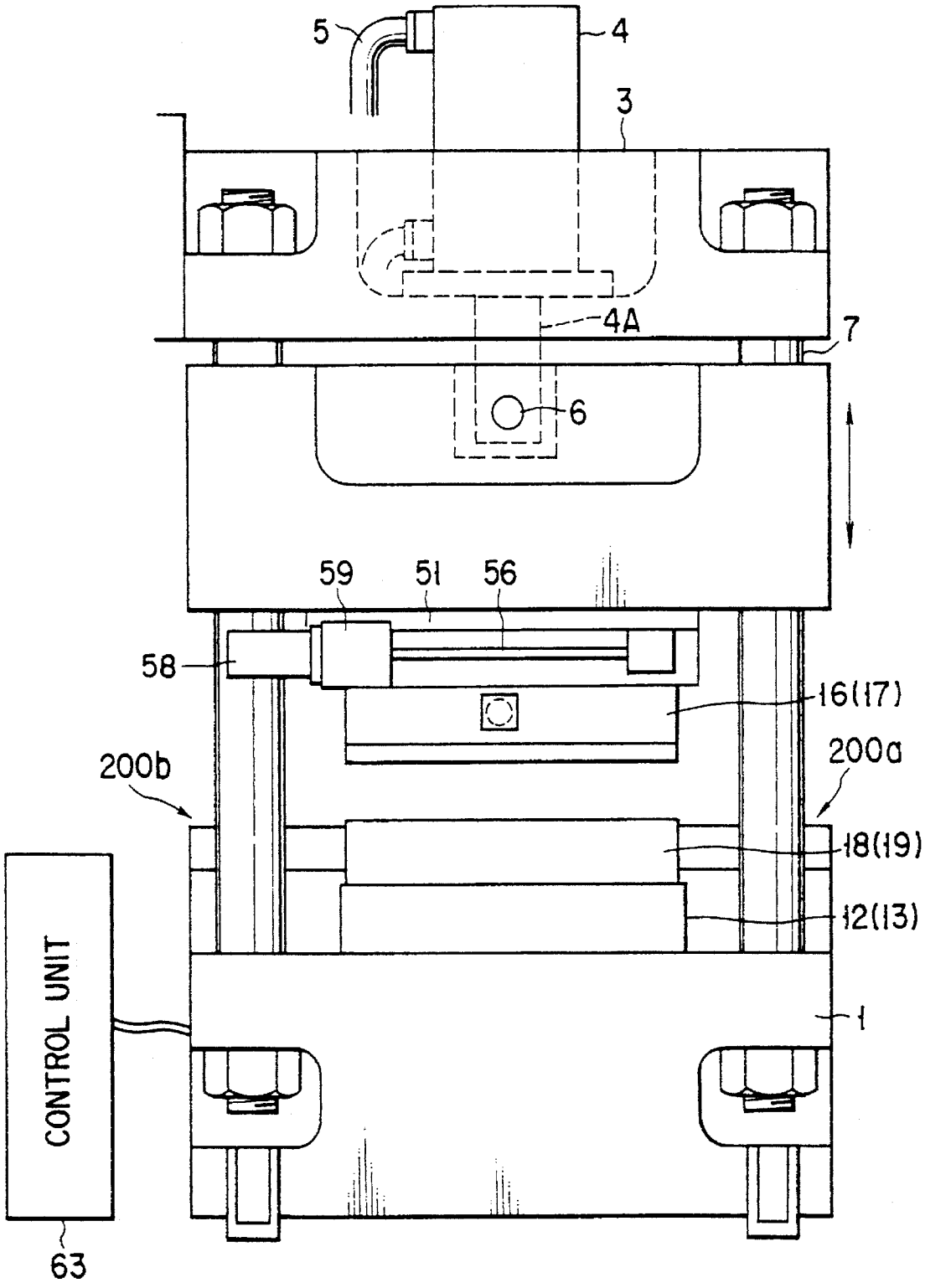
FIG. 36 is a front view showing a press machine to which the third modified embodiment of the present invention is applied.
Figure 37:
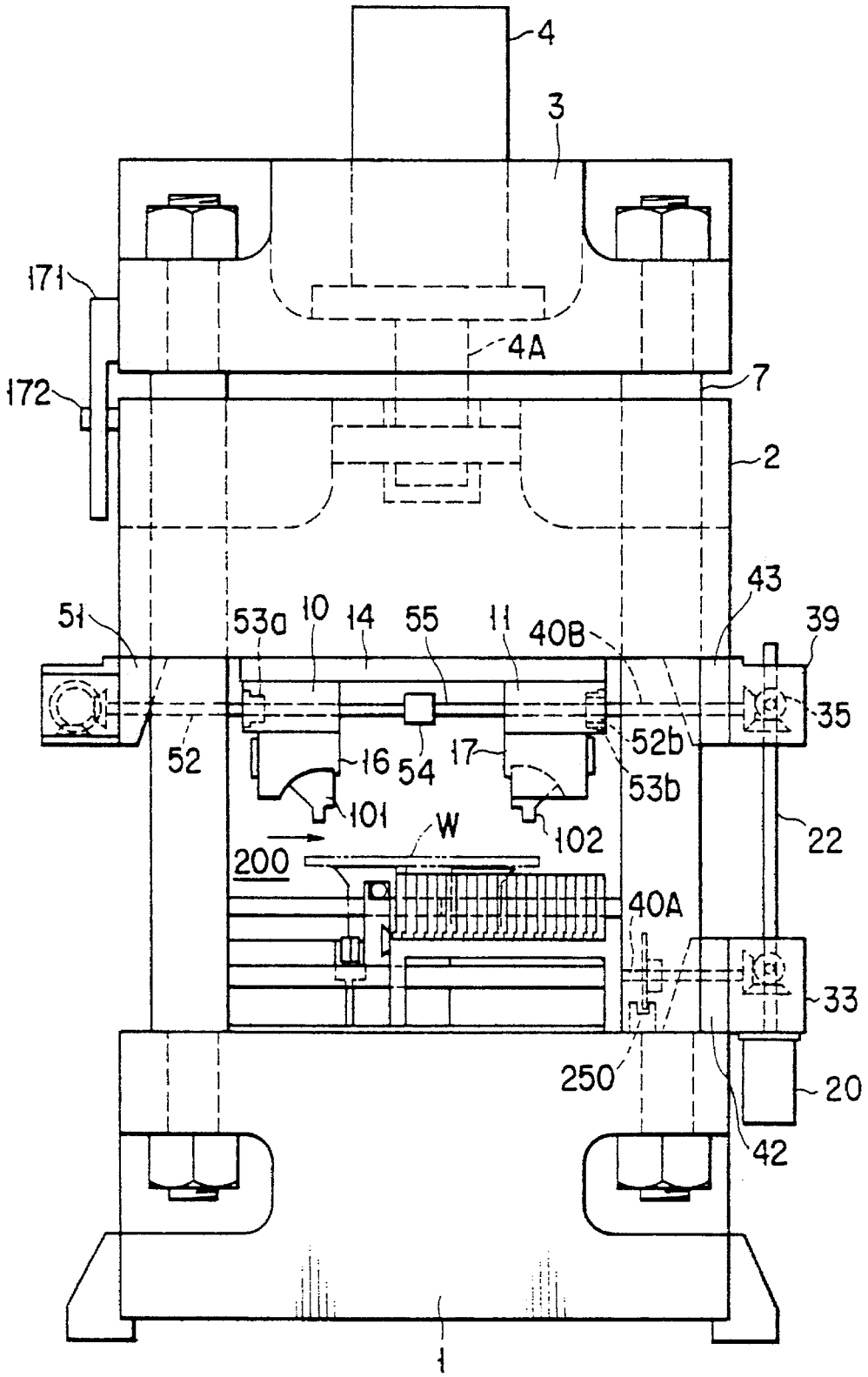
FIG. 37 is a side view of the press machine of FIG. 36.

A third modified main part of the metallic die device for a press machine according to the present invention will be described. FIGS. 36 and 37 are front and side views, respectively, showing the press machine to which the metallic die device according to the third modified embodiment of the present invention is provided.

Referring to FIGS. 36 and 37, components which have the same arrangement and operate in the same manner as in FIGS. 1 and 2 of the first embodiment described above are denoted by the same reference numerals to omit their description. Only components different from those in first embodiment will be described.

Rotation of one screw shaft 40A is detected by a rotary detector 250 and informed to a control unit 63. A fifth controller 63e of the control unit 63 performs control to be described below in order to actuate a direct-acting supply 209 in accordance with the number of multilayer spacers interposed between movable and stationary lower metallic dies 18 and 19.

A movable punch plate 11 and a movable die plate 13 can be moved simultaneously by drive of a metallic die positioning servo motor 20 serving as the first power supply.

Upper metallic die mechanisms 16 and 17 have pivotal upper metallic dies 101 and 102, respectively. Hence, the driving sources are provided to the upper metallic die mechanisms 16 and 17. Guide mechanisms serving as the driving sources may be provided to the side portions of the lower metallic dies 18 and 19 to guide the pivotal upper metallic dies 101 and 102.

Figure 39:
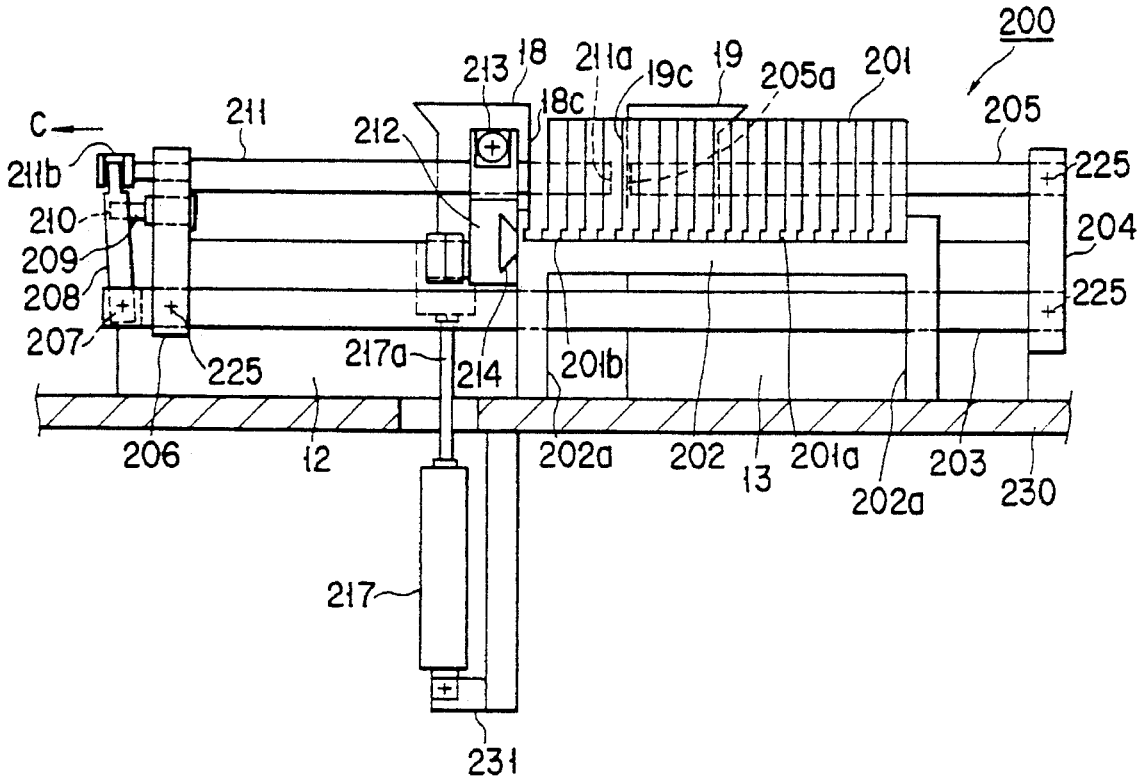
FIG. 39 is a side view of the spacer mechanism of FIG.

FIG. 38 is an enlarged plan view showing a spacer mechanism 200; FIG. 39 is a side view of the same; and FIG. 42 is a view seen along the line B—B of FIG. 38. In FIG. 38, the halves of the lower metallic dies 18 and 19 are omitted. Separate spacer mechanisms 200, i.e., spacer mechanisms 200*a* and 200*b* are symmetrically provided to the side portions of the lower metallic dies 18 and 19, as shown in FIG. 36, for inserting a spacer 201' between the lower metallic dies 18 and 19.

Each spacer mechanism 200 will be described with reference to FIG. 38. The spacer mechanism 200 is provided to the side portions of a stationary die plate 12 and the movable die plate 13, i.e., to the side portion of the press machine shown in FIG. 37.

A metal coupling member 204 projects from the side portion of the movable die plate 13, and a support shaft 205 is fixed at the upper end of the metal coupling member 204, by a fixing pin 225, to be parallel to the moving direction of the movable die plate 13. An end portion 205*a* of the support shaft 205 extends to a position on the same plane as that of an inner end face 19*c* of the lower metallic die 19.

An interlocking main shaft 203, extending to the position of the end portion of the stationary die plate 12 to be parallel to the support shaft 205, is fixed at the lower end of the metal coupling member 204 by a fixing pin 225.

A joint 206 is fixed by a fixing pin 225 to extend on an end portion of the interlocking main shaft 203, to stand vertically, and a selecting shaft 211 is slidably provided to the upper end of the joint 206 to be coaxial with the support shaft 205. One end portion 211*a* of the selecting shaft 211 is separated from the end portion 205*a* of the support shaft 205 by a distance corresponding to the thickness of one multilayer spacer 201.

A fitting portion 211*b* is formed on the side surface of the other end portion of the selecting shaft 211. A shaft 207 is provided to the end portion of the interlocking main shaft 203, and a step feed rod 208 to be engaged with a fitting portion 211*b* of the selecting shaft 211 is pivotally provided to the shaft 207. The actuator piece of the cylinder 209 serving as the direct-acting supply provided to the joint 206 is coupled to the step feed rod 208. Upon operation of the cylinder 209, the selecting shaft 211 can be slid in the axial direction by a distance corresponding to one multilayer spacer 201.

In FIG. 39, the cylinder 209 is not operated. When the cylinder 209 is not operated, the one end portion 211*a* of the selecting shaft 211 is separated from the end portion 205*a* of the support shaft 205 by a distance corresponding to about one multilayer spacer 201 (to be described later).

One end portion of a spacer base 202 is fixed at the side portion of the stationary die plate 12. The interlocking main shaft 203 is slidably inserted in and supported by a support piece 202*a* extending downward from the spacer base 202.

The spacer 201' is placed on the base surface of the spacer base 202. In this embodiment, the spacer 201' comprises a plurality of flat multilayer spacers 201 each having a predetermined thickness.

The support shaft 205 and the selecting shaft 211 are inserted in the multilayer spacers 201. The multilayer spacer 201 at the end portion is placed on the spacer base 202 such that it is separated from the same plane as that of an inner end face 18*c* of the lower metallic die 18 by a distance corresponding to about one multilayer spacer 201.

A projection 201*a* and a groove 201*b* are formed on the two surfaces of the lower portion of each multilayer spacer 201 so that the adjacent multilayer spacers 201 are engaged with each other. A positioning groove 18*e* engageable with each projection 201*a* is formed in the lower metallic die 18.

A rail 214 is provided to the spacer base 202 at a position on the same plane as that of the inner end face 18*c* of the lower metallic die 18.

A slidable table 212 is slidably provided on the rail 214, and an insertion hole 212*a* for receiving the selecting shaft 211 is formed in the upper portion of the slidable table 212. The portion including the insertion hole 212*a* is clamped by the operation of a cylinder 213, so that the slidable table 212 and the selecting shaft 211 can be axially fixed.

Two links 215 and 218 are foldably connected between the slidable table 212 and the stationary die plate 12 by a central joint 216, and a metal support member 219 and a coupling pin 220 at opposite ends of the links 215 and 218. The joint 216 is coupled to a rod 217*a* of a cylinder 217. The cylinder 217 is pivotally axially supported by a bracket 231 under a stationary base 230 of the metallic die device. Upon operation of the cylinder 217, the slidable table 212 can be slid toward the lower metallic die 18.

As shown in FIG. 38 and a side sectional view of FIG. 40 taken along the line A—A of FIG. 38, inclined surfaces 19*d* are formed on the inner end face 19*c* of the lower metallic die 19 at the predetermined pitch, and adjustment spacers 222 are provided along the inclined surfaces 19*d* to be able to project.

More specifically, an inclined surface 222*a* is formed on each adjustment spacer 222 to correspond to the inclined surfaces 19*d* of the lower metallic die 19, and each adjustment spacer 222 is slidably axially supported on the lower metallic die 19 by a corresponding guide pin 223. A rod 221*a* of each cylinder 221 is coupled to the lower portion of the corresponding adjustment spacer 222. The proximal portion of each cylinder 221 is axially supported on the movable die plate 13.

Press surfaces 222*b* of the adjustment spacers 222 can project from the inner end face 19*c* of the lower metallic die 19. When the cylinders 221 are actuated, the press surfaces 222*b* can continuously project from the inner end face 19*c* toward the multilayer spacers 201 until approaching them at a gap corresponding to one multilayer spacer 201.

The control unit 63 shown in FIG. 41 has a first controller 63*a* for positioning the upper metallic die mechanism 17 and the lower metallic die 19 on the side of the movable die plate 13 and for controlling a servo motor 20 serving as the first driving source, and a second controller 53*b* for controlling a servo motor 58 serving as the second driving source, thereby performing fine adjustment of the upper metallic die mechanisms 16 and 17.

A third controller 63*c* outputs a rotation command for the upper metallic die mechanisms 16 and 17 to the driving source. The bending angles of portions Wa and Wb of a work W are preset in the third controller 63*c* by a setting unit 70 in advance. The third controller 63*c* compares the actual bending angle measured by a measurement unit 65 with the present bending angle, and outputs a command to the corresponding driving source and a fourth controller 63*d* to instruct bending again.

A detection value from a scale detector 172 is input to the fourth controller 63*d*. The fourth controller 63*d* controls a hydraulic cylinder 4 on the basis of this detection value, thereby controlling the operation of a press slider 2.

A detection value from the rotary detector 250 is input to the fifth controller 63*e*, so that the gap between the lower metallic dies 18 and 19 is calculated. Whether or not the cylinder 209 for the step feed rod 208 of the spacer mechanism 200 is actuated is determined in order to insert a number of multilayer spacers 201 corresponding to this gap between the lower metallic dies 18 and 109.

The fifth controller 63*e* calculates the number of multilayer spacers 201 to be inserted on the basis of the detection signal from the rotary detector 250. When the gap between the lower metallic dies 18 and 19 coincides with the total thickness of the multilayer spacers 201, or falls within a range larger than that by ½ the thickness of one multilayer spacer 201, the cylinder 209 is actuated, so that the selecting shaft 211 is moved close to the support shaft 205.

Thereafter, the fifth controller 63*e* actuates the cylinders 213, 217, and 221, thereby controlling the insertion operation of the multilayer spacers 201.

The operation of the metallic die device having the above arrangement will be described.

When the lower metallic die 19 and the upper metallic die mechanism 17 on the side of the movable die plate 13 are to be positioned, a positioning command is input to the servo motor 20 from the first controller 63*a* of the control unit 63 to rotate the servo motor 20, thereby rotating a spline shaft 22.

Then, the screw shaft 40A and a screw shaft 40B are rotated through the corresponding bevel gears to simultaneously move the lower metallic die 19 on the movable die plate 13 and the upper metallic die mechanism 17 on the movable punch plate 11, respectively, by the same distance.

When the lower metallic die 19 and the upper metallic die mechanism 17 reach desired positions, the servo motor 20 is stopped to stop the lower metallic die 19 and the upper metallic die mechanism 17, thereby positioning the lower metallic die 19 and the upper metallic die mechanism 17 at the desired positions.

These positions are detected by the rotary detector 250, and the corresponding detection signals are input to the fifth controller 63*e* of the control unit 63.

When a command value for punch fine adjustment positioning is input from the second controller 63*b* of the control unit 63 to the servo motor 58 for moving the punches for a small distance, the servo motor 58 starts rotation to rotate a driving shaft 56 for punch fine adjustment, and a screw shaft 52 is rotated through the corresponding bevel gear.

Upon rotation of the screw shaft 52, a fine adjustment nut 53*a* threadably engaged with the screw shaft 52 is moved in the right-left direction, and a stationary punch plate 10 is moved as it is guided along upper guide rails 14. Meanwhile, upon rotation of the screw shaft 52, a spline shaft 55 is rotated through a coupler 54, thereby rotating a fine adjustment screw 52*b* fitted on the spline shaft 55.

Upon rotation of the fine adjustment screw 52*b* and movement of a fine adjustment nut 53*b* meshed with the fine adjustment screw 52*b*, the movable punch plate 11 is further moved, from the position where it is positioned by the metallic die positioning servo motor 20, by a small distance.

In this manner, the upper metallic die mechanisms 16 and 17 can be automatically positioned at positions slightly moved toward the lower metallic dies 18 and 19, respectively. Then, the work W is conveyed and positioned at a position to correspond to the respective lower metallic dies 18 and 19, and the respective upper metallic die mechanisms 16 and 17.

Then, the fifth controller 63*e* of the control unit 63 calculates the gap between the lower metallic dies 18 and 19 from the detection signals from the rotary detector 250, and actuates the cylinders 209, 213, and 217, thereby inserting a number of multilayer spacers 201 corresponding to this gap between the lower metallic dies 18 and 19.

First, the fifth controller 63*e* determines whether to actuate the cylinder 209 for the step feed rod 208 of the spacer mechanism 200, by calculating the difference between the gap, between the lower metallic dies 18 and 19, and the total thickness of the multilayer spacers 201.

The one end portion 211*a* of the selecting shaft 211 is located in the multilayer spacer 201 next to the multilayer spacer 201 located at the end portion 205*a* (inner end face 19*c* of the lower metallic die 19) of the support shaft 205.

Then, the fifth controller 63*e* actuates the cylinder 213 to fix the selecting shaft 211 to the slidable table 212.

Thereafter, as shown in the operational view of FIG. 43, the cylinder 217 is actuated to withdraw the joint 216, so that the links 215 and 218 are folded, thereby sliding the slidable table 212 toward the lower metallic die 18. Then, as shown in the operational view of FIG. 44, the selecting shaft 211 is moved toward the lower metallic dies 18 and 19, and a number of multilayer spacers 201 corresponding to or less than the gap between the lower metallic dies 18 and 19 are inserted between the lower metallic dies 18 and 19 in the engaged state.

Thereafter, the fifth controller 63*e* actuates the cylinders 221, as shown in FIG. 40, to insert, with pressure, the adjustment spacers 222 between the multilayer spacer 201 at the end and the lower metallic die 19, thereby eliminating the gap between the multilayer spacers 201 and the lower metallic die 19.

In this state, a plurality of multilayer spacers 201 and the adjustment spacers 222 are inserted between the lower metallic dies 18 and 19.

Thereafter, in order to bend the two sides of the work W at a right angle, the control unit 63 outputs a signal for moving the press slider 2 downward, and the hydraulic cylinder 4 is driven to move a plunger 4A downward. Then, the press slider 2 is moved downward through a pin 6, and the upper metallic die mechanisms 16 and 17 are brought into contact with the work W. Thereafter, the press slider 2 is moved further downward, and the two sides of the work W are simultaneously bent at the right angle.

At this time, as the press slider 2 is moved downward, a bevel gear 35 of the press slider 2 is moved downward as it slides in the groove of the spline shaft 22.

When the work W is subjected to predetermined bending, since the multilayer spacers 201 and the adjustment spacers 222 are inserted between the lower metallic dies 18 and 19, escape or deformation does not occur in the lower metallic die 18 or 19, and the work W can be bent at high precision.

After the work W is bent, the press slider 2 reaches the lower dead point and then starts to move upward, and is stopped at the uppermost position as the upper dead point.

When the two sides of the work W are to be bent at an angle other than the right angle, the third controller 63*c* of the control unit 63 rotates the pivotal upper metallic dies 101 and 102 of the upper metallic die mechanisms 16 and 17, respectively, by the corresponding driving sources in accordance with the lower position of the press slider 2.

Then, the pivotal upper metallic dies 101 and 102 can bend the two sides of the work W simultaneously at predetermined angles. The maximum bending angles of the two sides of the work W are set at the inclination angles of the inclined surfaces 18*b* and 19*b*.

In this case, since the multilayer spacers 201 and the adjustment spacers 222 are inserted between the lower metallic dies 18 and 19, escape or deformation of the lower metallic die 18 or 19 can be prevented, thereby performing high-precision bending.

Thereafter, the pivotal upper metallic dies 101 and 102 are set at the vertical state, and the press slider 2 is moved upward to return to the upper dead point as the uppermost position.

A case will be described wherein the bending width, thickness, or material of the work W is to be changed. In this case, the servo motor 20 is driven by a positioning command signal from the first controller 63*a* of the control unit 63 to move the lower metallic die 19 and the upper metallic die mechanisms 16 and 17, and the servo motor 58 is driven by a punch fine positioning command to move the upper metallic die mechanisms 16 and 17 by a small distance, thus performing required adjustment. Thereafter, the work W is bent in accordance with the same operation as described above. In this case, since the multilayer spacers 201 and the adjustment spacers 222 are kept inserted between the lower metallic dies 18 and 19 by the spacer mechanism 200, high-precision bending can be performed.

In this modified embodiment, the multilayer spacers 201 are inserted between the lower metallic dies 18 and 19. However, the multilayer spacers 201 (spacer 201') can be inserted between divided upper metallic dies 16 and 17, while obtaining the same effect as that of the above embodiment.

According to the metallic die device for the press machine of the third modified embodiment of the present invention, spacers and adjusting spacers are inserted between divided lower metallic dies. Therefore, escape or deformation of a lower or upper metallic die upon application of a pressing force of a work can be prevented, and high-precision pressing can be performed.

According to the third modified embodiment of the present invention, a plurality of multilayer spacers are provided in advance on the side portion of a lower or upper metallic die, and a number of multilayer spacers corresponding to the gap between the divided metallic dies can be automatically and quickly inserted between the metallic dies. This can easily cope with a change in the gap between the metallic dies. High-precision bending of all works having various sizes is enabled.

Additional embodiments of the present invention will be apparent to those skilled in the art from consideration of the specification and practice of the present invention disclosed herein. It is intended that the specification and examples be considered as exemplary only, with the true scope of the present invention being indicated by the following claims.

What is claimed is:

1. A metallic die device for a press machine, in which upper and lower metallic dies for bending a flat workpiece are assembled in a press machine, each of said upper and lower metallic dies is divided, and at least a pair of divided upper and lower metallic dies are movably positionable, said die device comprising:

upper metallic die bases having pivot axes for pivoting said divided upper metallic dies;

reference surfaces, formed on said upper metallic die bases, for holding said upper metallic dies in a reference state;

a press member for pressing said upper metallic dies against said reference surfaces and which is retracted upon application of a large force thereon;

metallic backup members, spaced apart from said divided lower metallic dies, for guiding said upper metallic dies when said upper metallic dies are moved downward;

lower bases having pivot centers for changing angles of guide surfaces of said metal backup members;

driving means for determining the angles of said guide surfaces of said metal backup members;

a coupling member for transmitting movement of said driving means to said metal backup members; and a control unit for supplying a command representing a moving amount to said driving means.

2. A die device according to claim 1, further comprising:

power supplies for moving said metal backup members and said lower bases in back and forth directions;

metal positioning members for determining stop positions of said lower bases;

a further driving means for moving and positioning said metal positioning members;

a coupling mechanism for transmitting movement of said further driving means to said metal positioning members; and said control unit supplying a command representing a moving amount to said further driving means.

3. A die device according to claim 1, further comprising;

a scale and a detector respectively provided on a sliding member and a stationary member of said device, for measuring lower positions of said divided upper metallic dies; and wherein said control unit supplies a command to said driving means in order to change the angles of said metal backup members to correspond to the detected lower positions.

4. A die device according to claim 3, wherein said control unit performs control in which slight movement of said divided upper metallic dies and movement to change the angles of said metal backup members are interlocked in accordance with the lower positions detected by said detector.

5. A die device according to claim 1, further comprising:

two measurement mechanisms, brought into contact with measurement surfaces, as bent portions, of the workpiece after said divided upper metallic dies finish downward movement and are returned to move in an upward direction, for measuring sizes of the bent portions and wherein said control unit supplies an angle correcting command to said driving means in accordance with measured amounts of the bent portions.

6. A die device according to claim 5, wherein:

said two measurement mechanisms are used as a pair to measure remote portions of a same measurement surface; and said control unit supplies an angle correcting command to said driving means in accordance with a difference between values obtained by said two measurement mechanisms.

7. A die device according to claim 1, wherein said driving means is independently provided for each of said lower metallic die bases for changing the angles of said edge portions of said upper metallic dies that perform bending.

8. A metallic die device for press machine, comprising:

upper and lower metallic dies, assembled in the press machine, for bending a workpiece, each of said upper and lower metallic dies being divided, and at least a pair of divided upper and lower metallic dies being movably positionable;

upper metallic die bases having rotation axes for rotating said divided upper metallic dies;

major reference surfaces, formed on said upper metallic die bases, for holding said upper metallic dies at a reference angle;

a press member for pressing said upper metallic dies against said reference surfaces of said upper metallic die bases, and which is retracted upon application of a large force thereon;

metal backup members, spaced apart from said divided lower metallic dies, for guiding said upper metallic dies when said upper metallic dies are moved downward;

lower bases having rotation centers for changing angles of guide surfaces of said metal backup members;

driving means for determining the angles of said guide surfaces of said metal backup members; and a control unit for supplying a command representing a moving amount to said driving means.

9. A die according to claim 8, further comprising:

power supplies for moving said metal backup members and said lower bases in back and forth directions;

metal positioning members for determining stop positions of said lower bases;

a further driving means for moving and positioning said metal positioning members; and said control unit supplying a command representing a moving amount to said further driving means.

* * * * *

UNITED STATES PATENT AND TRADEMARK OFFICE

CERTIFICATE OF CORRECTION

PATENT NO. : 5,462,424
DATED : October 31, 1995
INVENTOR(S) : KUROYONE

It is certified that error appears in the above-indentified patent and that said Letters Patent is hereby corrected as shown below:

In the Title Page, under Section [30]

FOREIGN APPLICATION PRIORITY DATA,

Delete "Apr. 24, 1992 [JP] Japan....4-106916".

Delete "Apr. 27, 1992 [JP] Japan....4-107953".

Delete "May 27, 1992 [JP] Japan....4-134759".

Signed and Sealed this

Twelfth Day of March, 1996

Bruce Lehman

*Attest:*

BRUCE LEHMAN

*Attesting Officer*

*Commissioner of Patents and Trademarks*